US008388368B2

(12) United States Patent
Li et al.

(10) Patent No.: US 8,388,368 B2
(45) Date of Patent: Mar. 5, 2013

(54) LIGHTING CONNECTOR DEVICES AND USES THEREOF

(75) Inventors: Eddie Ping Kuen Li, Hong Kong (CN); Sue-Anne Tean Leung, Hong Kong (CN)

(73) Assignee: Huizhou Light Engine Ltd., Huizhou (CN)

( * ) Notice: Subject to any disclaimer, the term of this patent is extended or adjusted under 35 U.S.C. 154(b) by 0 days.

(21) Appl. No.: 13/414,596

(22) Filed: Mar. 7, 2012

(65) Prior Publication Data

US 2012/0220158 A1 Aug. 30, 2012

Related U.S. Application Data

(60) Division of application No. 12/911,651, filed on Oct. 25, 2010, now Pat. No. 8,187,022, which is a continuation-in-part of application No. 12/771,844, filed on Apr. 30, 2010, now Pat. No. 8,187,021.

(60) Provisional application No. 61/174,980, filed on May 1, 2009.

(51) Int. Cl.
*H01R 11/20* (2006.01)
*H01R 4/24* (2006.01)
*H01R 4/26* (2006.01)

(52) U.S. Cl. ..... 439/426

(58) Field of Classification Search ..... 439/426, 439/425

See application file for complete search history.

(56) References Cited

U.S. PATENT DOCUMENTS

| | | | |
|---|---|---|---|
| 2,820,843 | A | 1/1958 | Dreher |
| 4,841,420 | A | 6/1989 | Baggio et al. |
| 5,041,953 | A | 8/1991 | Dannatt |
| 5,179,339 | A | 1/1993 | Volk, Jr. |
| 5,435,747 | A | 7/1995 | Franckx et al. |
| 7,156,686 | B1 | 1/2007 | Sekela et al. |
| 7,160,140 | B1 | 1/2007 | Mrakovich et al. |
| 7,988,332 | B2 | 8/2011 | Lo et al. |
| 2007/0058377 | A1 | 3/2007 | Zampini et al. |
| 2007/0109710 | A1 | 5/2007 | Milan |
| 2007/0249204 | A1 | 10/2007 | Petersen et al. |
| 2008/0081507 | A1 | 4/2008 | Mahajan |
| 2008/0137332 | A1 | 6/2008 | Lo et al. |
| 2008/0252234 | A1 | 10/2008 | MacKenzie et al. |
| 2009/0154156 | A1 | 6/2009 | Lo et al. |
| 2010/0279539 | A1 | 11/2010 | Lo et al. |

FOREIGN PATENT DOCUMENTS

| | | | |
|---|---|---|---|
| WO | WO-90/14698 | A1 | 11/1990 |
| WO | WO-2010/082967 | A1 | 7/2010 |

OTHER PUBLICATIONS

PCT Notification of Transmittal of the International Search Report and the Written Opinion of the International Searching Authority, or the Declaration dated Jan. 14, 2011 in connection with PCT International Application No. PCT/US10/56747.

PCT International Search Report dated Sep. 6, 2010 in connection with PCT International Application No. PCT/EP2010/055909.

(Continued)

*Primary Examiner* — Javaid Nasri
(74) *Attorney, Agent, or Firm* — Cindy Yang

(57) ABSTRACT

A multi-way connector connects a plurality of lighting apparatuses together, wherein connector comprises a plurality of lighting connectors, each lighting connector comprising an upper housing having plural connector pins, and one or more interlocking grooves; and a lower housing which has a plurality of connector pin guide holes, and one or more interlocking tongue portions, the lower housing being connectable with the upper housing to form each lighting connector by coupling at least one of the interlocking grooves with at least one of the interlocking tongue portions, and by coupling at least one of the plural connector pins with at least one of the connector pin guide holes; a multi-way connecting portion configured to permit power and/or signals to pass between and among the plurality of lighting connectors; and plural flexible connectors electrically connecting each lower housing with the multi-way connecting portion.

9 Claims, 68 Drawing Sheets

OTHER PUBLICATIONS

PCT Notification of Transmittal of the International Search Report and the Written Opinion of the International Searching Authority, or the Declaration in connection with PCT International Application No. PCT/EP2010/055909.

PCT Written Opinion of the International Searching Authority in connection with PCT International Application No. PCT/EP2010/055909.

Office Action issued by USPTO for U.S. Appl. No. 12/771,844, mail date Nov. 25, 2011.

EPO's Communication pursuant to Article 94(3) EPC issued for EP 10 721 377.9, dated Aug. 10, 2012.

LIGHTING CONNECTOR DEVICES AND USES THEREOF

CROSS-REFERENCE TO RELATED APPLICATIONS

This application is a divisional of U.S. Ser. No. 12/911,651, filed on Oct. 25, 2010, now U.S. Pat. No. 8,187,022, which is a continuation-in-part of U.S. Ser. No. 12/771,844, filed Apr. 30, 2010, now U.S. Pat. No. 8,187,021, which claims benefit under 35 U.S.C. §119(e) of U.S. Provisional Application No. 61/174,980, filed May 1, 2009, each of which is hereby incorporated by reference.

Throughout this application, several patent applications and references are referenced. Disclosure of these patent applications and references in their entirety is hereby incorporated by reference into this application.

BACKGROUND OF THE INVENTION

The present invention relates generally to connector devices and more particularly to such devices which electrically and mechanically connect, at a variety of angles with respect to each other, segments of a lighting apparatus (such as light wires, cables, bars or tubes which are protected by an encapsulant (e.g., the integrally formed single piece light-emitting diode ("LED") light wire described in U.S. Ser. No. 11/854,145, filed Sep. 12, 2007, and U.S. Ser. No. 12/355,655, filed Jan. 16, 2009) or protective sheath(es), cover(s) or layer(s)), and the uses thereof.

BRIEF SUMMARY OF THE INVENTION

In accordance with a first aspect, a multi-way connector connects a plurality of lighting apparatuses together. The multi-way connector comprises: (a) a plurality of lighting connectors, each lighting connector comprising: (i) an upper housing having: plural connector pins, and one or more interlocking grooves; and (ii) a lower housing, the lower housing having a plurality of connector pin guide holes, and one or more interlocking tongue portions, the lower housing being connectable with the upper housing to form each lighting connector by coupling at least one of the one or more interlocking grooves with at least one of the one or more interlocking tongue portions, and by coupling at least one of the plural connector pins with at least one of the connector pin guide holes; (b) a multi-way connecting portion configured to permit power and/or signals to pass between and among the plurality of lighting connectors; and (c) plural flexible connectors electrically connecting an inner side of each lower housing with the multi-way connecting portion.

In another aspect, each of the plural connector pins comprises an embedded portion situated within the upper housing, and plural protruding portions, at least one of the protruding portions being configured to couple with a respective corresponding one of the at least one connector pin guide holes.

In another aspect, each lower housing further comprising at least one opening for receiving an end portion of a length of lighting apparatus.

In another aspect, each lower housing further comprising a gasket in a lining of the at least one opening.

In another aspect, each of the connector pins are made of an electrically conductive material.

In another aspect, the embedded portion of each of the connector pins is insert-molded into the upper housing.

In another aspect, the protruding portions of each of the connector pins comprise a barbed tip, inverted "V" tip, or a "U" tip.

In another aspect, the upper and lower housings are made of a thermoplastic.

In another aspect, the multi-way connector is a T-connector configured to connect three lighting connectors to one another.

In another aspect, the multi-way connector is an X-connector configured to connect four lighting connectors to one another.

In accordance with another aspect, a multi-way splitter is provided for supplying power and/or signals to plural lighting connectors, each comprising: (a) an upper housing having: plural connector pins, and one or more interlocking grooves; (b) a lower housing having a plurality of connector pin guide holes, and one or more interlocking tongue portions; (c) a connector plug and (d) a flexible connector electrically connecting an inner side of the lower housing with the connector plug, the lower housing being connectable with the upper housing to form the lighting connector by coupling at least one of the one or more interlocking grooves with at least one of the one or more interlocking tongue portions, and by coupling at least one of the plural connector pins with at least one of the connector pin guide holes, the multi-way power splitter comprising: a power/signal plug connectible to a source of power and/or signals; a flexible connector extending from the power/signal plug; a splitting portion, configured to split power and/or signals from the source of power and/or signals multiple ways and apply the power and/or signals to the plural lighting connectors via plural flexible connectors extending from the splitting portion.

In another aspect, the splitting portion splits the power and/or signals four ways.

In accordance with another aspect, a lighting system is provided comprising plural lighting connectors connected together using the multi-way splitter.

In accordance with another aspect, a lighting system is provided comprising plural lighting connectors connected together using at least one multi-way connector.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which:

FIG. 41 is a perspective view of a T-connector in accordance with the eighth embodiment;

FIGS. 51A to 52 are views of the power splitter of FIG. 50 coupled with plural lighting apparatuses according to the seventh embodiment of the present invention.

DETAILED DESCRIPTION OF THE INVENTION

Figure 1:
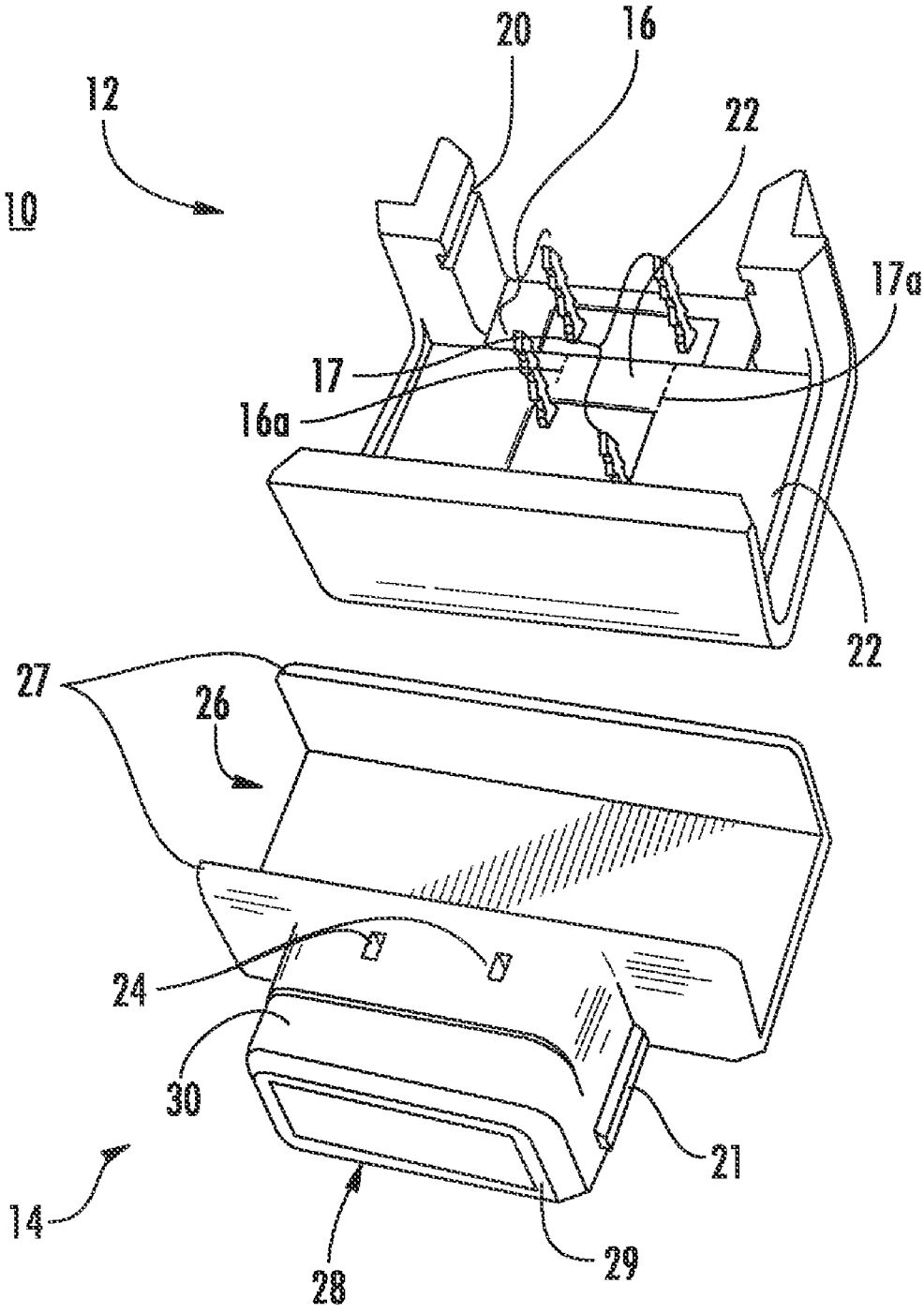
FIG. 1 is a view of a disassembled T-branch lighting connector in accordance with a first embodiment of the present invention.
Figure 2:
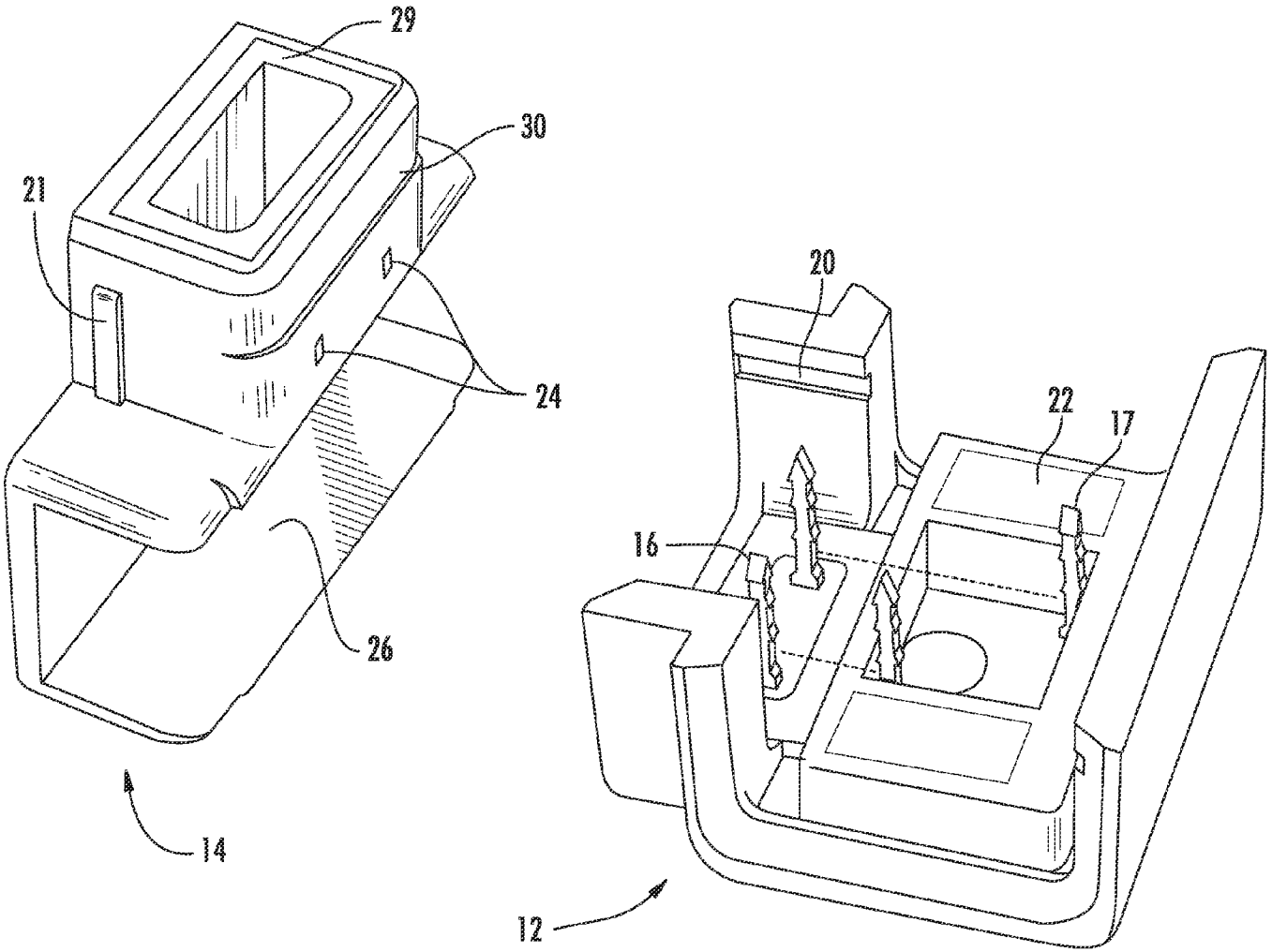
FIG. 2 is another view of a disassembled T-branch lighting connector in accordance with a first embodiment of the present invention.
Figure 3:
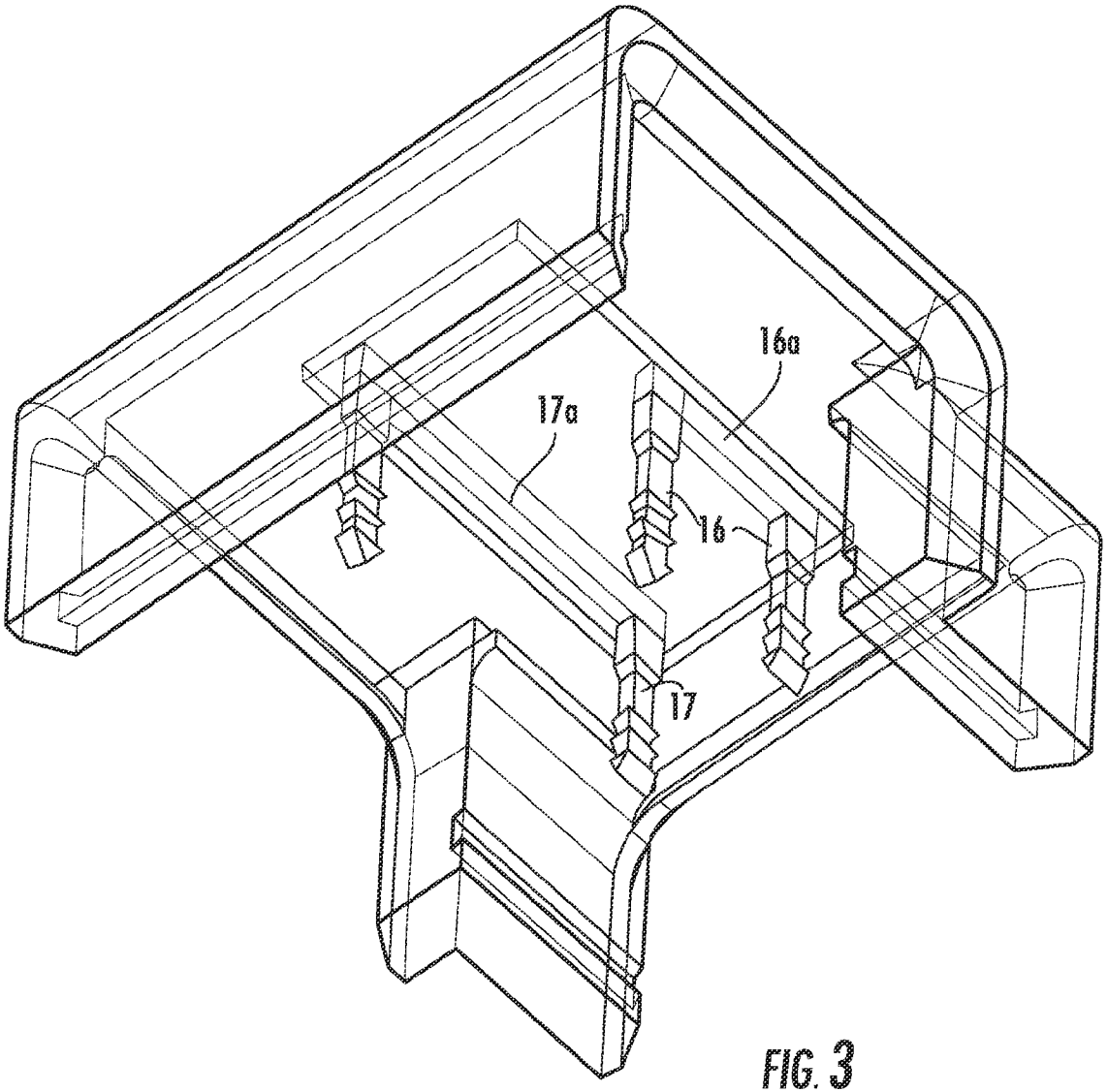
FIG. 3 is an X-ray view of an upper housing in accordance with a first embodiment of the present invention.
Figure 4A:
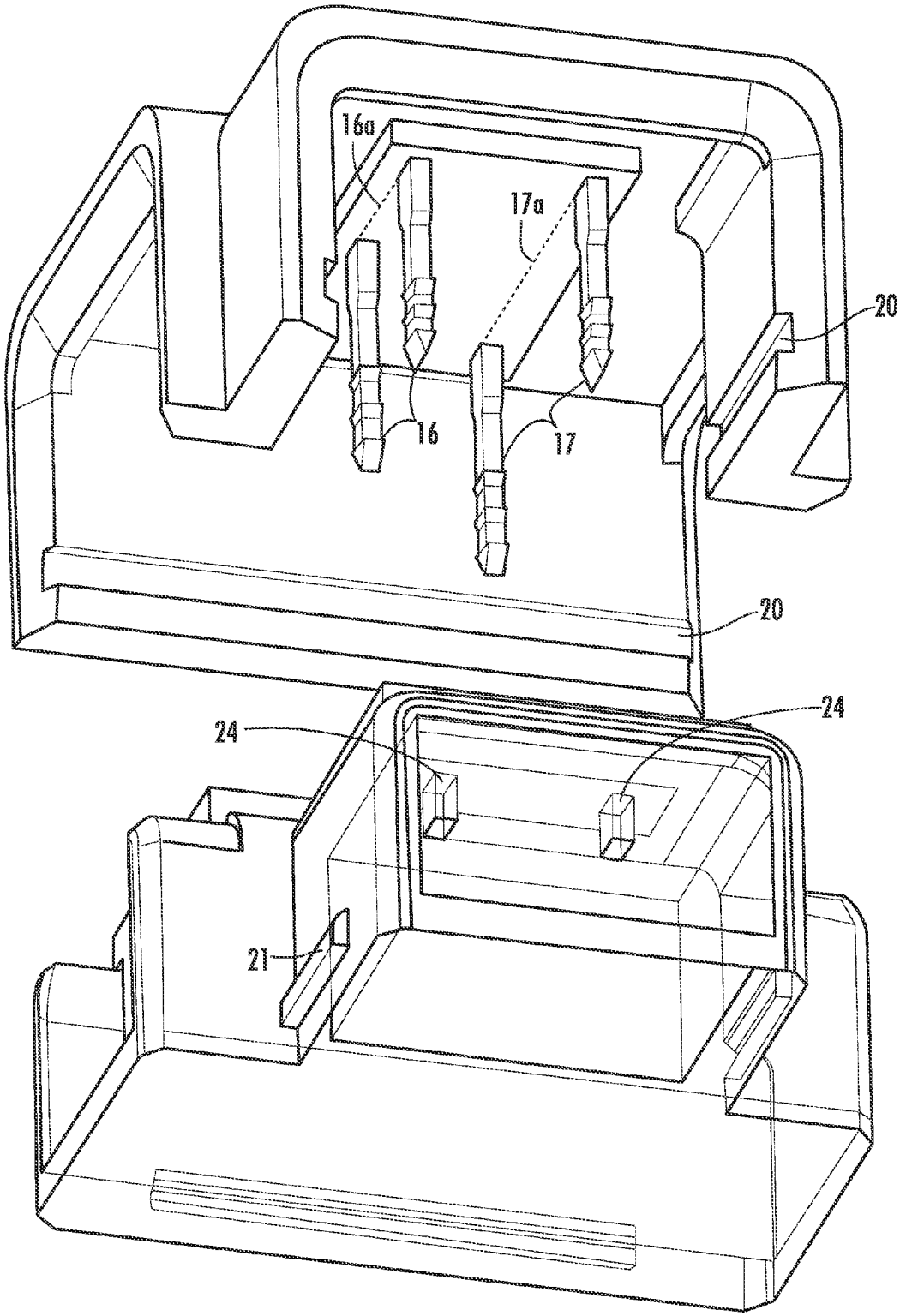
FIGS. 4A-4C, 5A and 5B are exploded and X-ray views of a disassembled T-branch lighting connector in accordance with a first embodiment of the present invention.
Figure 4B:
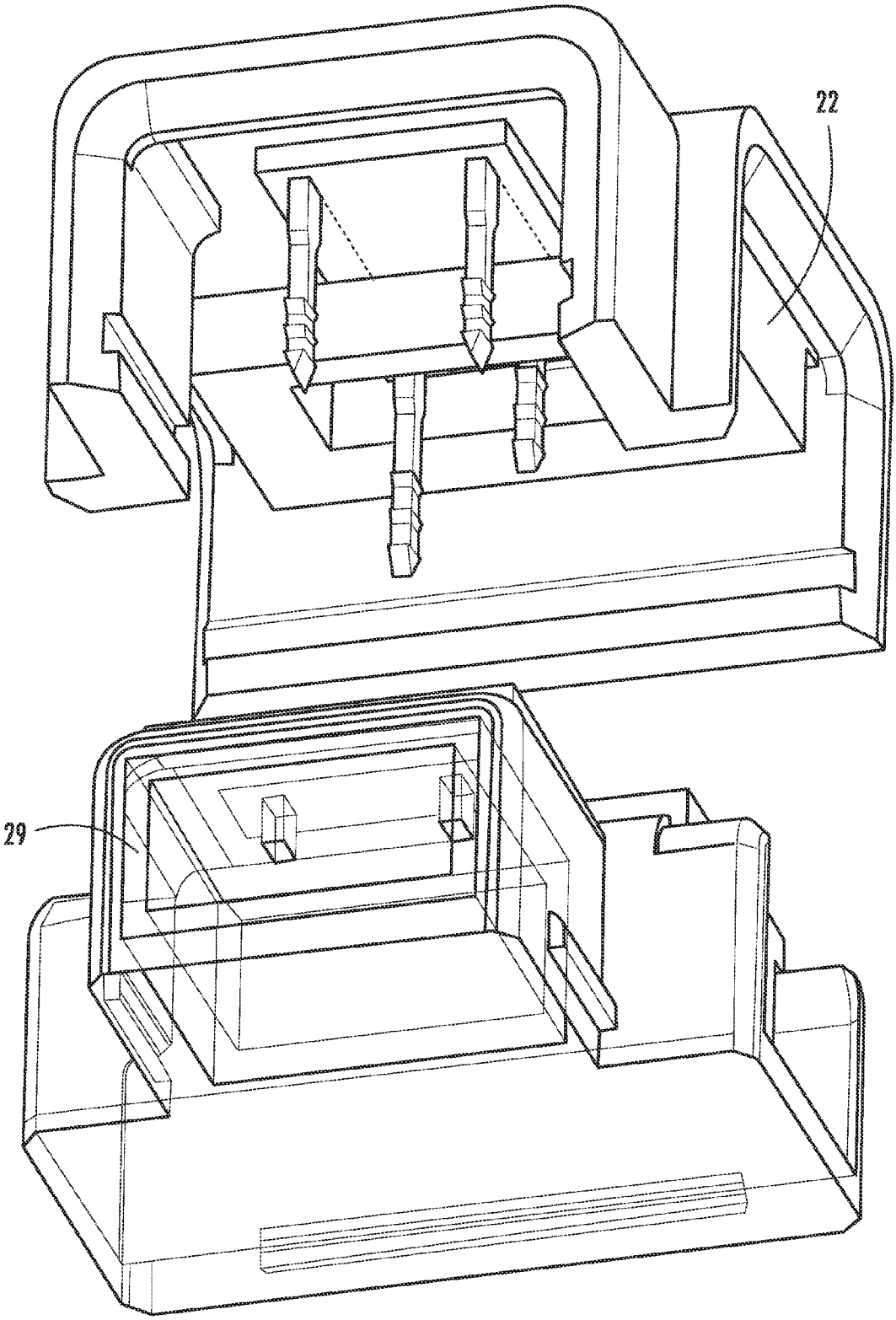
Figure 4C:
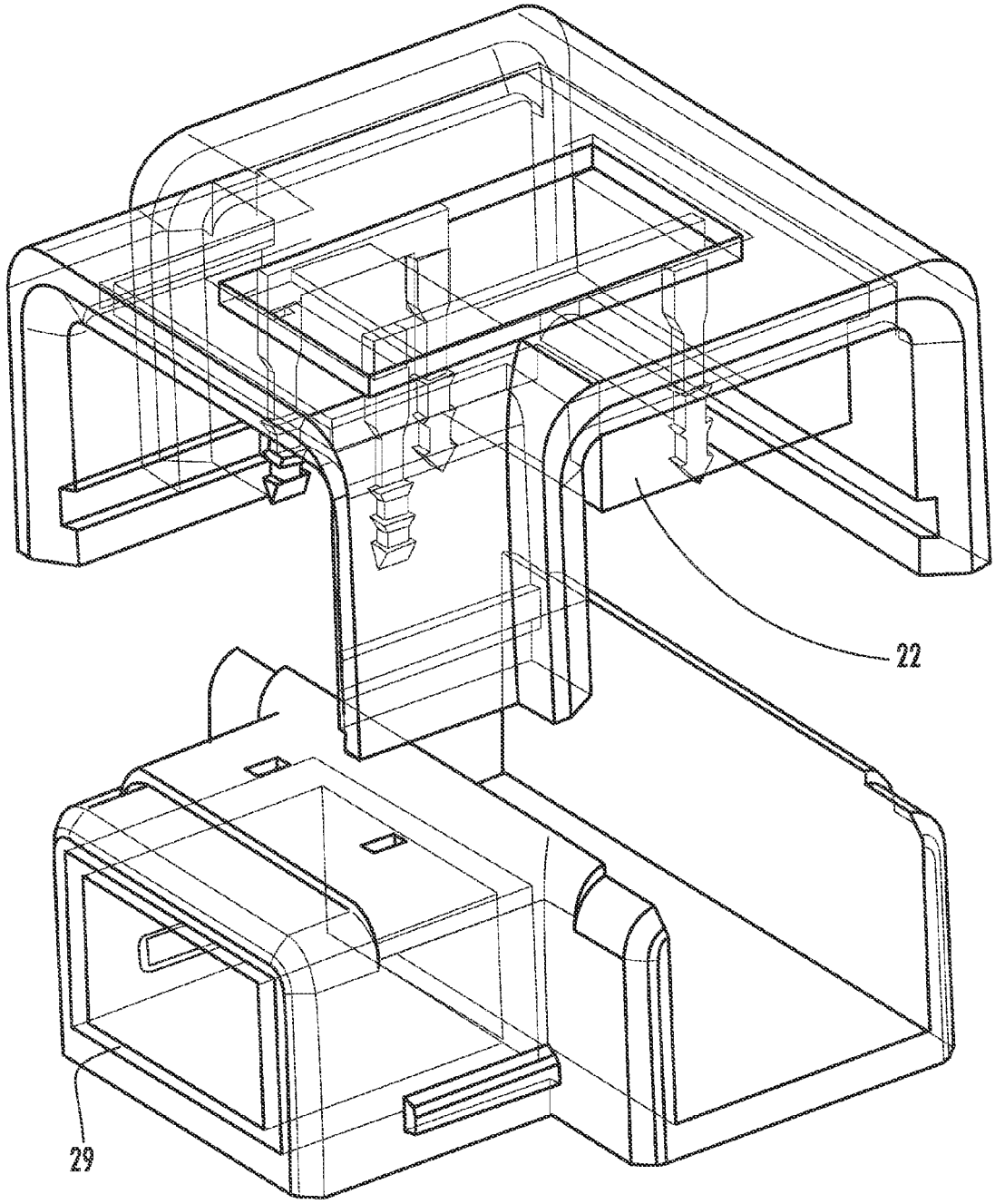

According to the various embodiments, a lighting connector is formed using an upper and lower housing and connector pins. In accordance with the disclosed embodiments, connector pins formed in the upper housing are situated within the upper housing such that, when the upper housing is mated with the lower housing, and plural segments or portions of hard and/or flexible lighting apparatus, such as an LED light wire, cable, bar or tube, are configured therebetween, an electrical and mechanical connection between the portions of lighting apparatus is effected by the connector pins.

As shown in FIGS. 1-7, in accordance with a first preferred embodiment, a T-branch lighting connector 10 is formed from an upper housing 12 and a lower housing 14. The upper housing 12 has connector pins 16 and 17. Connector pin 16 includes protruding portions extending from the upper housing, and an embedded portion 16*a*, shown in phantom, formed within the housing perpendicularly to and connecting the protruding portions. Connector pin 17 similarly includes protruding portions and an embedded portion 17*a*. As will be described in more detail below, each connector pin forms a connection between a first lighting apparatus 31 that connects with the connector from a first direction, and a second lighting apparatus 32 that connects with the connector from a second direction.

Figure 5A:
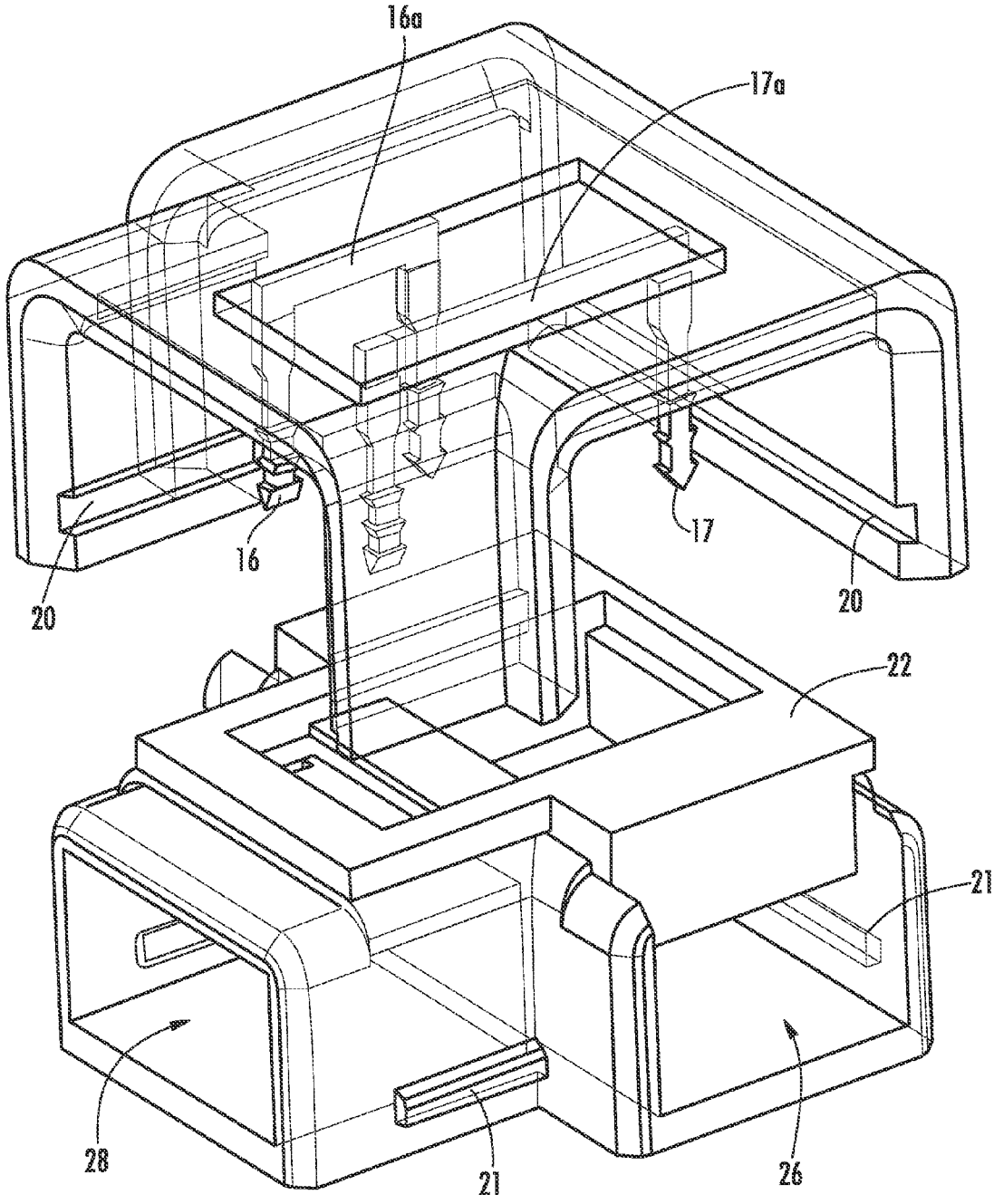
Figure 5B:
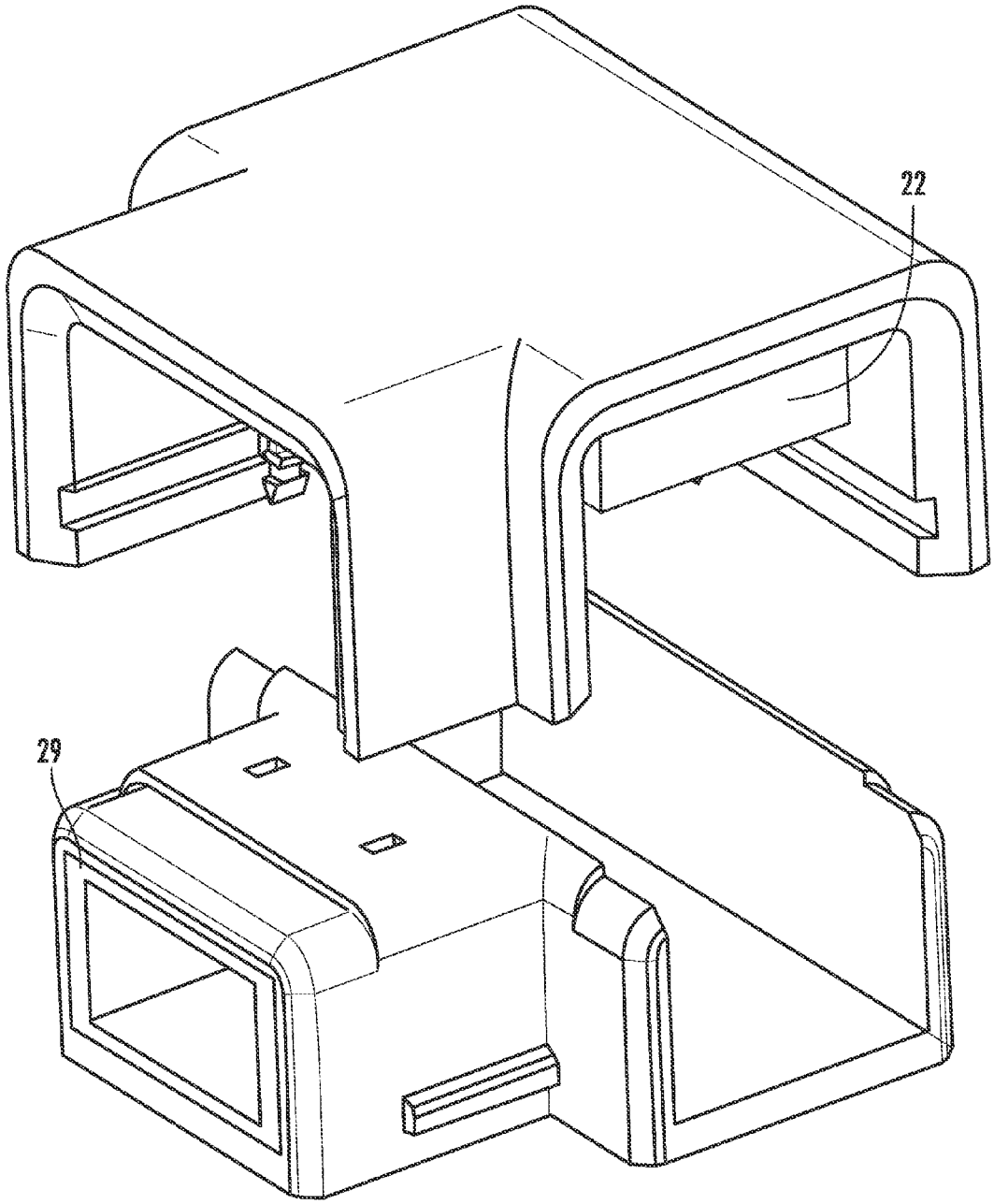

The upper housing includes interlocking groove(s) 20 and a gasket 22. The interlocking groove(s) 20 mate with interlocking tongue(s) 21 in the lower housing 14 to achieve a secure connection, e.g., a snap fit, between the upper and lower housing when the connector is assembled. The gasket 22 is used to ensure a tight fit of the housings and the lighting apparatuses when the connector has been assembled. While shown in the figure as being associated with the upper housing 12, the gasket can be provided separately, and placed between the upper and lower housings during assembly of the connector, for example as shown in FIG. 5A.

The lower housing 14 includes plural connector pin guide holes 24, a slot 26, formed by walls 27, and an opening 28. In the T-branch embodiment, an end portion of a first length of lighting apparatus 31 is inserted into the opening 28 for connection to a second length of lighting apparatus 32 that will be located in a slot 26, perpendicular to the first length of lighting apparatus, as can be seen particularly in FIGS. 6A, 6B and 7. An opening gasket 29 lines the opening 28 in the lower housing, as can be seen, for example, in FIGS. 4B, 4C, 5B and 6B. The lower housing 14 also includes a gasket groove 30. The opening gasket 29, e.g., prevents water leaking between the lower housing 14 and the lighting apparatus inserted into the opening 28.

To assemble the connector 10, the upper housing 12 is coupled with the lower housing 14 via the corresponding interlocking groove(s) 20 and tongue(s) 21. When pressing the upper housing 12 and the lower housing 14 together, one end of each of the connector pins 16 and 17 on the upper housing are matched with their corresponding connector pin guide holes 24 on the lower housing. The connector pins/connector pin guide holes guide the upper housing and lower housing in a manner which permits easy coupling of the corresponding interlocking groove(s) and tongue(s). The other ends of each of the connector pins penetrate into the lighting apparatus 32.

Preferably the tips of each connector pin are configured to increase the contact area between the connector pin and a conductive bus of the lighting apparatus, e.g., conductor bus 31*a* or conductor bus 32*a*, as shown in FIG. 6. To achieve this function, the tip can be in the shape of an inverted "V" or "U."

When assembling the connector 10, the pressure caused by the coupling of the interlocking groove(s) 20 and tongue(s) 21, as well as the penetration of one end of each of the connector pins 16 and 17 through the opening gasket 29 and into an encapsulant or protective sheath(es), cover(s) or layer(s) of a lighting apparatus (such as an LED light wire, cable, bar or tube), creates a waterproof seal between the upper housing 12 and lower housing 14, between the opening gasket 29 and the lighting apparatus 31, and, in the case of the T-branch shaped lighting connector device of the first embodiment, between the upper housing 12 and the lighting apparatus 32. Specifically, the upper housing gasket 22 tightly presses onto the corresponding gasket groove 30 and/or lighting apparatus; thereby creating a tight pressure seal. Further, the opening gasket 29 tightly presses the lighting apparatus via pressure insertion of the lighting apparatus into the opening 28, and the penetration of the connector pins 16 and 17 into the lighting apparatus.

Figure 6A:
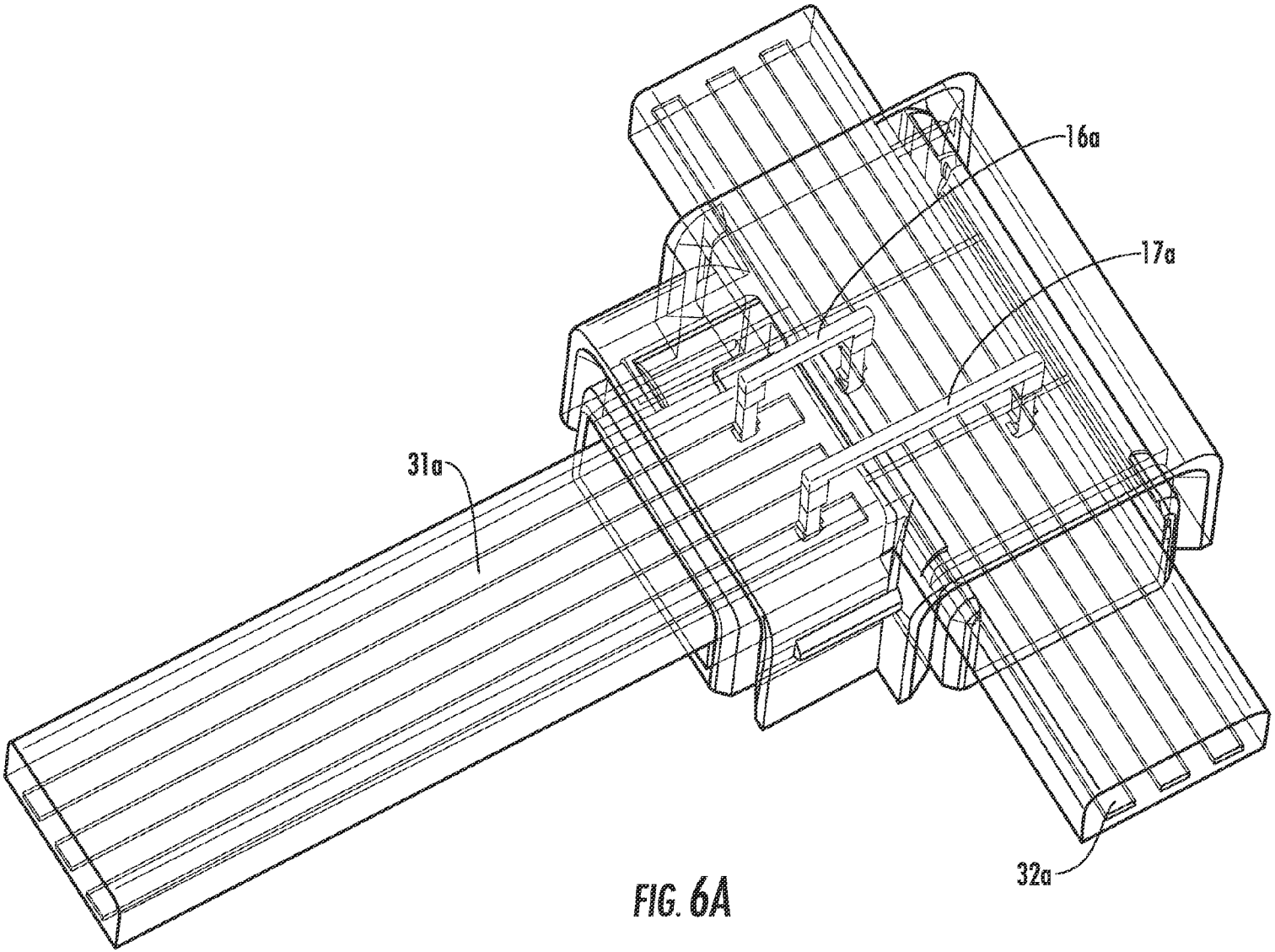
FIGS. 6A and 6B are X-ray views of an assembled T-branch lighting connector in accordance with a first embodiment of the present invention.
Figure 6B:
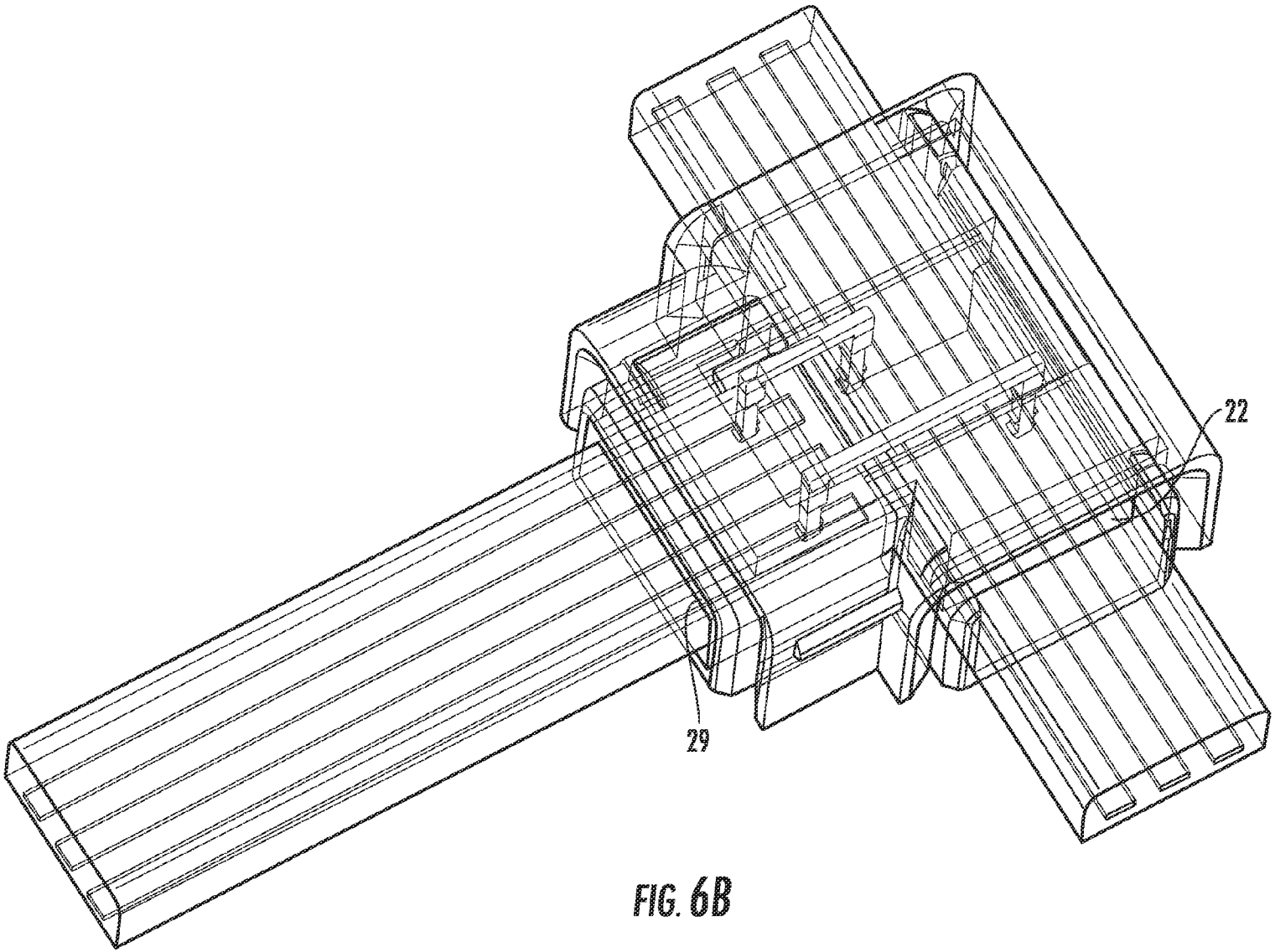
Figure 7:
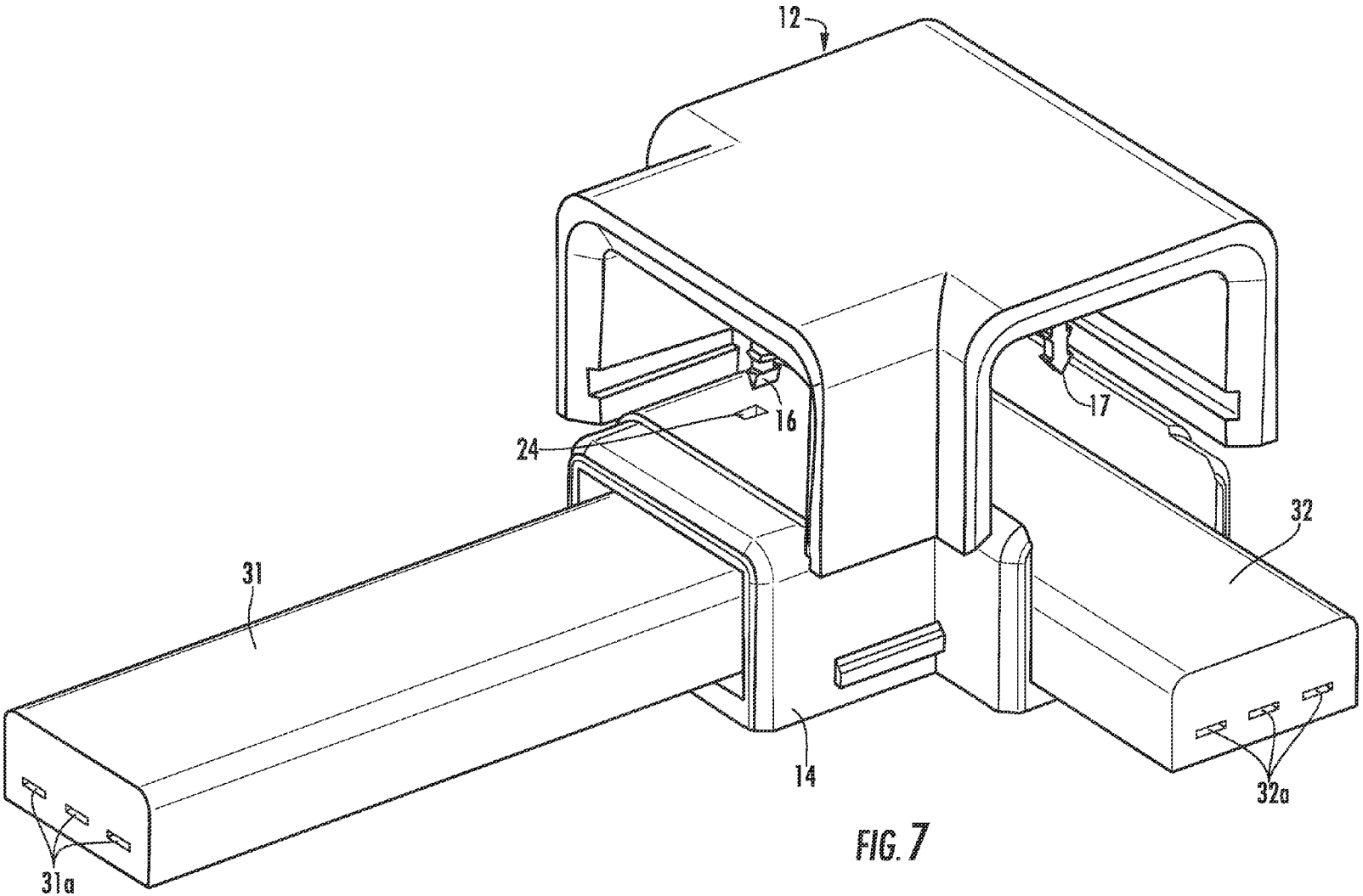
FIG. 7 is a perspective view of a disassembled T-branch lighting connector in accordance with a first embodiment of the present invention showing how lengths of lighting apparatus are connected to the lighting connector.
Figure 8:
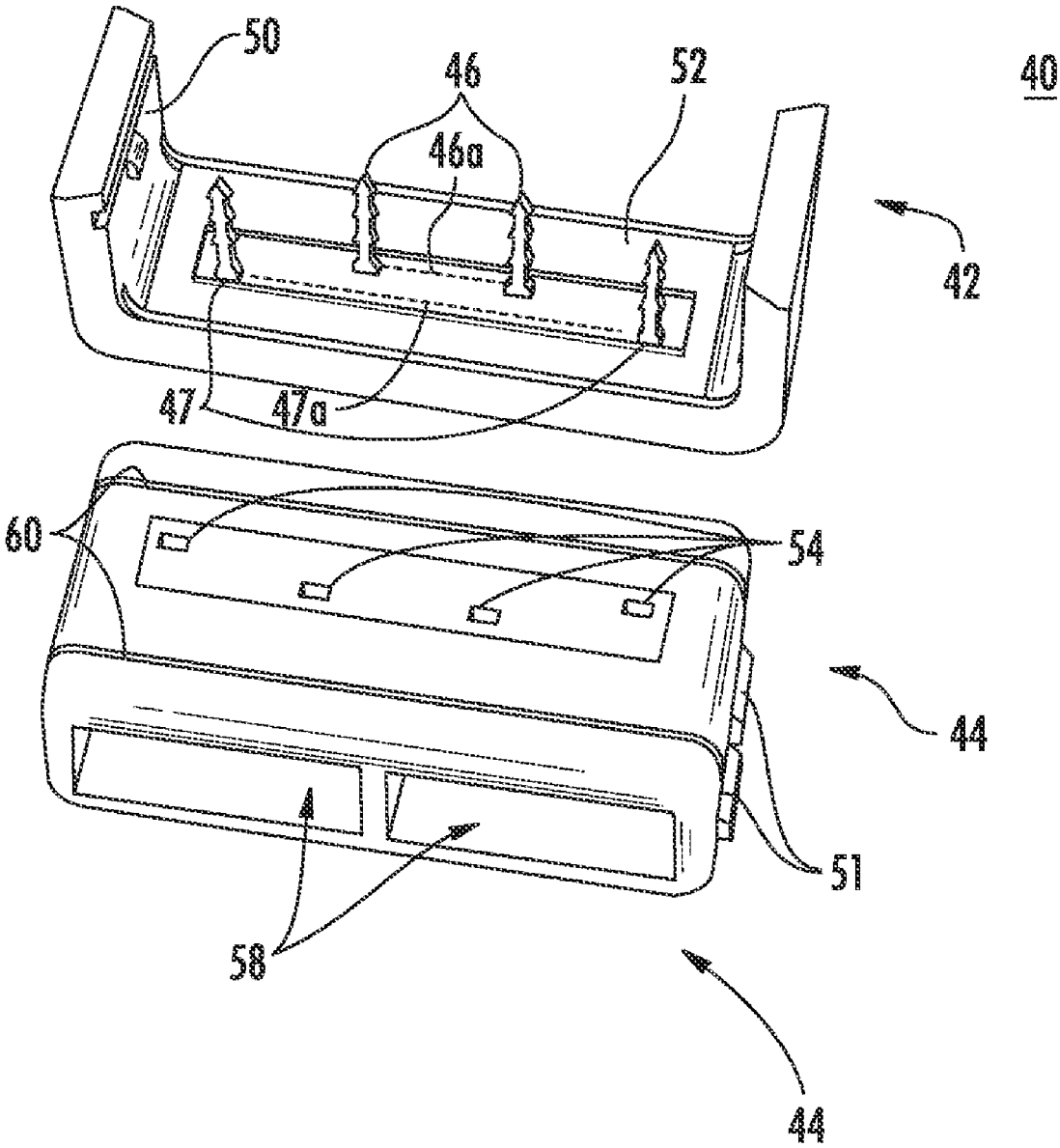
FIG. 8 is a view of a disassembled U-branch lighting connector in accordance with a second embodiment of the present invention.
Figure 9A:
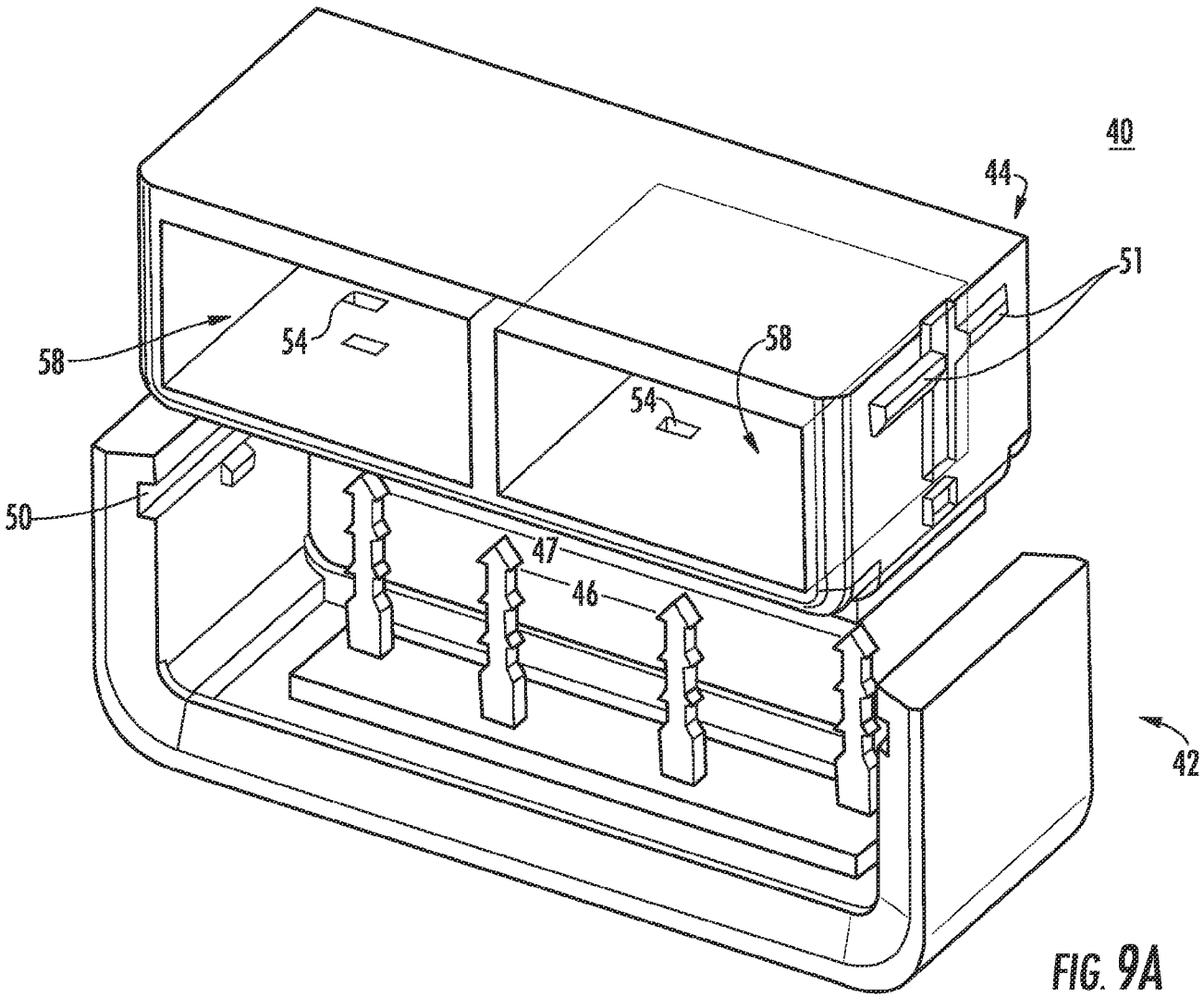
FIGS. 9A and 9B are additional views of a disassembled U-branch lighting connector in accordance with a second embodiment of the present invention.
Figure 9B:
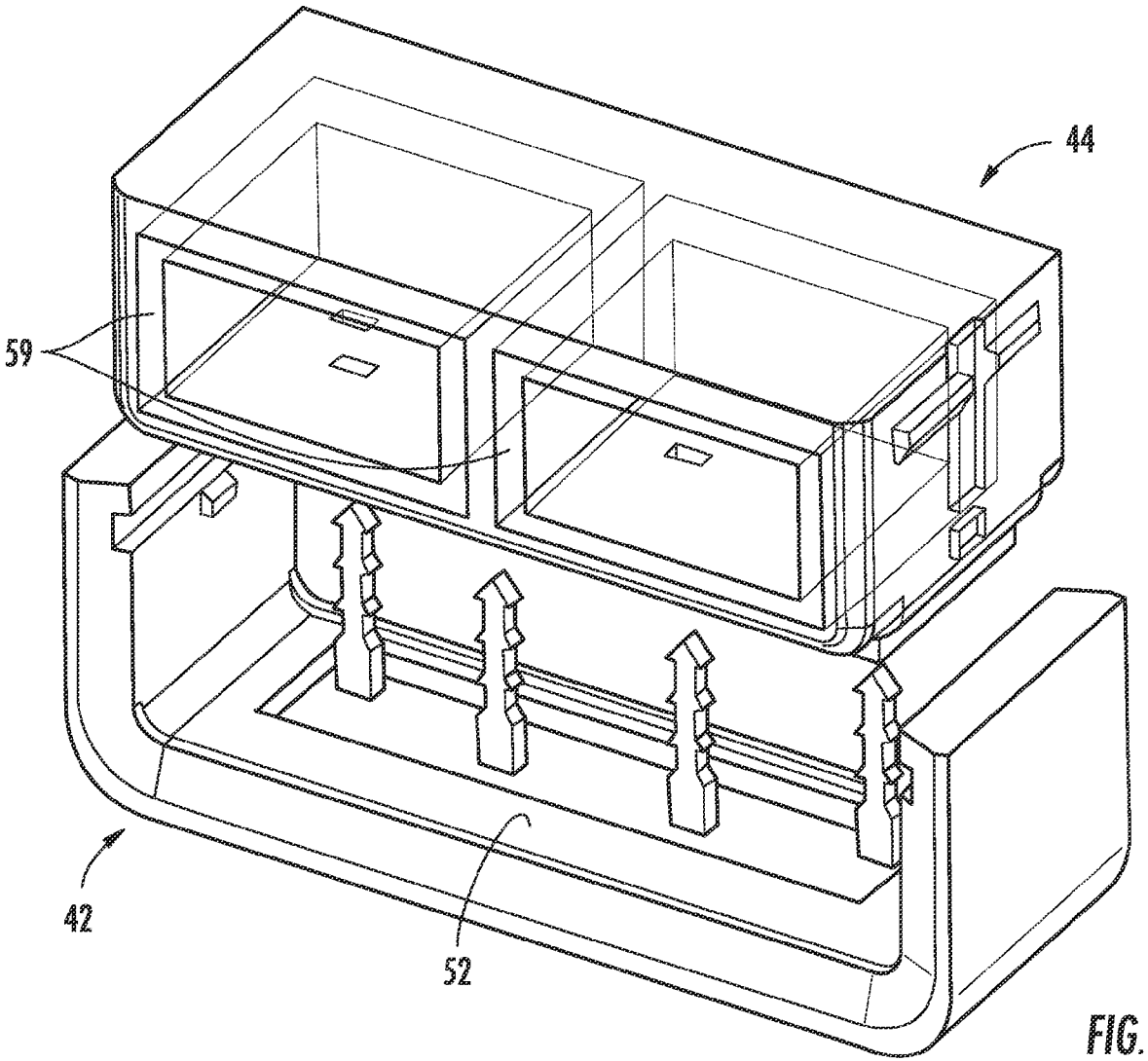
Figure 10:
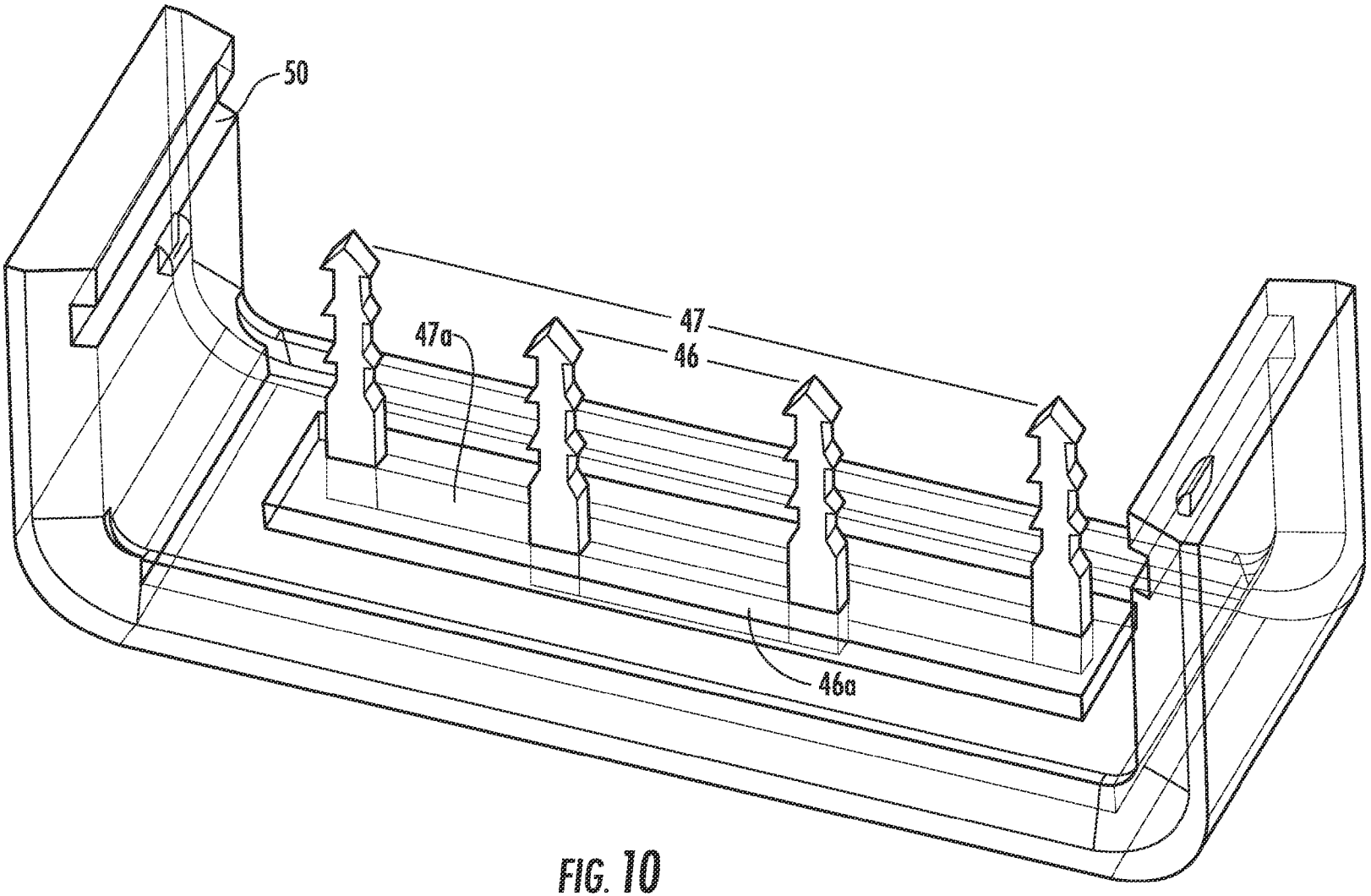
FIG. 10 is an X-ray view of an upper housing in accordance with a second embodiment of the present invention.
Figure 11A:
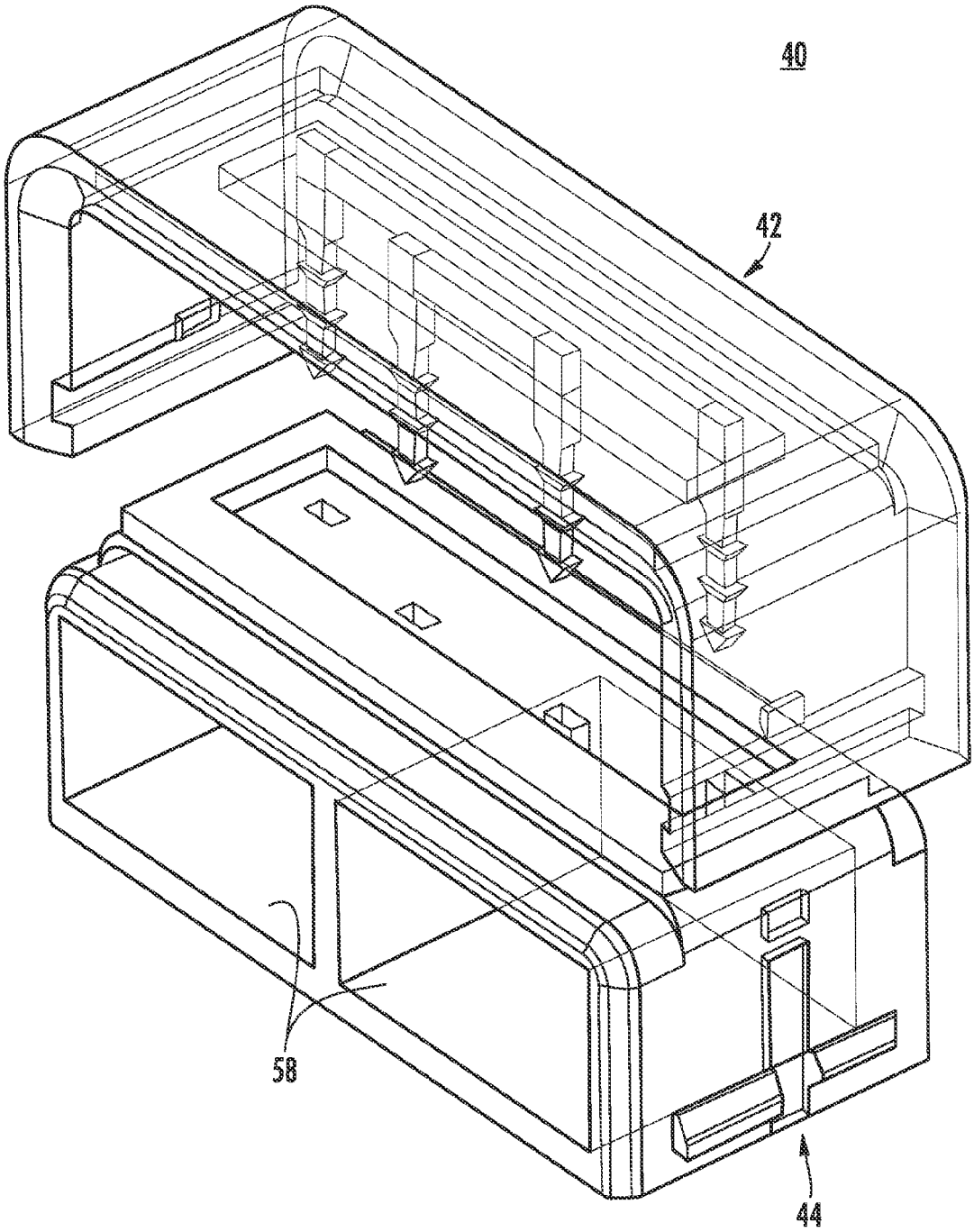
FIGS. 11A and 11B are X-ray views of a disassembled U-branch lighting connector in accordance with a second embodiment of the present invention.
Figure 11B:
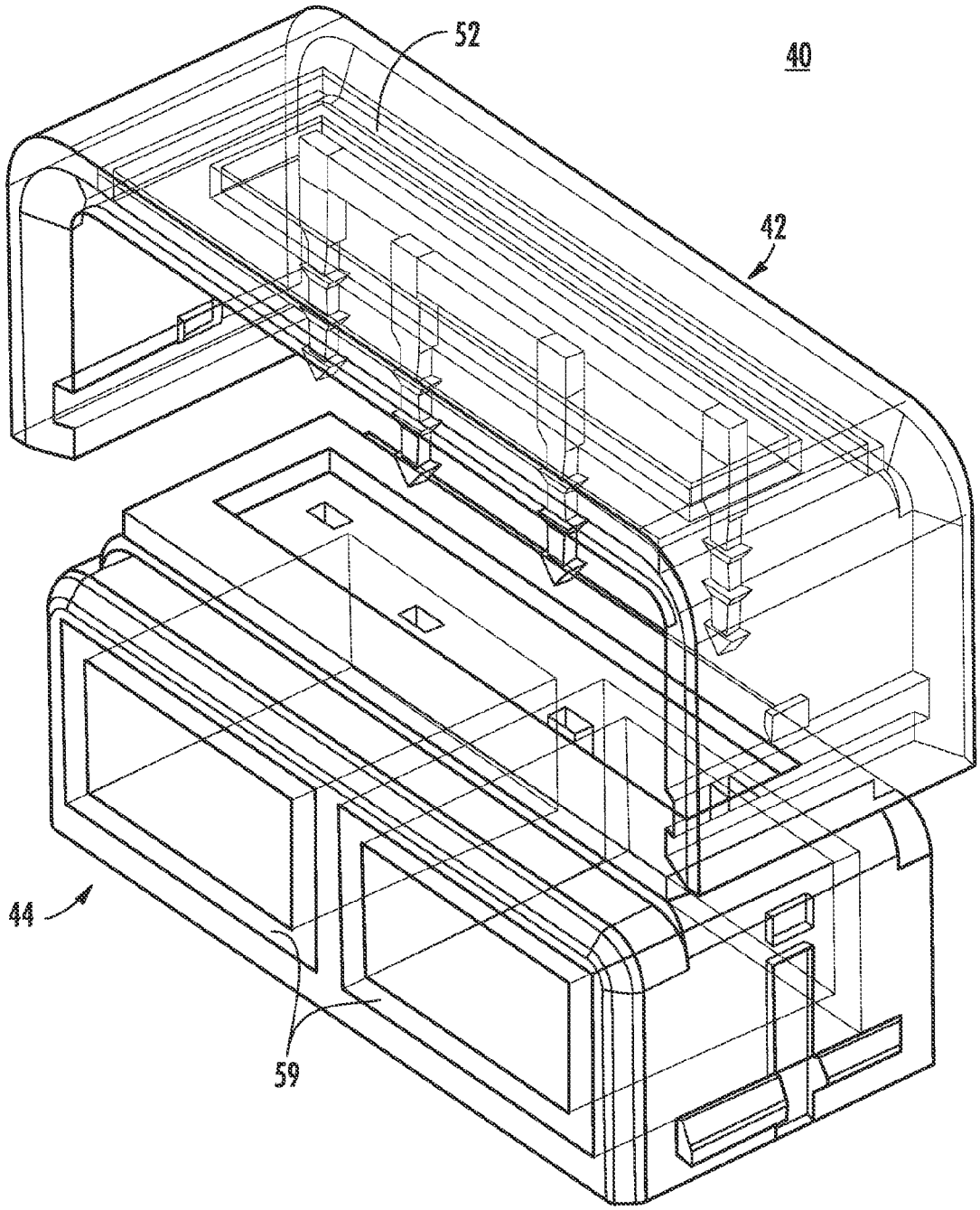

As can be seen in FIGS. 6A, 6B and 7, when the connector is assembled, the connector pins 16 and 17 penetrate through the encapsulant of the lighting apparatuses 31 and 32 to make contact with the conductor buses 31*a* and 32*a*, respectively, causing an electrical connection to be formed between the conductor buses 31*a* and 32*a* to permit an electrical signal and/or power to pass between lighting apparatuses 31 and 32 and securely connecting the lighting apparatuses together.

As shown in FIGS. 8-13, in accordance with a second preferred embodiment, a U-branch lighting connector 40 is formed from an upper housing 42 and a lower housing 44.

The U-branch connector in accordance with the second embodiment works in a substantially similar manner to the T-branch connector 10 described above, except that the U-branch connector is configured to electrically and mechanically connect the ends of a first length 61 and a second length 62 of lighting apparatus, to effectuate a U-turn. As in the first embodiment, connector pins 46 and 47 are provided in the upper housing 42. The pins 46 and 47 have embedded portions 46*a* and 47*a* , respectively formed in the upper housing.

The upper housing includes interlocking groove(s) 50 and a gasket 52. The interlocking groove(s) 50 mate with interlocking tongue(s) 51 in the lower housing 44 to achieve a secure connection, e.g., a snap fit, between the upper and lower housing when the connector is assembled. The gasket 52 is used to ensure a tight fit of the housings when the connector has been assembled. While shown in the figure as being associated with the upper housing 42, the gasket can be provided separately, and placed between the upper and lower housings during assembly of the connector.

The lower housing 44 includes plural connector pin guide holes 54, and openings 58. In the U-branch embodiment, an end portion of a first length of lighting apparatus 61 is inserted into one of the openings 58 and an end portion of a second length of lighting apparatus 62 is inserted into the other one of the openings 58, as can be seen particularly in FIGS. 12 and 13. An opening gasket 59 lines the openings 58 in the lower housing. The lower housing 44 also preferably includes a gasket groove 60. Opening gaskets 59 prevent water leaking between the lower housing 44 and the lighting apparatuses inserted into the openings 58.

To assemble the connector 40, the upper housing 42 is coupled with the lower housing 44 via the corresponding interlocking groove(s) 50 and tongue(s) 51. When pressing the upper housing 42 and the lower housing 44 together, the connector pins 46 and 47 on the upper housing are matched with their corresponding connector pin guide holes 54 on the lower housing. The connector pins/connector pin guide holes guides the upper housing and lower housing in a manner which permits easy coupling of the corresponding interlocking groove(s) and tongue(s).

Figure 13:
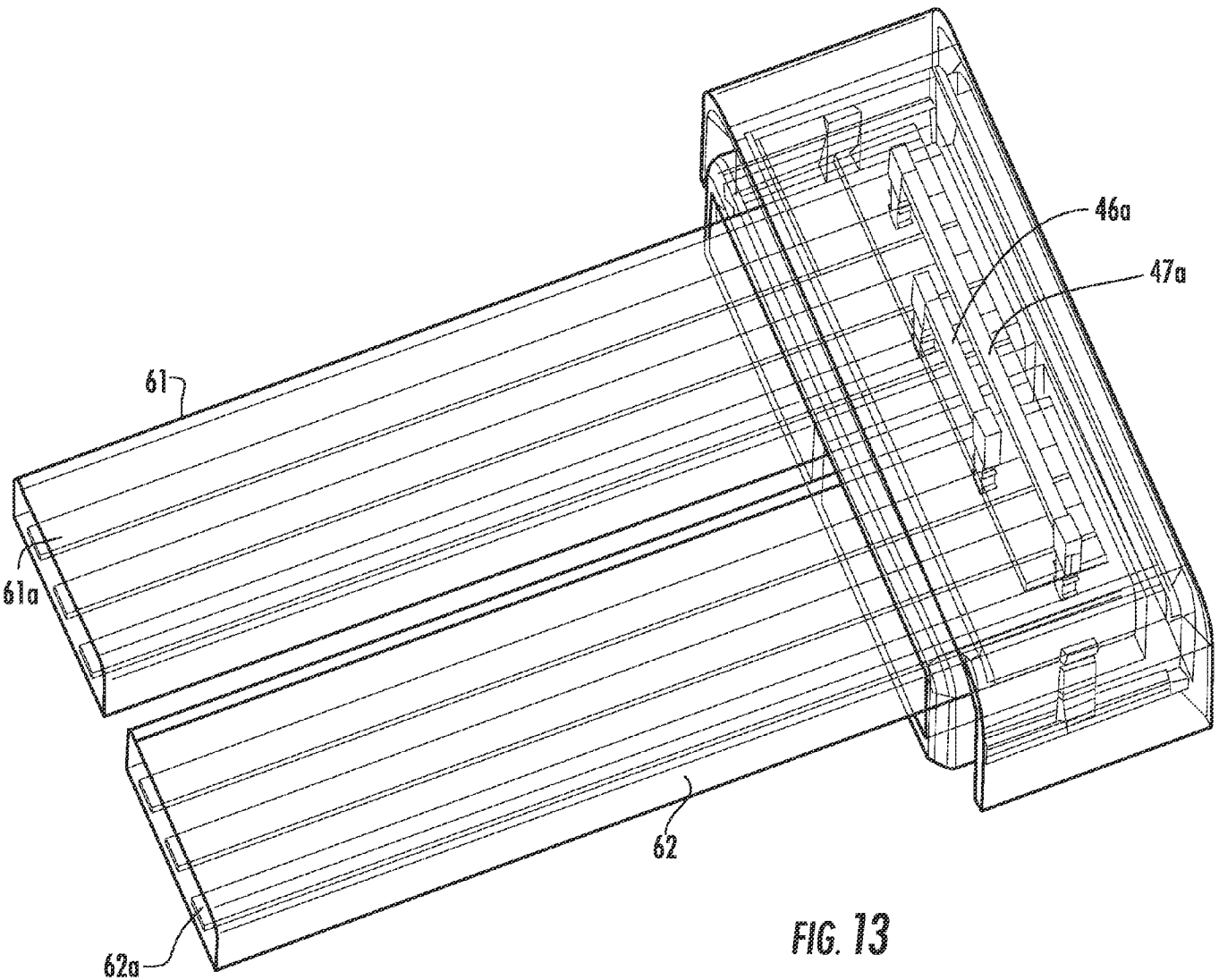
FIG. 13 is an X-ray view of an assembled U-branch lighting connector in accordance with a second embodiment of the present invention.
Figure 14A:
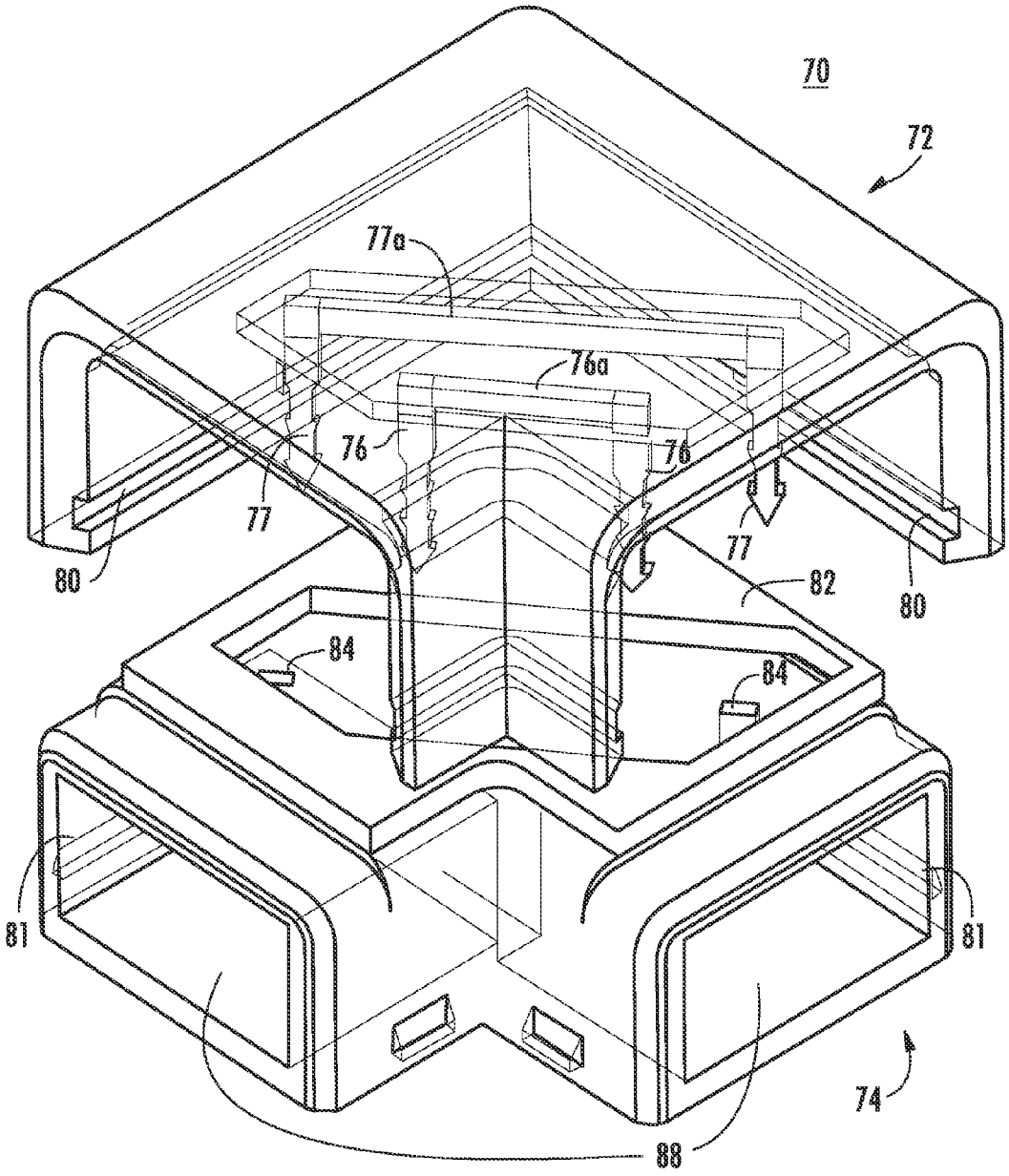
FIGS. 14A, 14B and 15 are X-ray views of a disassembled L-branch lighting connector in accordance with a third embodiment of the present invention.
Figure 14B:
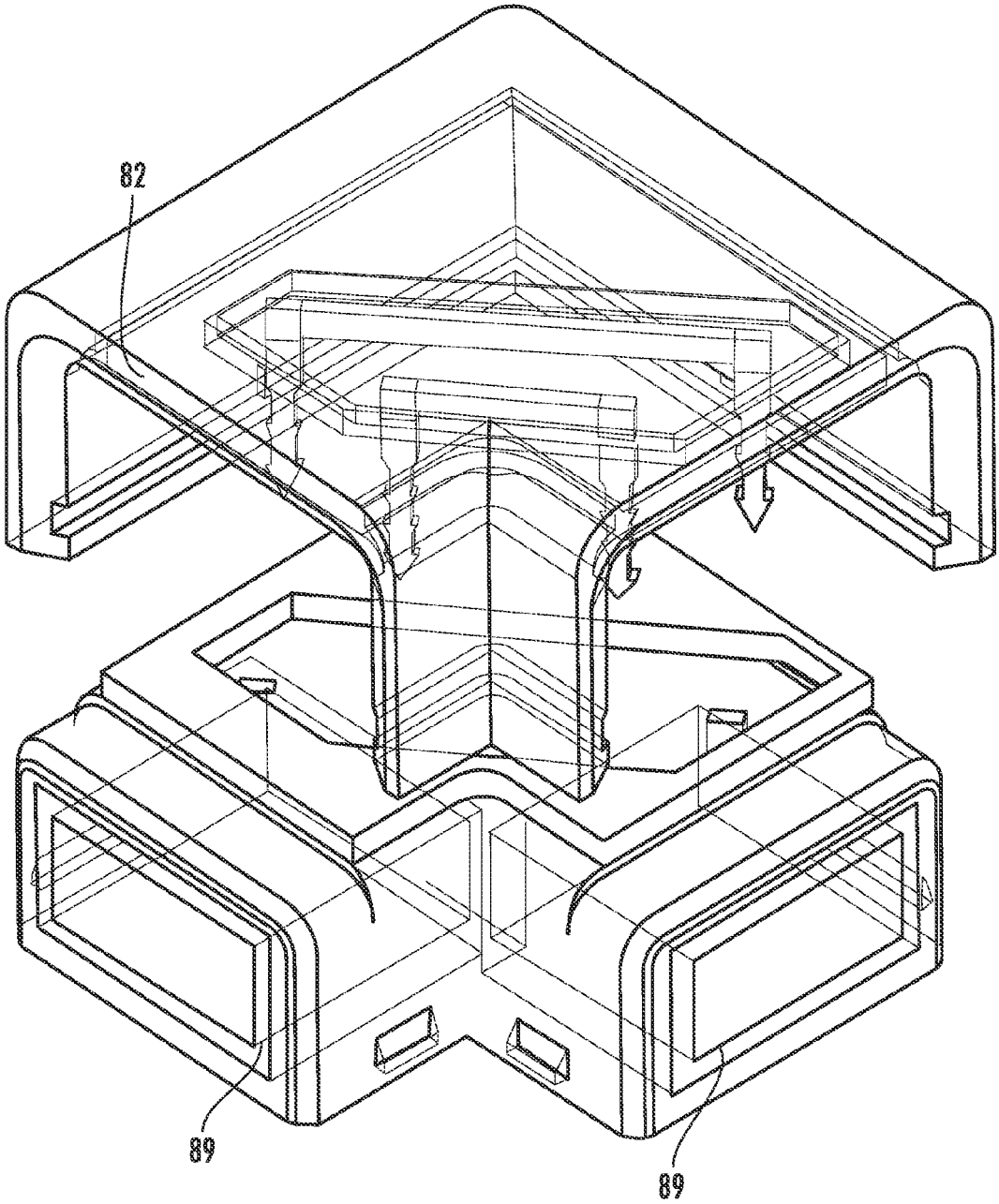
Figure 15:
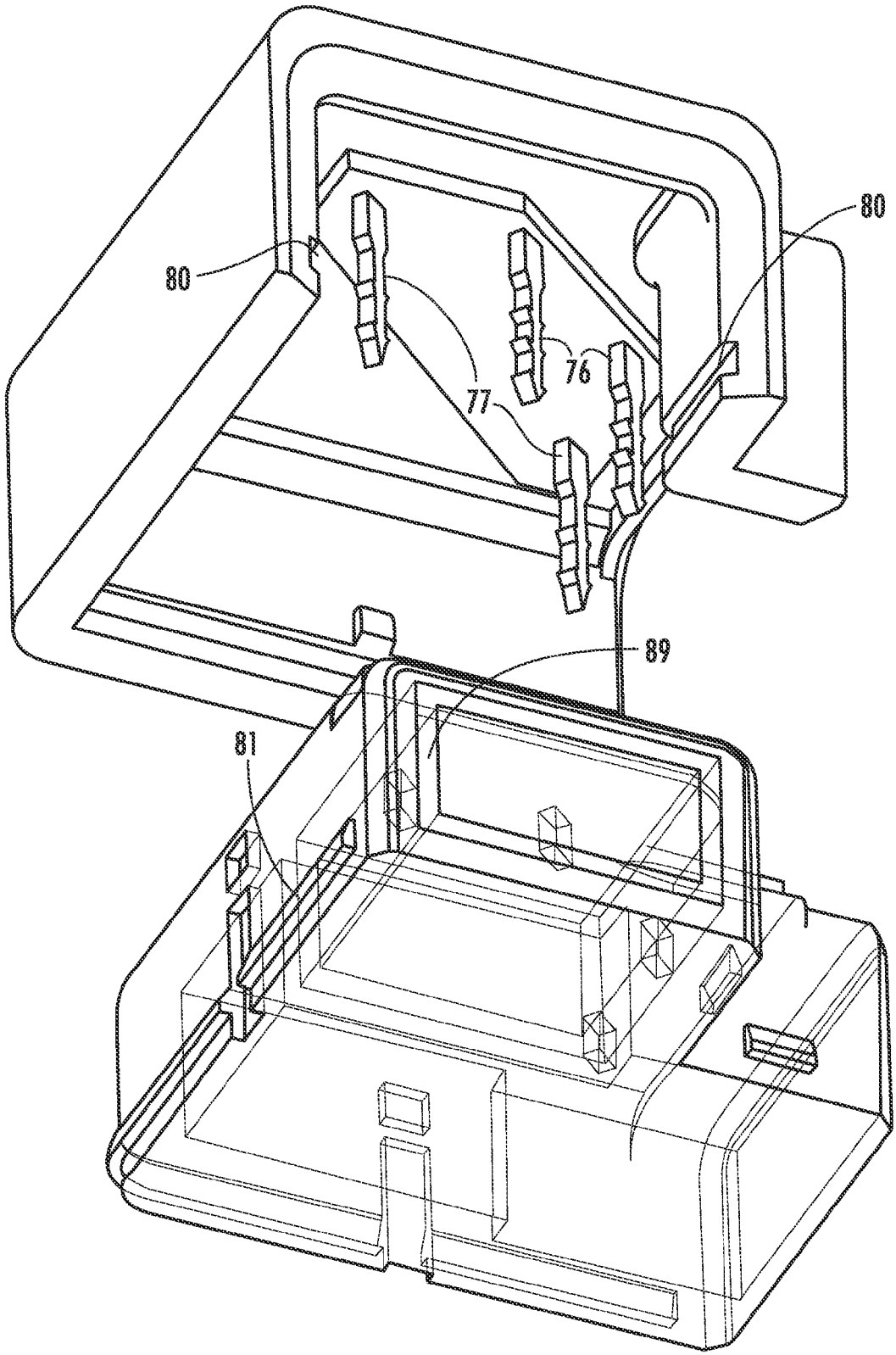
Figure 16:
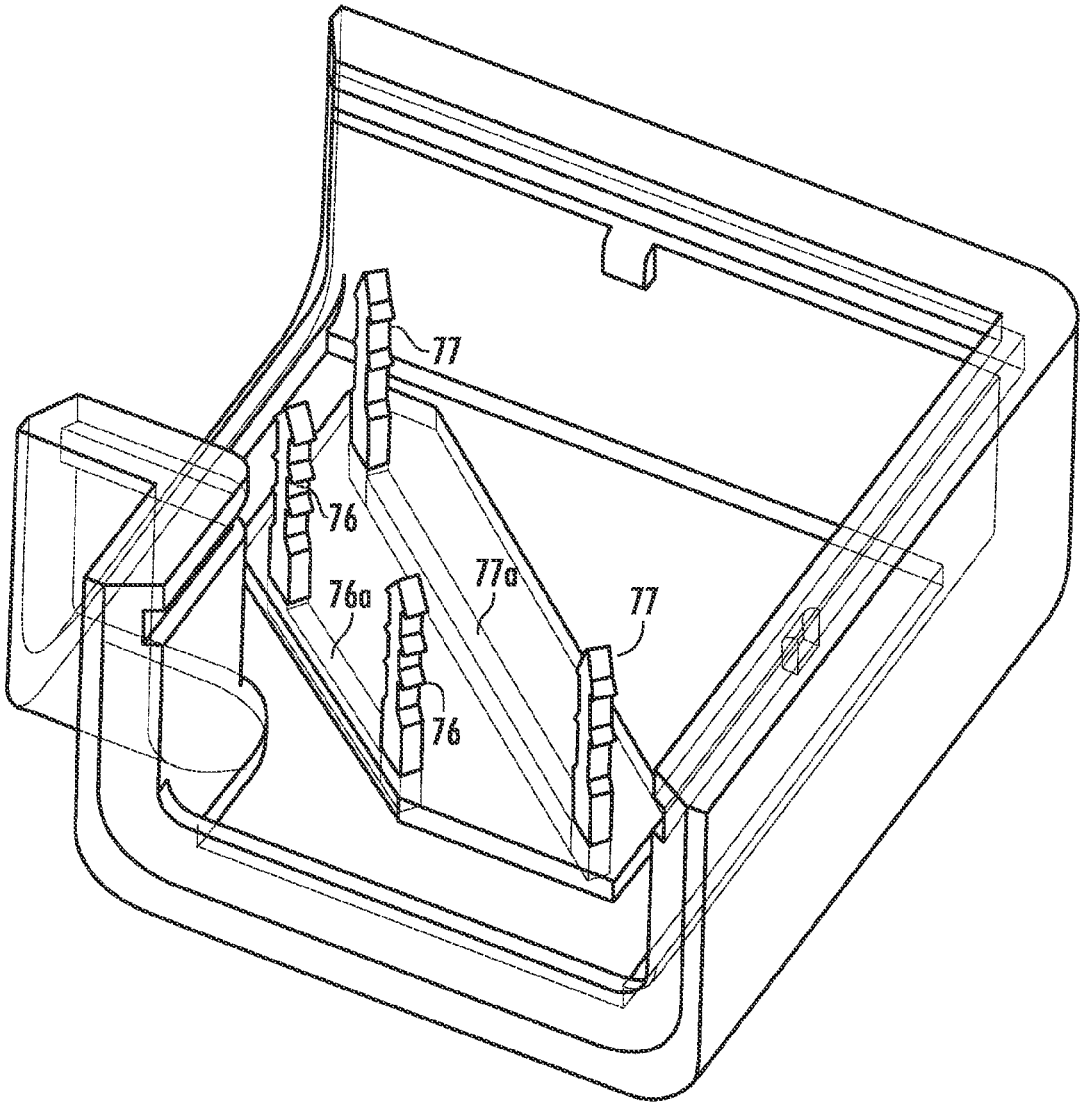
FIG. 16 is an X-ray view of an upper housing in accordance with a third embodiment of the present invention.
Figure 17:
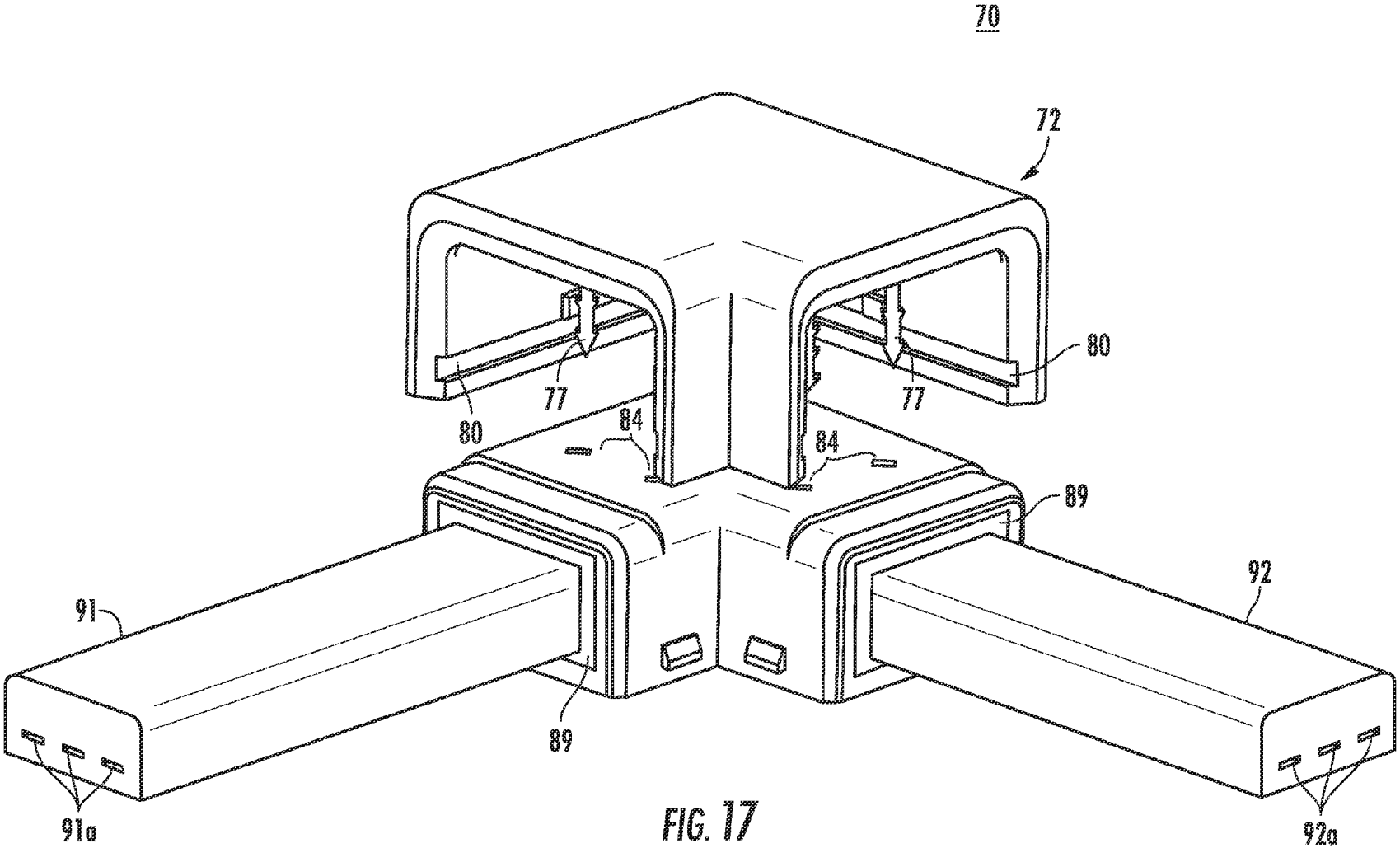
FIG. 17 is a perspective view of a disassembled L-branch lighting connector in accordance with a third embodiment of the present invention showing how lengths of lighting apparatus are connected to the lighting connector.

Preferably the tips of each connector pin are configured to increase the contact area between the connector pin and a conductive bus of the lighting apparatus, e.g., conductor bus 61*a* or conductor bus 62*a*, as shown in FIG. 13. To achieve this function, the tip can be in the shape of an inverted "V" or "U."

When assembling the connector 40, the pressure caused by the coupling of the interlocking groove(s) 50 and tongue(s) 51, as well as the penetration of the connector pins 46 and 47 through the opening gaskets 59 and into an encapsulant or protective sheath(es), cover(s) or layer(s) of a lighting apparatus (such as an LED light wire, cable, bar or tube), creates a waterproof seal between the upper housing 42 and lower housing 44, and between the opening gaskets 59 and the lighting apparatuses. Specifically, the upper housing gasket 52 tightly presses onto the corresponding gasket groove 60, thereby creating a tight pressure seal. Further, the opening gaskets 59 tightly press the lighting apparatuses via pressure insertion of the lighting apparatus into the openings 58, and the penetration of the connector pins 46 and 47 into the lighting apparatus.

Figure 12:
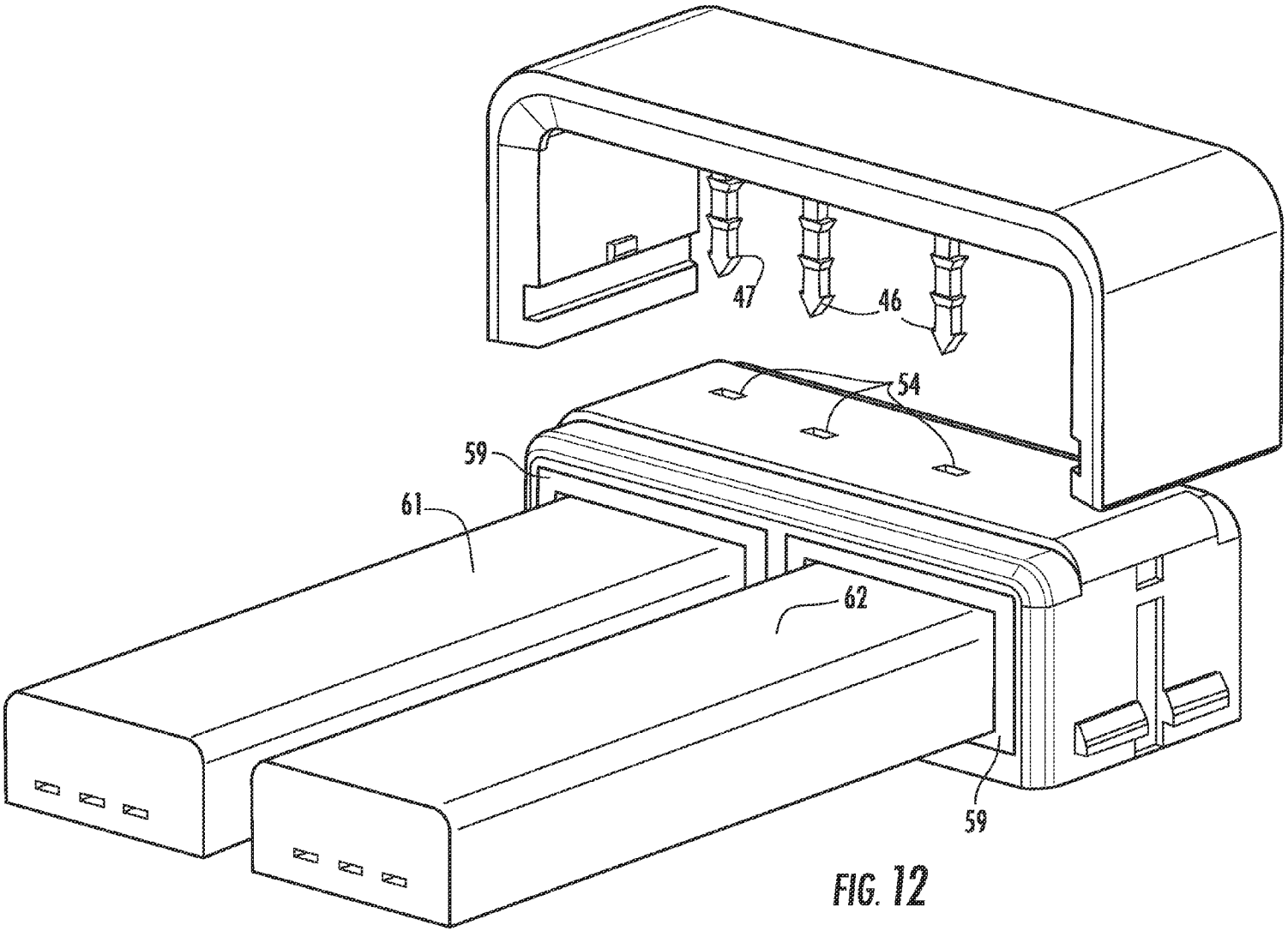
FIG. 12 is a perspective view of a disassembled U-branch lighting connector in accordance with a second embodiment of the present invention showing how lengths of lighting apparatus are connected to the lighting connector.

As can be seen in FIGS. 12 and 13, when the connector is assembled, the connector pins 46 and 47 penetrate through the encapsulant of the lighting apparatuses 61 and 62 to make contact with the conductor buses 61*a* and 62*a*, respectively, causing an electrical connection to be formed between the conductor buses 61*a* and 62*a* to permit an electrical signal and/or power to pass between lighting apparatuses 61 and 62 and securely connecting the lighting apparatuses together.

As shown in FIGS. 14-18B, in accordance with a third preferred embodiment, an L-branch lighting connector 70 is formed from an upper housing 72 and a lower housing 74.

The L-branch connector 70 in accordance with the third embodiment works in a substantially similar manner to the U-branch connector 40 described above, except that the L-branch connector 70 is configured to electrically and mechanically connect the ends of a first length 91 and a second length 92 of lighting apparatus, to effectuate a right angle connection. As in the first and second embodiments, connector pins 76 and 77 are provided in the upper housing 72. The pins 76 and 77 have embedded portions 76*a* and 77*a*, respectively formed in the upper housing.

The upper housing includes interlocking groove(s) 80. The interlocking groove(s) 80 mate with interlocking tongue(s) 81 in the lower housing 74 to achieve a secure connection, e.g., a snap fit, between the upper and lower housing when the connector is assembled. A gasket 82 is provided between the upper and lower housings and is used to ensure a tight fit of the housings when the connector has been assembled.

The lower housing 74 includes plural connector pin guide holes 84, and openings 88. In the L-branch embodiment, an end portion of a first length of lighting apparatus 91 is inserted into one of the openings 88 and an end portion of a second length of lighting apparatus 92 is inserted into the other one of the openings 88, as can be seen particularly in FIGS. 17, 18A and 18B. An opening gasket 89 lines the openings 88 in the lower housing. Opening gaskets 89 prevent water leaking between the lower housing 74 and the lighting apparatuses inserted into the openings 88.

To assemble the connector 70, the upper housing 72 is coupled with the lower housing 74 via the corresponding interlocking groove(s) 80 and tongue(s) 81. When pressing the upper housing 72 and the lower housing 74 together, the connector pins 76 and 77 on the upper housing are matched with their corresponding connector pin guide holes 84 on the lower housing. The connector pins/connector pin guide holes guides the upper housing and lower housing in a manner which permits easy coupling of the corresponding interlocking groove(s) and tongue(s).

Figure 18A:
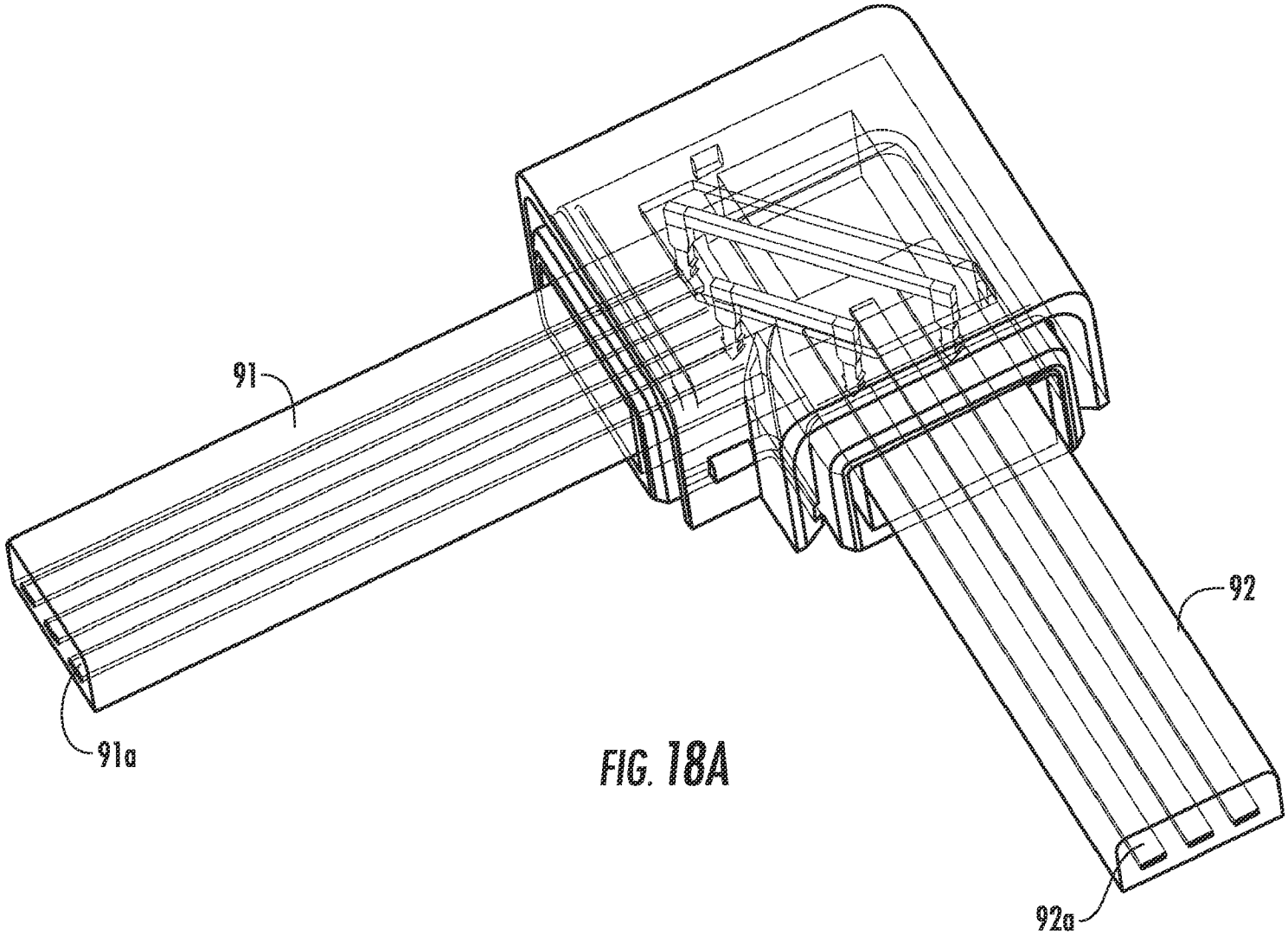
FIGS. 18A and 18B are X-ray views of an assembled L-branch lighting connector in accordance with a third embodiment of the present invention.
Figure 18B:
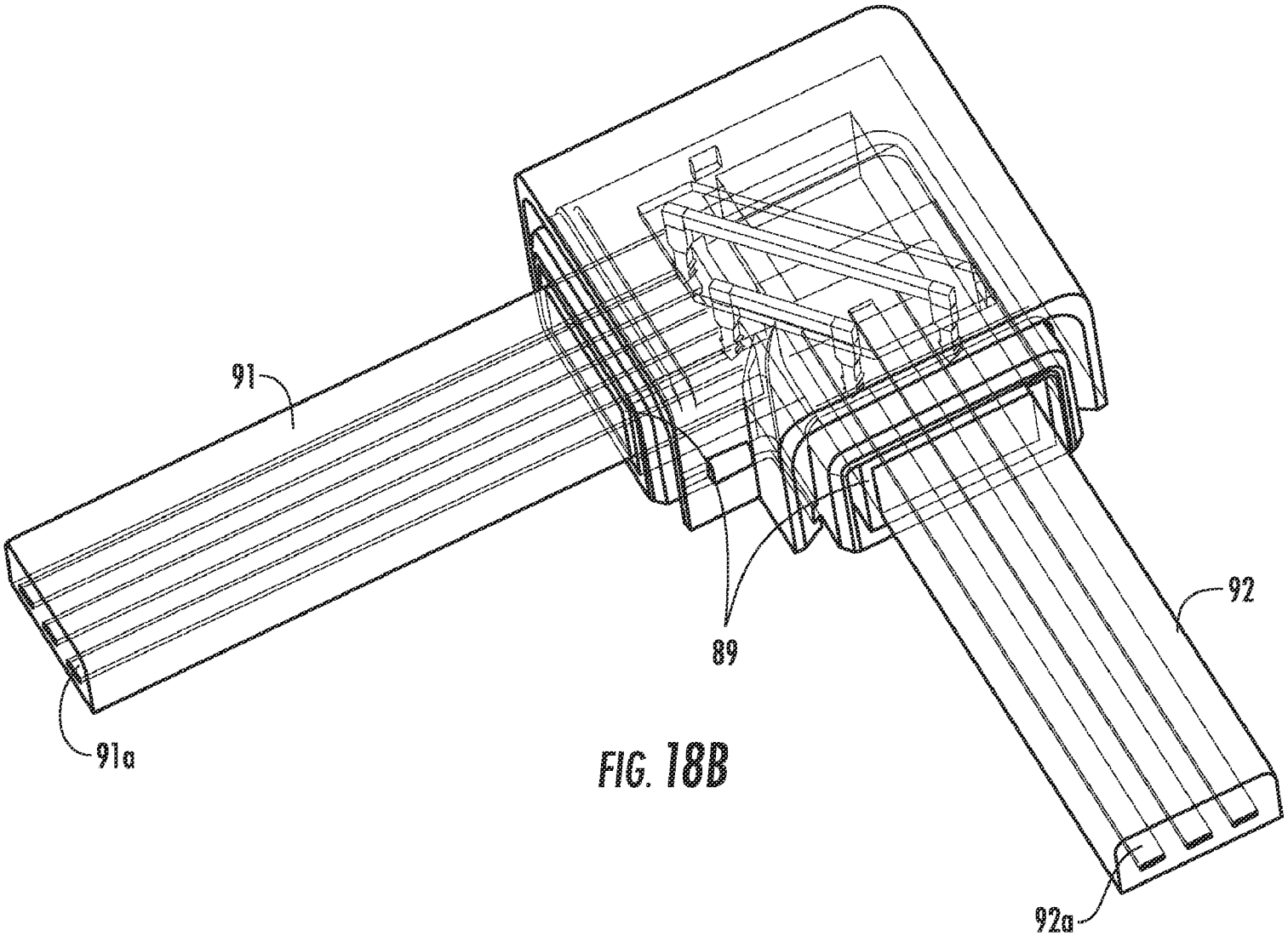
Figure 19A:
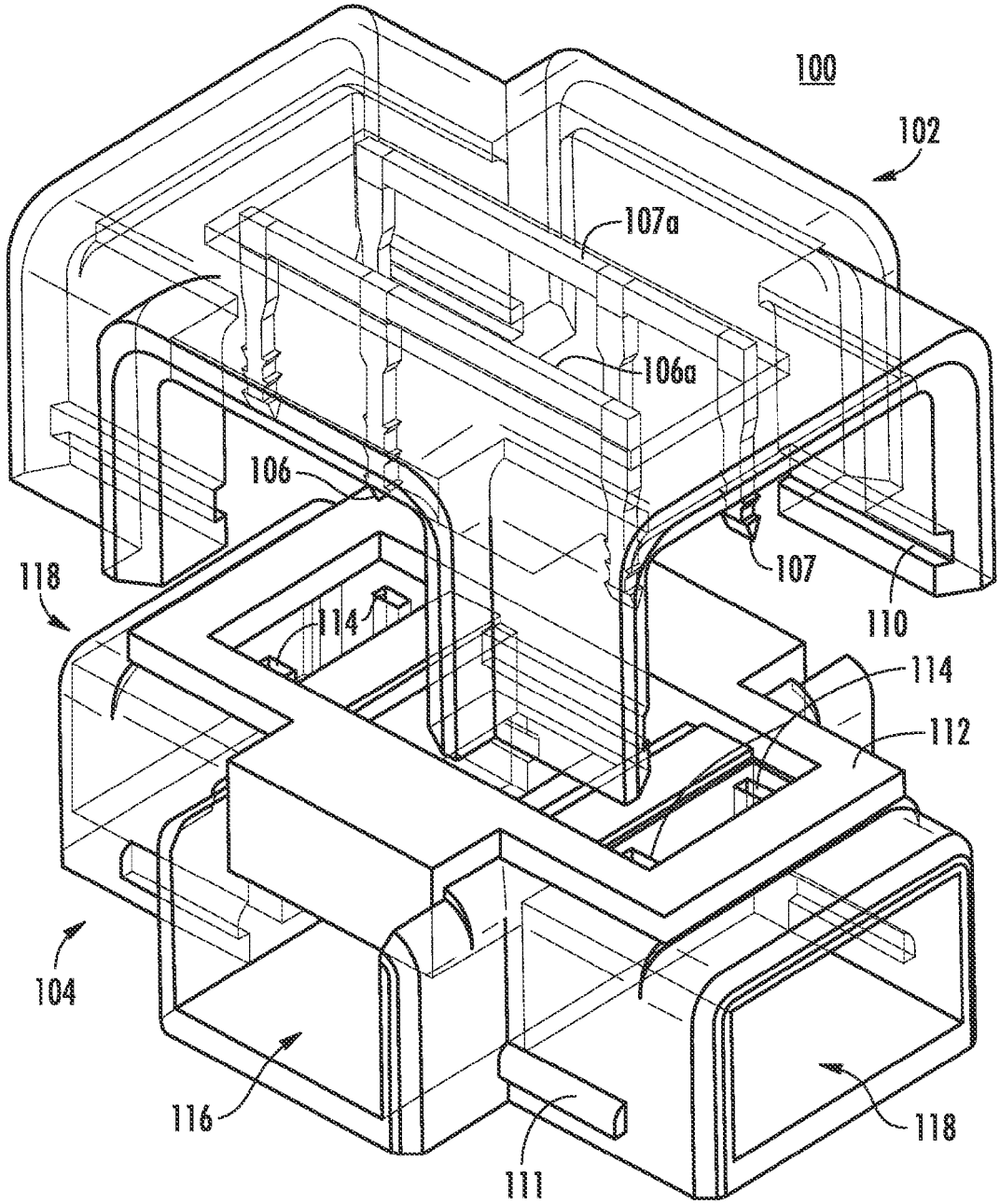
FIGS. 19A, 19B and 20 are X-ray views of a disassembled X-branch lighting connector in accordance with a fourth embodiment of the present invention.
Figure 19B:
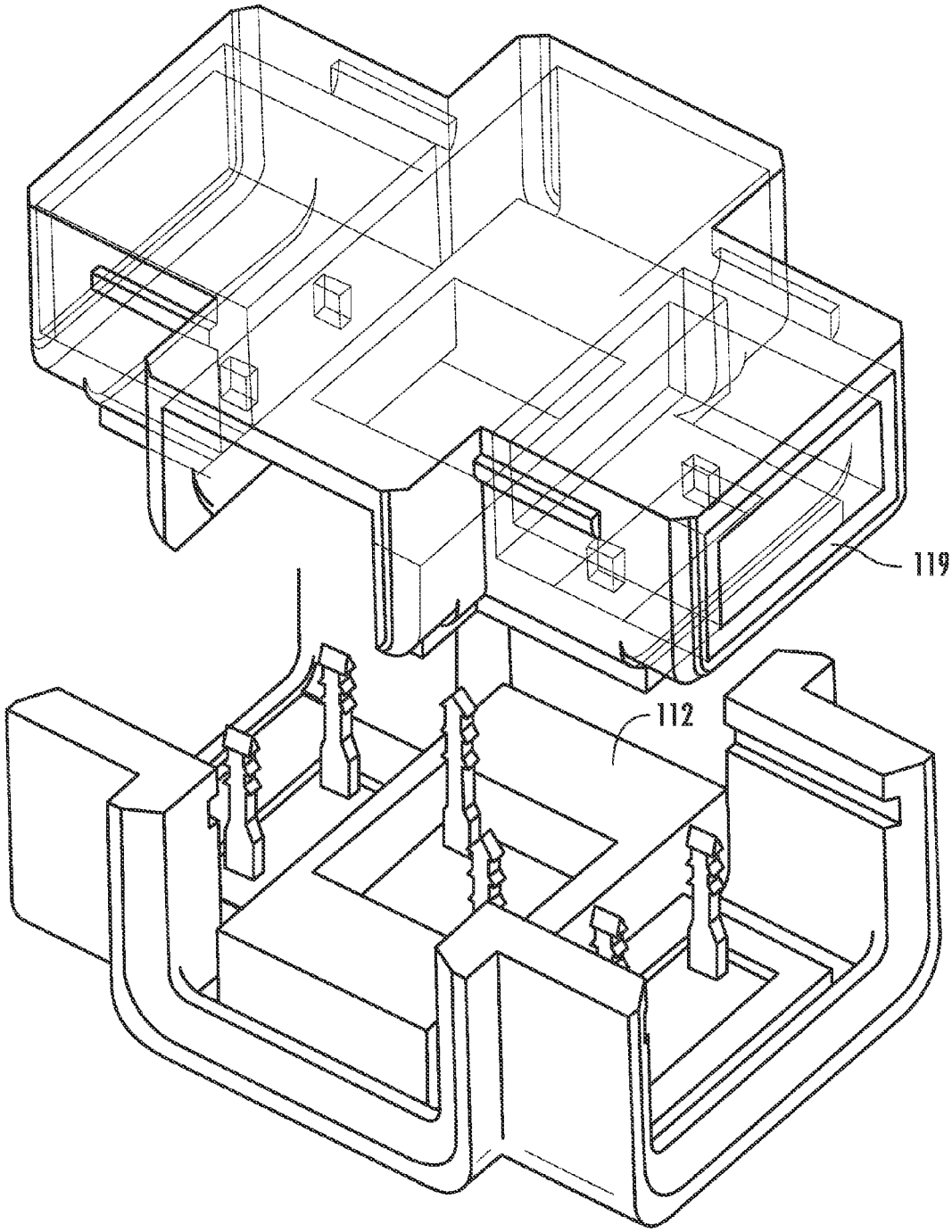
Figure 20:
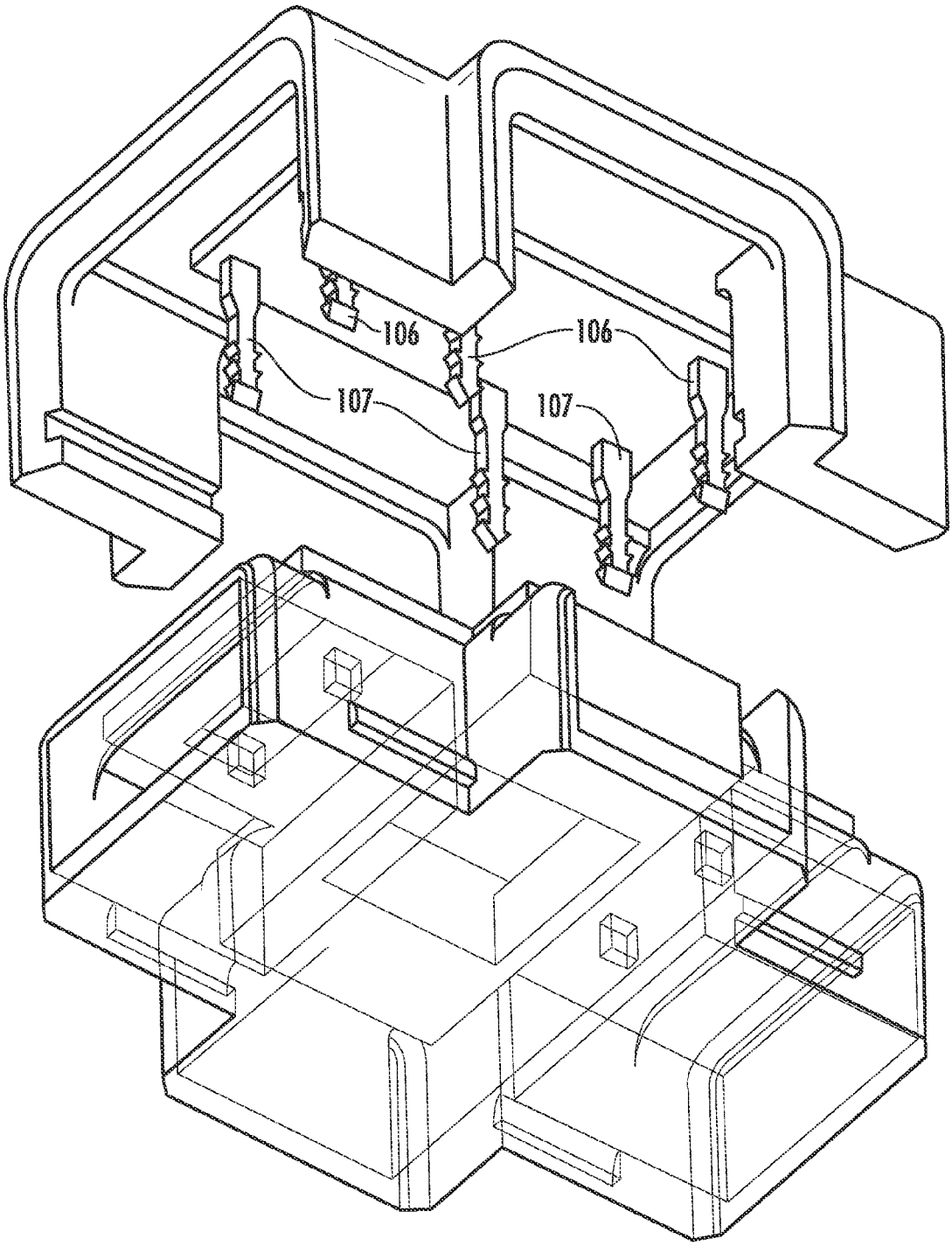
Figure 21:
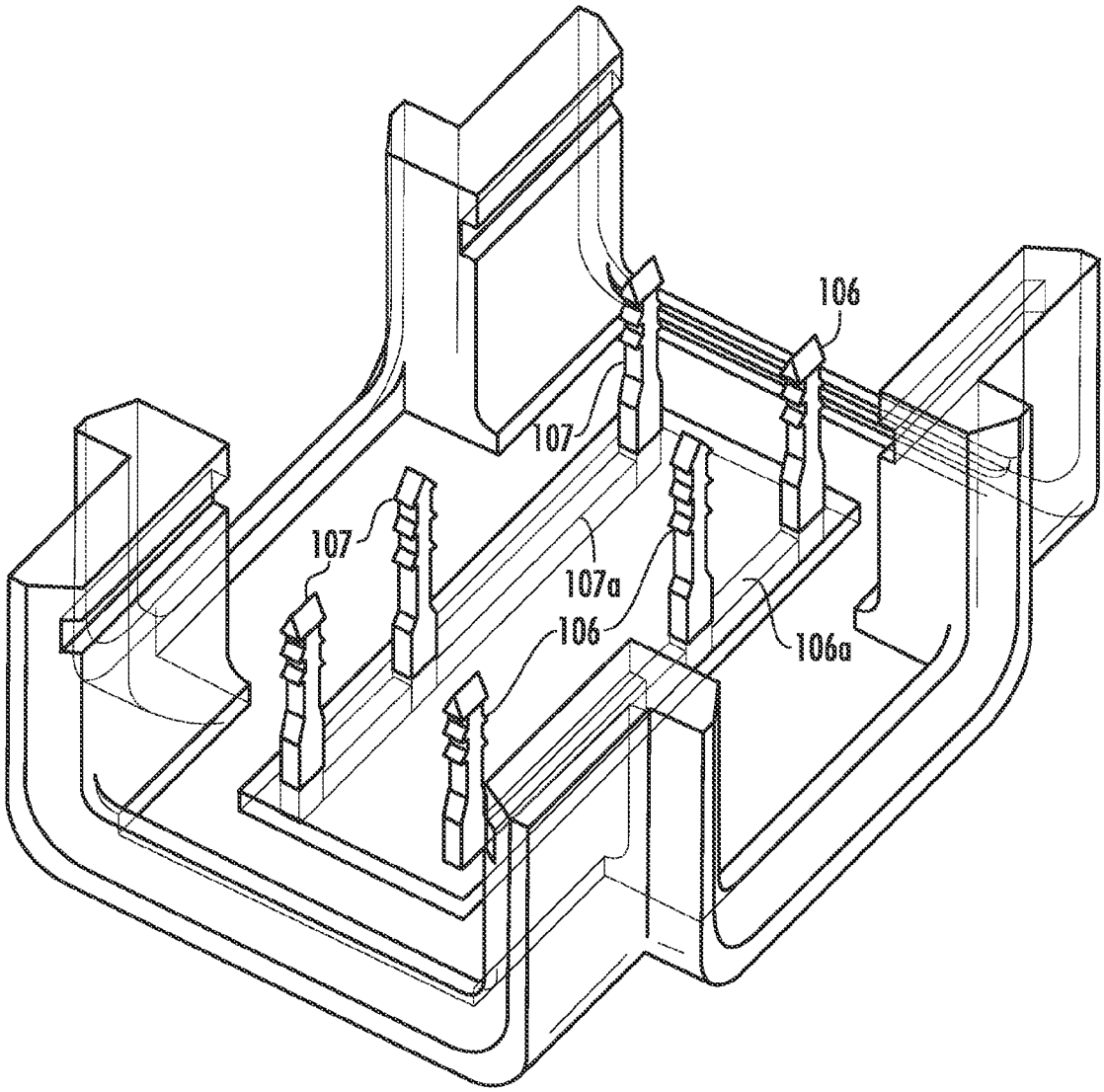
FIG. 21 is an X-ray view of an upper housing in accordance with a fourth embodiment of the present invention.
Figure 22A:
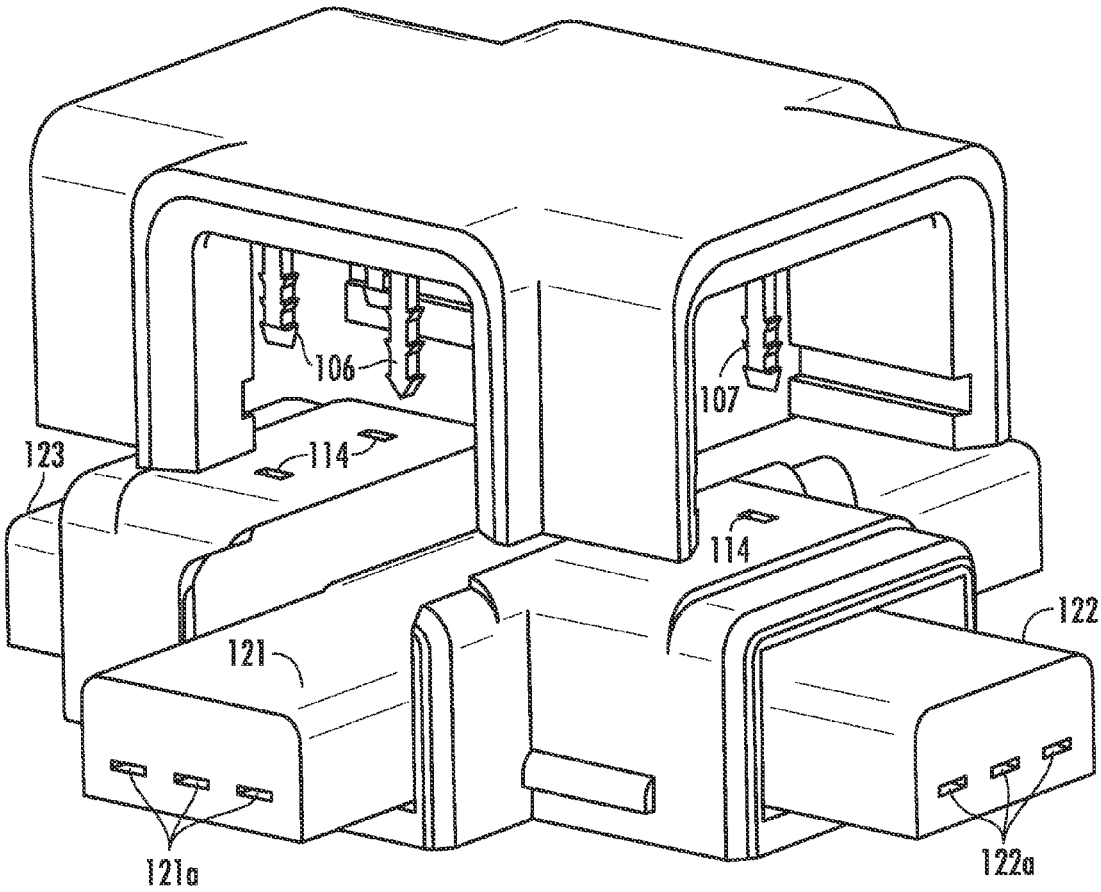
FIGS. 22A and 22B are perspective views of a disassembled X-branch lighting connector in accordance with a fourth embodiment of the present invention showing how lengths of lighting apparatus are connected to the lighting connector.
Figure 22B:
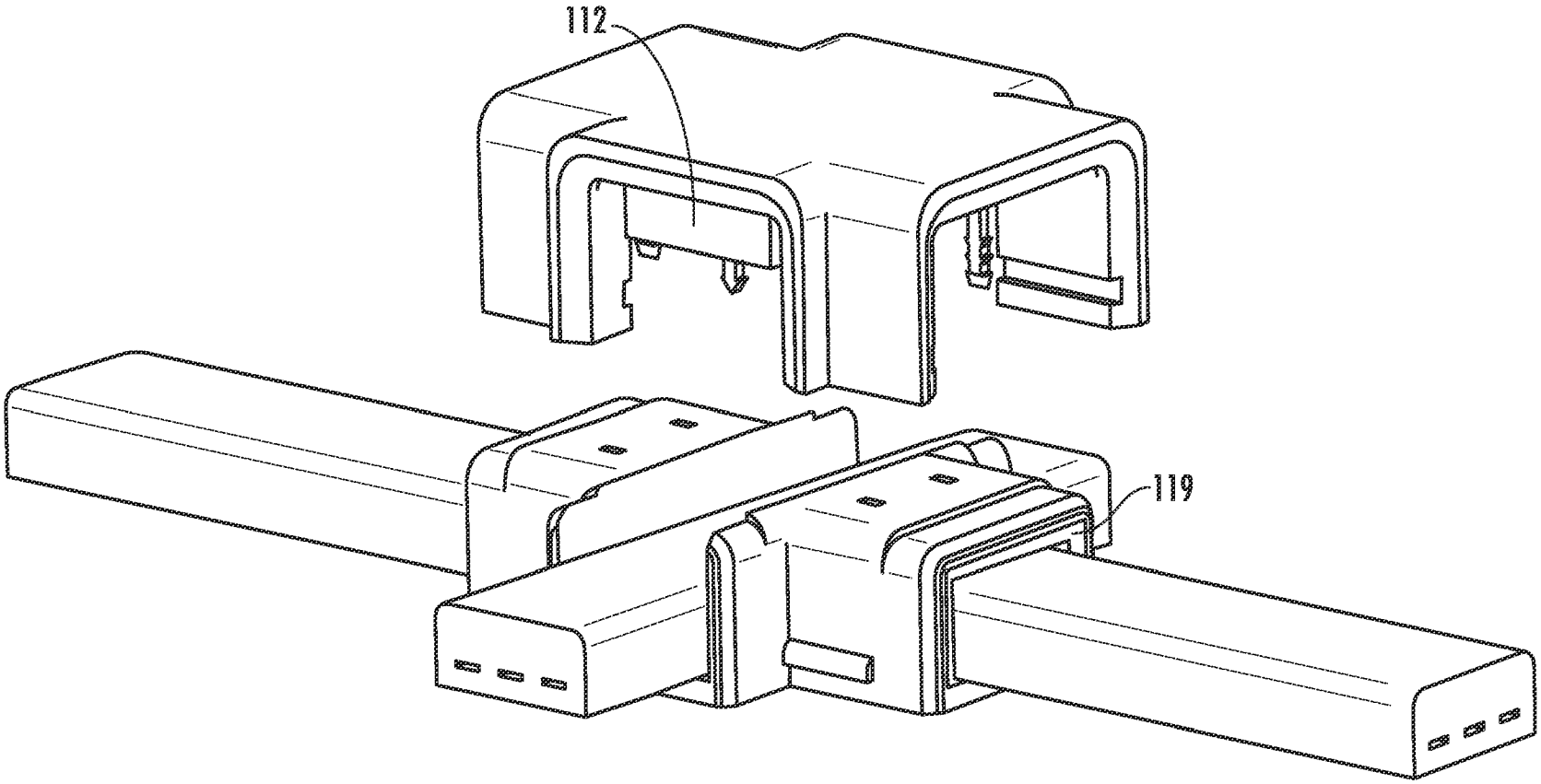

Preferably the tips of each connector pin are configured to increase the contact area between the connector pin and a conductive bus of the lighting apparatus, e.g., conductor bus 91*a* or conductor bus 92*a*, as shown in FIGS. 18A and 18B. To achieve this function, the tip can be in the shape of an inverted "V" or "U."

When assembling the connector 70, the pressure caused by the coupling of the interlocking groove(s) 80 and tongue(s) 81, as well as the penetration of the connector pins 76 and 77 through the opening gaskets 89 and into an encapsulant or protective sheath(es), cover(s) or layer(s) of a lighting apparatus (such as an LED light wire, cable, bar or tube), creates a waterproof seal between the upper housing 72 and lower housing 74, between the opening gaskets 89 and the lighting apparatuses. Specifically, the upper housing gasket 82 tightly presses onto the lower housing thereby creating a tight pressure seal. Further, the opening gaskets 89 tightly press the lighting apparatuses via pressure insertion of the lighting apparatus into the openings 88, and the penetration of the connector pins 76 and 77 into the lighting apparatus.

As can be seen in FIGS. 18A and 18B, when the connector is assembled, the connector pins 76 and 77 penetrate through the encapsulant of the lighting apparatuses 91 and 92 to make contact with the conductor buses 91*a* and 92*a*, respectively, causing an electrical connection to be formed between the conductor buses 91*a* and 92*a* to permit an electrical signal and/or power to pass between lighting apparatuses 91 and 92 and securely connecting the lighting apparatuses together.

As shown in FIGS. 19A-23B, in accordance with a fourth preferred embodiment, an X-branch lighting connector 100 is formed from an upper housing 102 and a lower housing 104.

The X-branch connector 100 in accordance with the fourth embodiment works in a substantially similar manner to the L-branch connector 70 described above, except that the X-branch connector 100 is configured to electrically and mechanically connect a first length 121 of lighting apparatus with the end of a second length 122 and the end of a third length 123 of lighting apparatus, to effectuate a X connection. As in the first and second embodiments, connector pins 106 and 107 are provided in the upper housing 102. The connector pins 106 and 107 have embedded portions 106*a* and 107*a*, respectively formed in the upper housing.

The upper housing includes interlocking groove(s) 110. The interlocking groove(s) 110 mate with interlocking tongue(s) 111 in the lower housing 104 to achieve a secure connection, e.g., a snap fit, between the upper and lower housing when the connector is assembled. A gasket 112 is provided between the upper and lower housings and is used to ensure a tight fit of the housings when the connector has been assembled.

The lower housing 104 includes plural connector pin guide holes 114, and openings 118 as well as a slot 116. In the X-branch embodiment, a first length of lighting apparatus 121 lies in the slot 116, passing completely through the connector 100. An end portion of a second length of lighting apparatus 122 is inserted into one of the openings 118 and an end portion of a third length of lighting apparatus 123 is inserted into the other one of the openings 118, as can be seen particularly in FIGS. 22 and 23. An opening gasket 119 lines the openings 118 in the lower housing. Opening gaskets 119 prevent water leaking between the lower housing 104 and the lighting apparatuses inserted into the openings 118.

To assemble the connector 100, the upper housing 102 is coupled with the lower housing 104 via the corresponding interlocking groove(s) 110 and tongue(s) 111. When pressing the upper housing 102 and the lower housing 104 together, the outer ones of the connector pins 106 and 107 on the upper housing are matched with their corresponding connector pin guide holes 114 on the lower housing. The inner ones of the pins are positioned above lighting apparatus 121 for penetration into that lighting apparatus upon assembly. The connector pins/connector pin guide holes guides the upper housing and lower housing in a manner which permits easy coupling of the corresponding interlocking groove(s) and tongue(s).

Figure 23A:
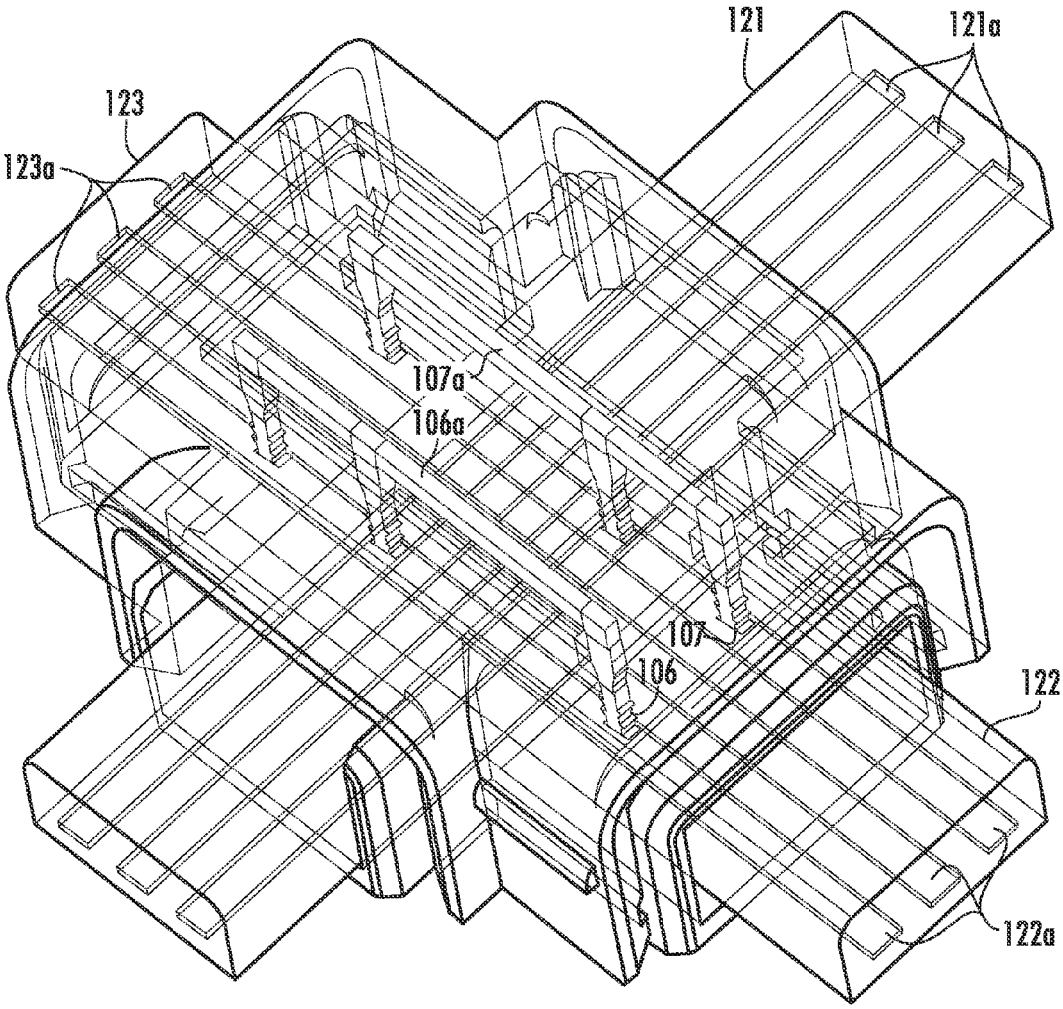
FIGS. 23A and 23B are X-ray views of an assembled X-branch lighting connector in accordance with a fourth embodiment of the present invention.
Figure 23B:
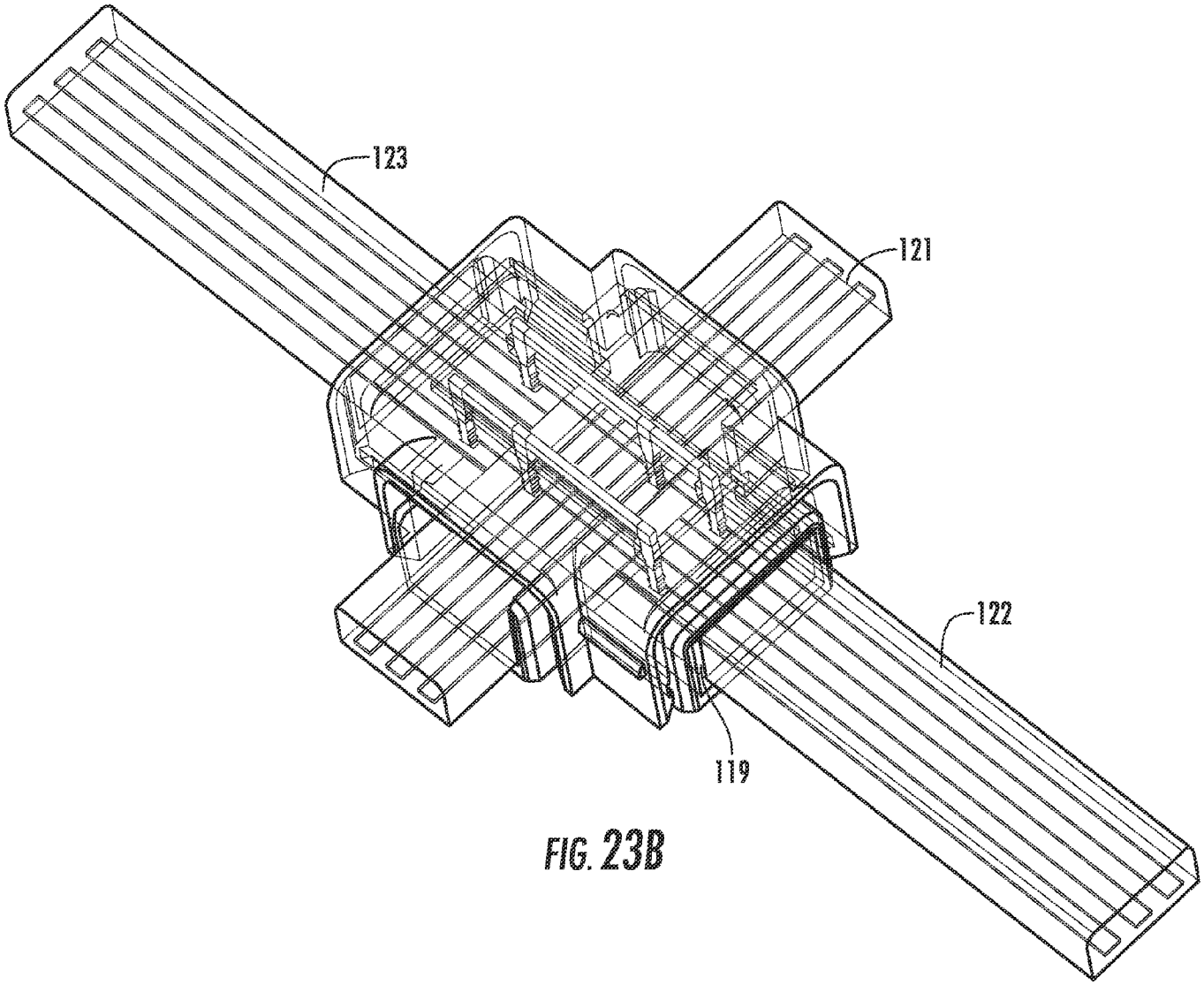
Figure 24A:
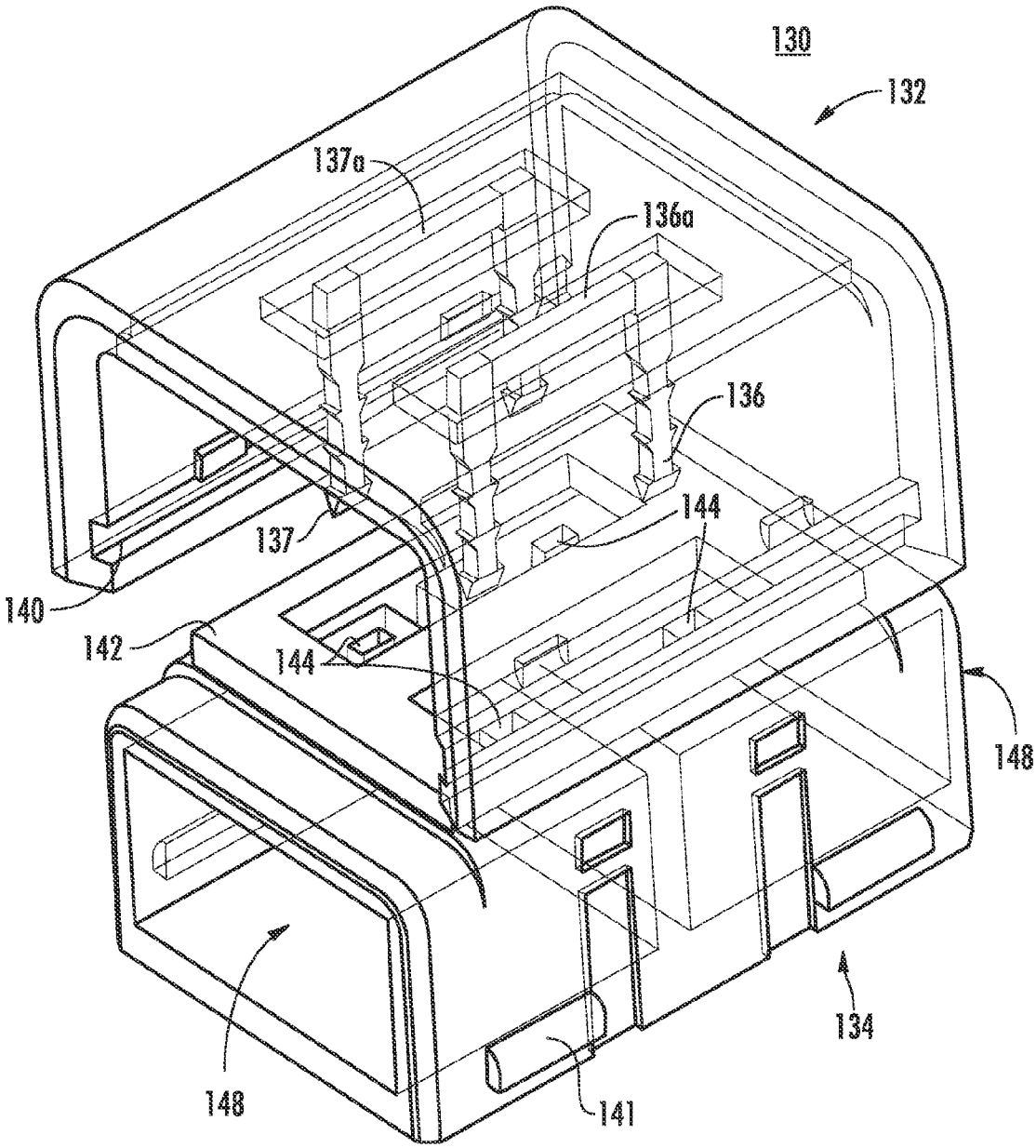
FIGS. 24A, 24B, 25A and 25B are X-ray views of a disassembled I-branch lighting connector in accordance with a fifth embodiment of the present invention.
Figure 24B:
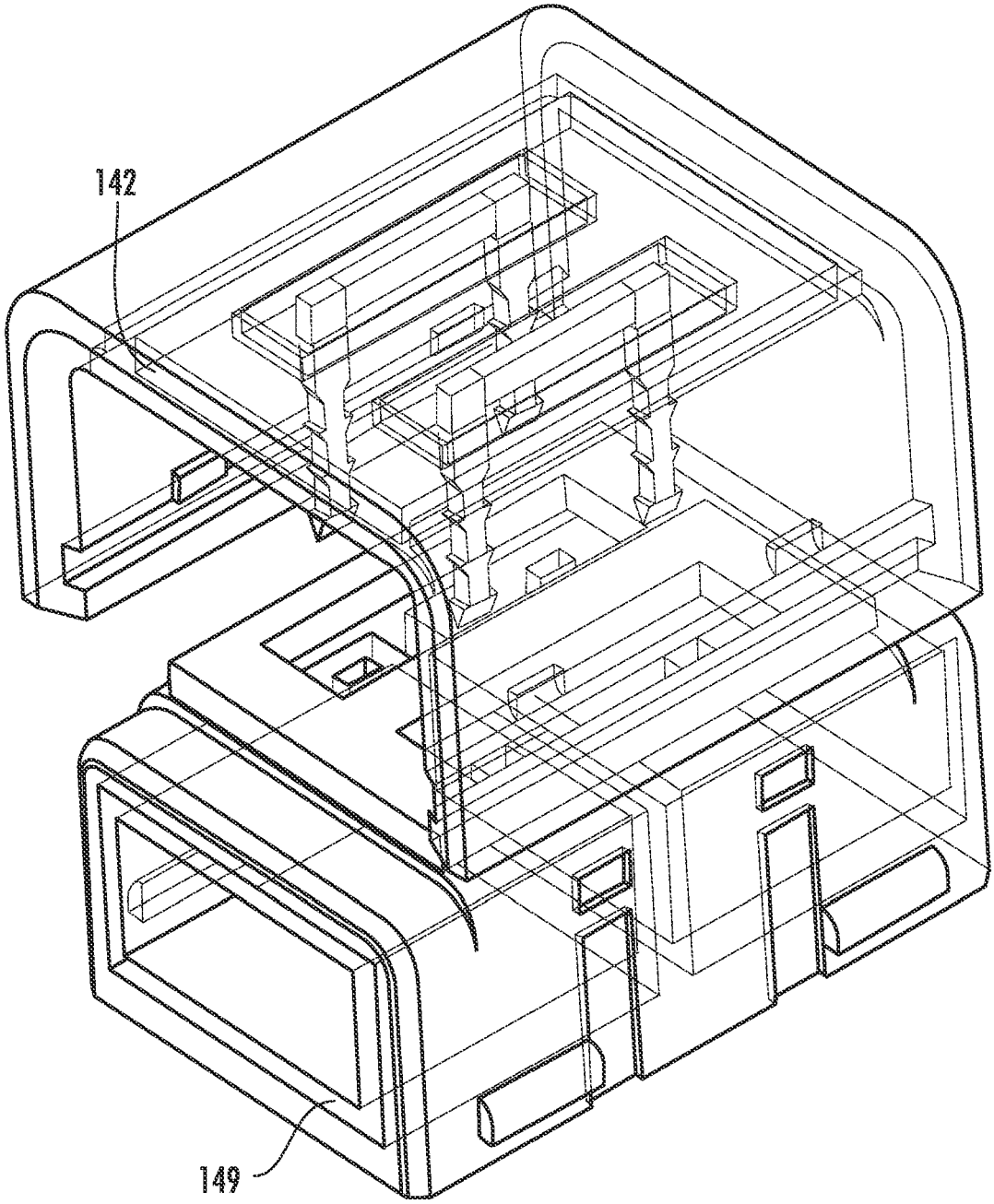
Figure 25A:
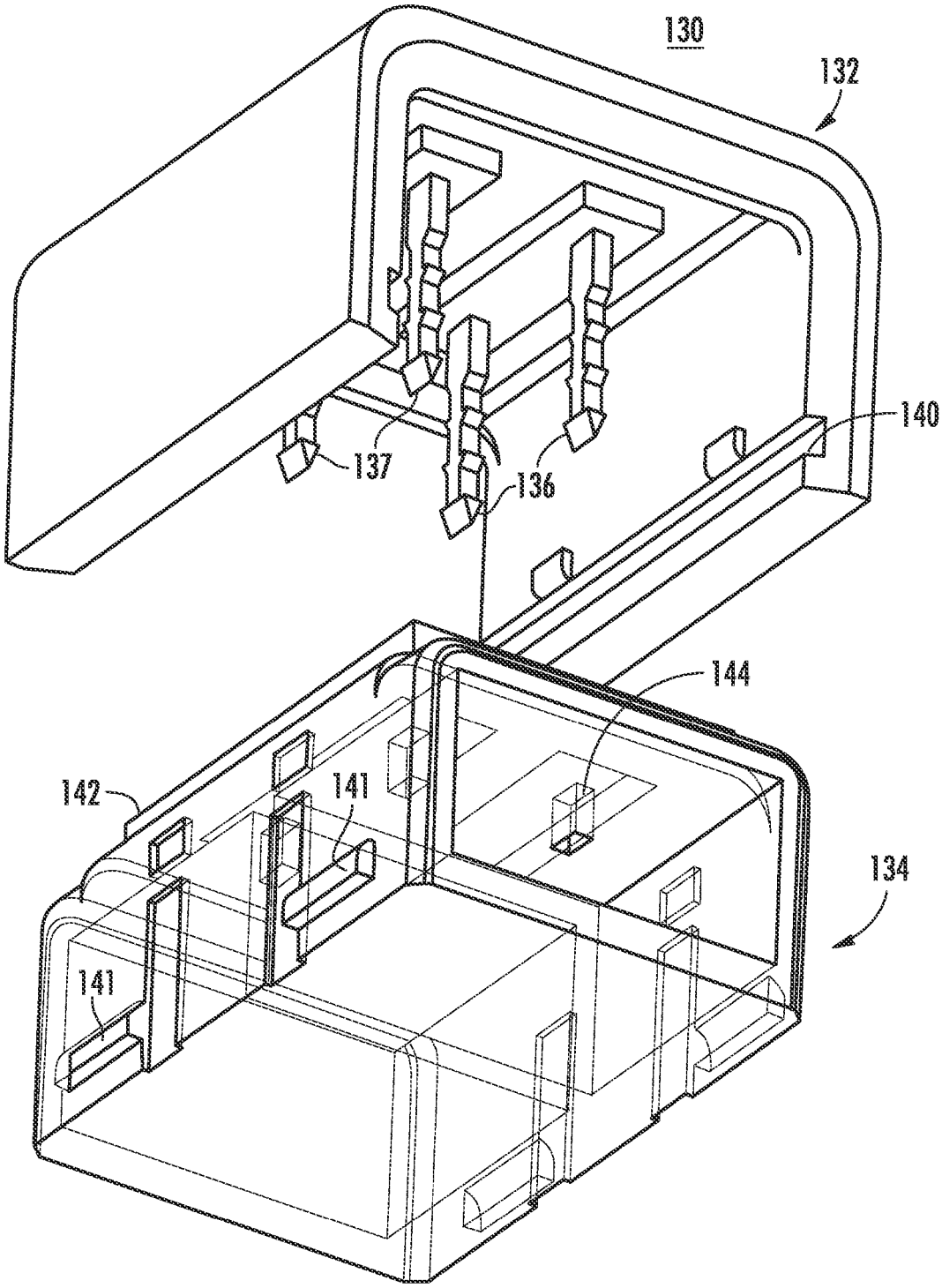
Figure 25B:
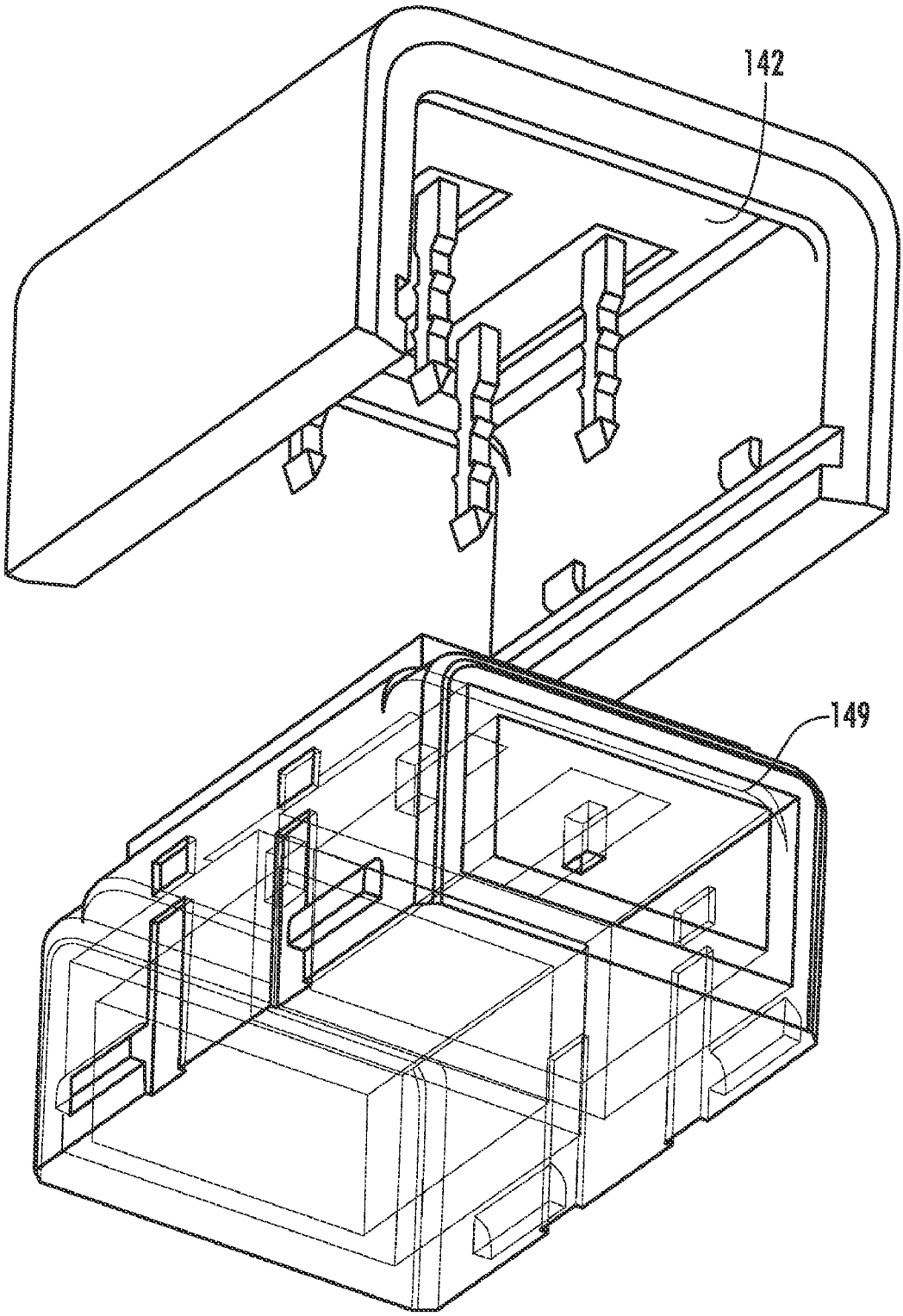
Figure 26:
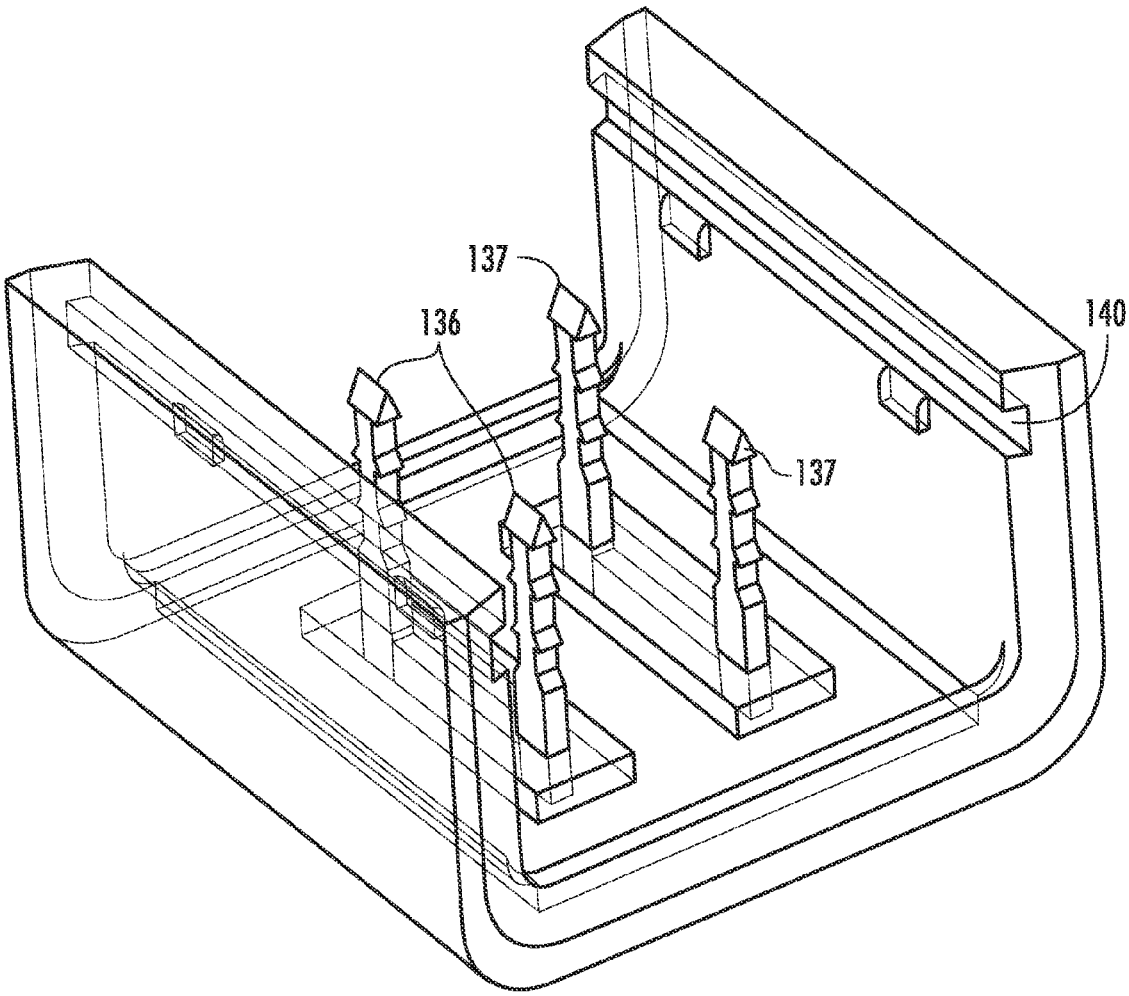
FIG. 26 is an X-ray view of an upper housing in accordance with a fifth embodiment of the present invention.
Figure 27:
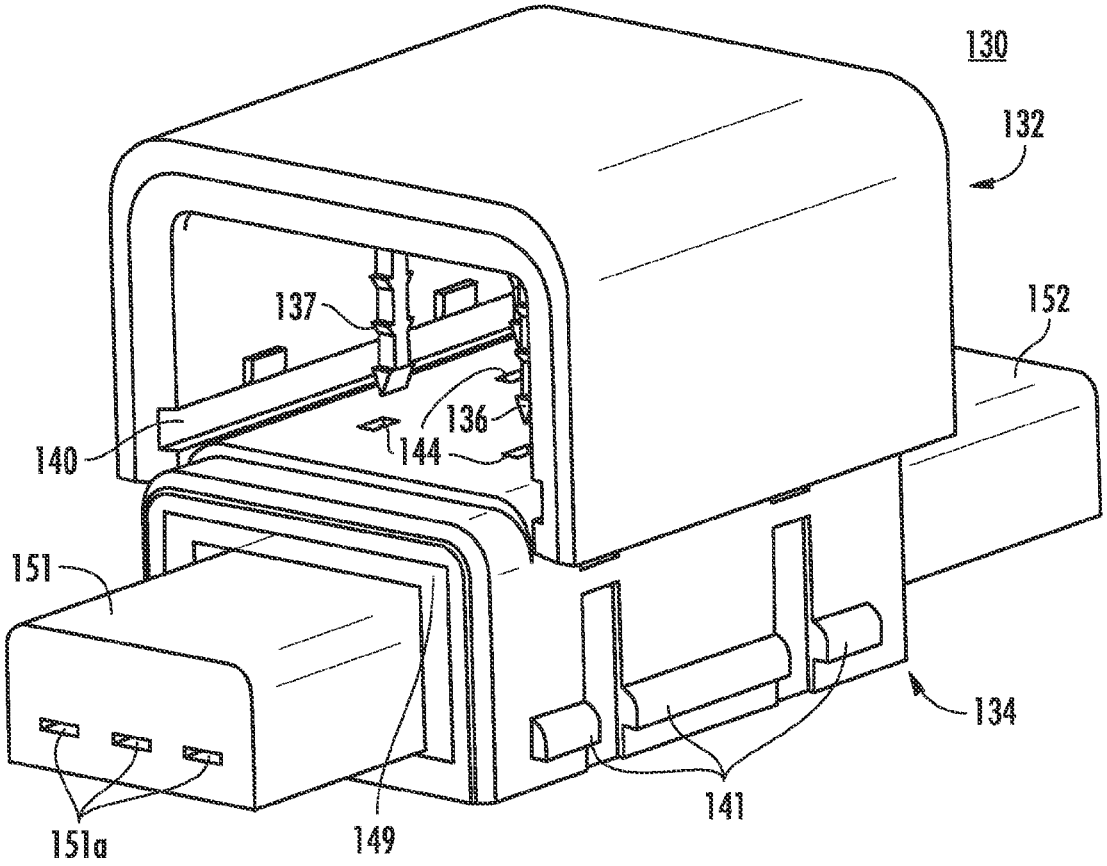
FIG. 27 is a perspective view of a disassembled I-branch lighting connector in accordance with a fifth embodiment of the present invention showing how lengths of lighting apparatus are connected to the lighting connector.

Preferably the tips of each connector pin are configured to increase the contact area between the connector pin and conductive buses of the lighting apparatuses, e.g., conductor buses 121*a*, 122*a* and 123*a*, as shown in FIGS. 23A and 23B. To achieve this function, the tip can be in the shape of an inverted "V" or "U."

When assembling the connector 100, the pressure caused by the coupling of the interlocking groove(s) 110 and tongue(s) 111, as well as the penetration of the connector pins 106 and 107 through the opening gaskets 119 and into an encapsulant or protective sheath(es), cover(s) or layer(s) of a lighting apparatus (such as an LED light wire, cable, bar or tube), creates a waterproof seal between the upper housing 102 and lower housing 104, between the opening gaskets 119 and the lighting apparatuses. Specifically, the gasket 112 tightly presses onto the lower housing and lighting apparatus 121, thereby creating a tight pressure seal. Further, the opening gaskets 119 tightly press the lighting apparatuses via pressure insertion of the lighting apparatus into the openings 118, and the penetration of the outer ones of connector pins 106 and 107 into the lighting apparatuses 122 and 123. The inner ones of the connector pins will penetrate the lighting apparatus 121.

As can be seen in FIGS. 23A and 23B, when the connector is assembled, the connector pins 106 and 107 penetrate through the encapsulant of the lighting apparatuses 121, 122 and 123 to make contact with the conductor buses 121*a*, 122*a*, and 123*a*, respectively, causing an electrical connection to be formed between the conductor buses 121*a*, 122*a*, and 123*a* (e.g., as shown in FIG. 23A, the two outer conductor buses in lighting apparatuses 121, 122 and 123), to permit an electrical signal and/or power to pass between lighting apparatuses 121, 122 and 123 and securely connecting the lighting apparatuses together.

As shown in FIGS. 24A-28, in accordance with a fifth preferred embodiment, an I-branch lighting connector 130 is formed from an upper housing 132 and a lower housing 134.

The I-branch connector 130 in accordance with the fifth embodiment works in a substantially similar manner to the L-branch connector 70 described above, except that the I-branch connector is configured to electrically and mechanically connect the ends of a first length 151 and a second length 152 of lighting apparatus, to effectuate a straight connection. As in the first through fourth embodiments, connector pins 136 and 137 are provided in the upper housing 132. The connector pins 136 and 137 have embedded portions 136*a* and 137*a*, respectively formed in the upper housing.

The upper housing includes interlocking groove(s) 140. The interlocking groove(s) 140 mate with interlocking tongue(s) 141 in the lower housing 134 to achieve a secure connection, e.g., a snap fit, between the upper and lower housing when the connector is assembled. A gasket 142 is provided between the upper and lower housings and is used to ensure a tight fit of the housings when the connector has been assembled.

The lower housing 134 includes plural connector pin guide holes 144, and openings 148. In the I-branch embodiment, an end portion of a first length of lighting apparatus 151 is inserted into one of the openings 148 and an end portion of a second length of lighting apparatus 152 is inserted into the other one of the openings 148, as can be seen particularly in FIGS. 27 and 28. An opening gasket 149 lines the openings 148 in the lower housing. Opening gaskets 149 prevent water leaking between the lower housing 134 and the lighting apparatuses inserted into the openings 148.

To assemble the connector 130, the upper housing 132 is coupled with the lower housing 134 via the corresponding interlocking groove(s) 140 and tongue(s) 141. When pressing the upper housing 132 and the lower housing 134 together, the connector pins 136 and 137 on the upper housing are matched with their corresponding connector pin guide holes 144 on the lower housing. The connector pins/connector pin guide holes guides the upper housing and lower housing in a manner which permits easy coupling of the corresponding interlocking groove(s) and tongue(s).

Figure 28:
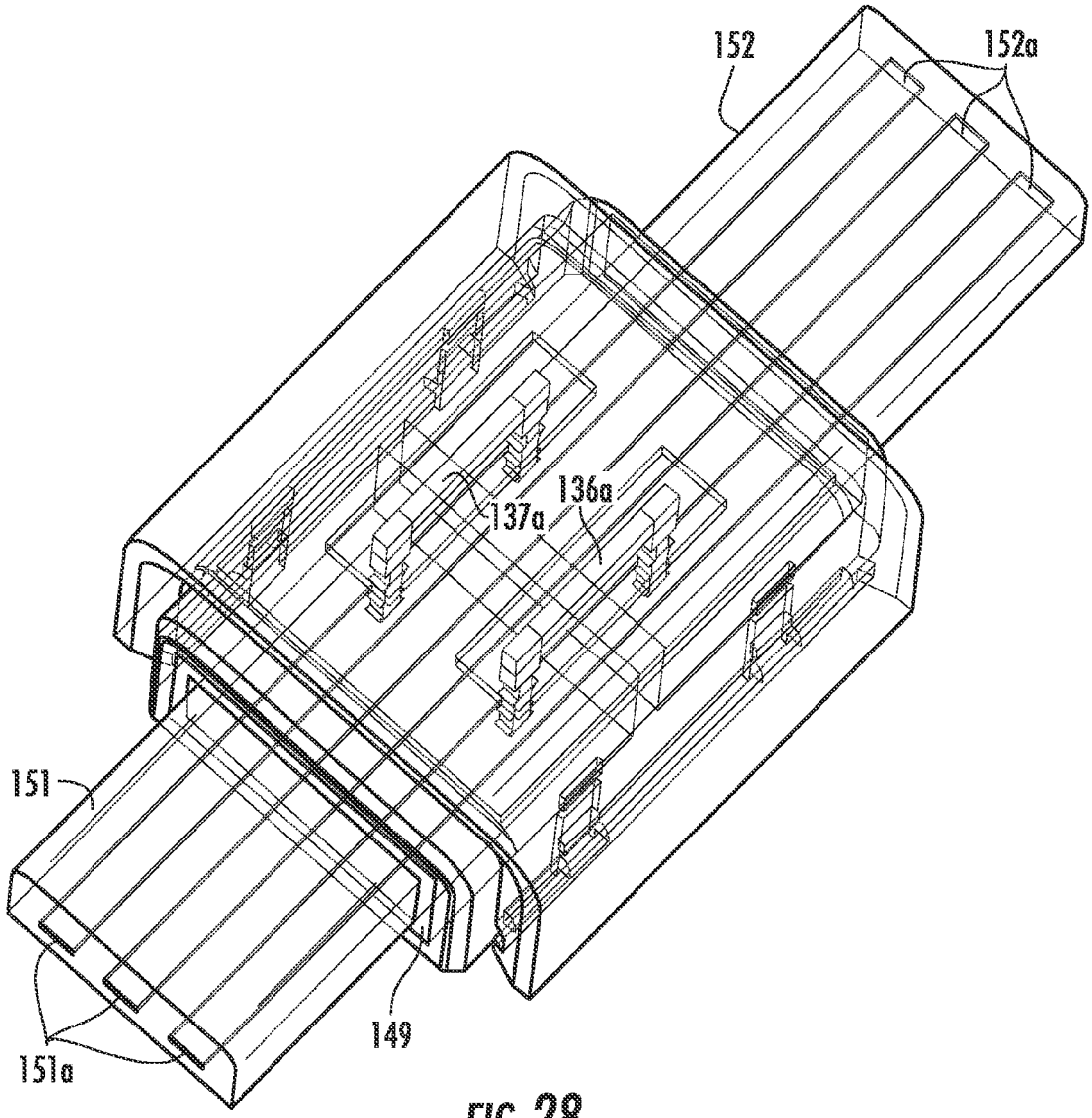
FIG. 28 is an X-ray view of an assembled I-branch lighting connector in accordance with a fifth embodiment of the present invention.
Figure 29:
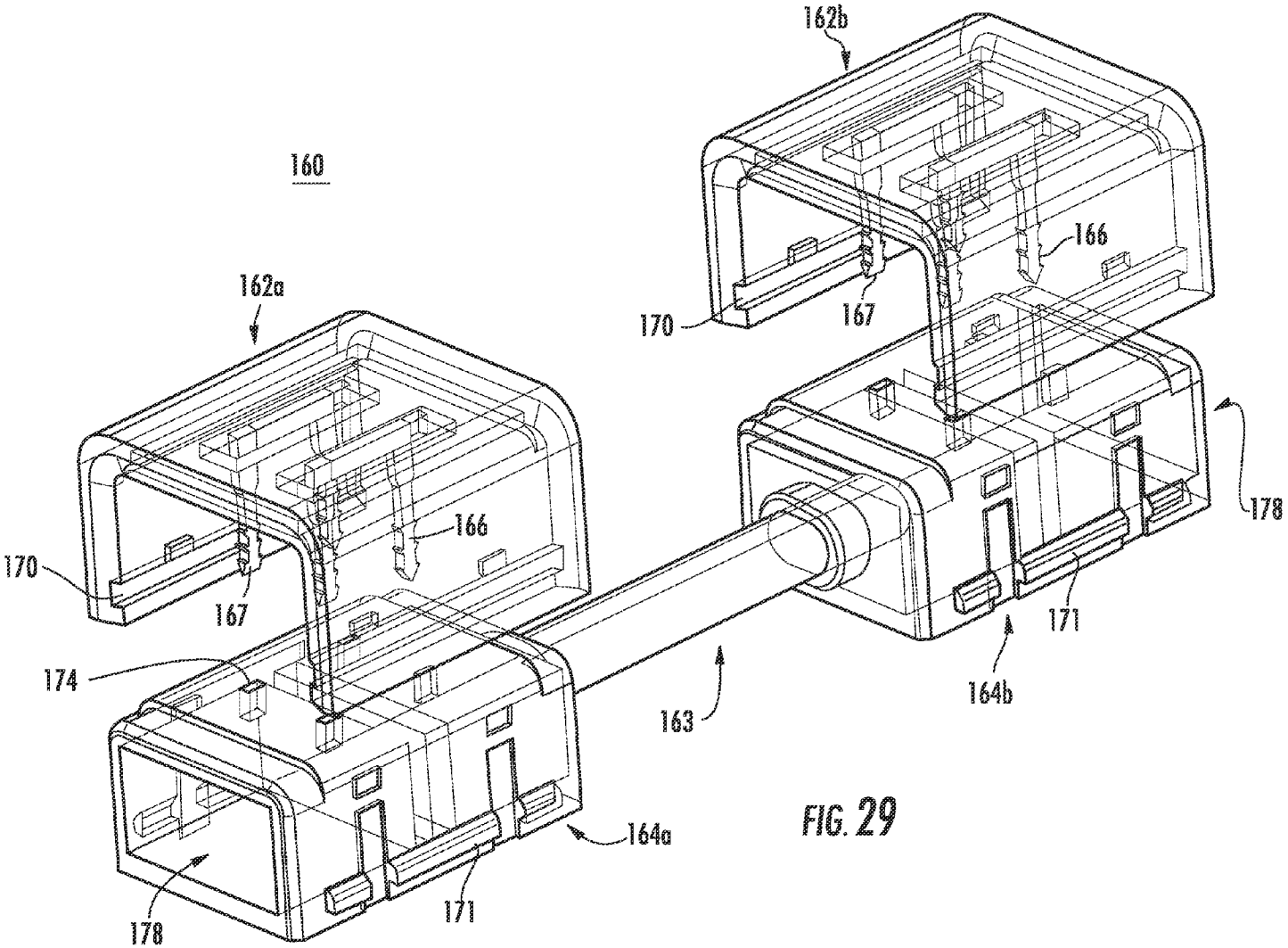
FIGS. 29, 30A and 30B are X-ray views of a disassembled I-extending lighting connector in accordance with a sixth embodiment of the present invention.

Preferably the tips of each connector pin are configured to increase the contact area between the connector pin and a conductive bus of the lighting apparatus, e.g., conductor bus 151*a* or conductor bus 152*a*, as shown in FIG. 28. To achieve this function, the tip can be in the shape of an inverted "V" or "U."

When assembling the connector 130, the pressure caused by the coupling of the interlocking groove(s) 140 and tongue(s) 141, as well as the penetration of the connector pins 136 and 137 through the opening gaskets 149 and into an encapsulant or protective sheath(es), cover(s) or layer(s) of a lighting apparatus (such as an LED light wire, cable, bar or tube), creates a waterproof seal between the upper housing 132 and lower housing 134, between the opening gaskets 149 and the lighting apparatuses. Specifically, the gasket 142 tightly presses onto the lower housing, thereby creating a tight pressure seal. Further, the opening gaskets 149 tightly press the lighting apparatuses via pressure insertion of the lighting apparatus into the openings 148, and the penetration of the connector pins 136 and 137 into the lighting apparatus.

As can be seen in FIG. 28, when the connector is assembled, the connector pins 136 and 137 penetrate through the encapsulant of the lighting apparatuses 151 and 152 to make contact with the conductor buses 151*a* and 152*a*, respectively, causing an electrical connection to be formed between the conductor buses 151*a* and 152*a* (e.g., as shown in FIG. 28, the two outer conductive buses 151*a* and 152*a*) to permit an electrical signal and/or power to pass between lighting apparatuses 151 and 152 and securely connecting the lighting apparatuses together.

As shown in FIGS. 29-33, in accordance with a sixth preferred embodiment, an I-extender lighting connector 160 is formed from upper housings 162*a* and 162*b* and lower housings 164*a* and 164*b*, and a preferably flexible connector extension 163 formed so as to electrically connect the lower housings together.

The I-extender connector in accordance with the sixth embodiment works in a substantially similar manner to the I-branch connector 130 described above, in that the I-extender connector is configured to electrically and mechanically connect the ends of a first length 181 and a second length 182 of lighting apparatus. However, by providing the flexible connector extension 163 between the lower housings 164*a* and 164*b*, a flexible connection may be achieved, which is not limited to a straight connection. As in the first through fifth embodiments, each upper housing has connector pins 166 and 167 provided therein. However, the I-extended connector 160 includes two upper housings, 162*a* and 162*b*, each connecting to a respective one of the lower housings 164*a* and 164*b*. The connector pins 166 and 167 have embedded portions 166*a* and 167*a*, respectively formed in the upper housing.

Figure 30A:
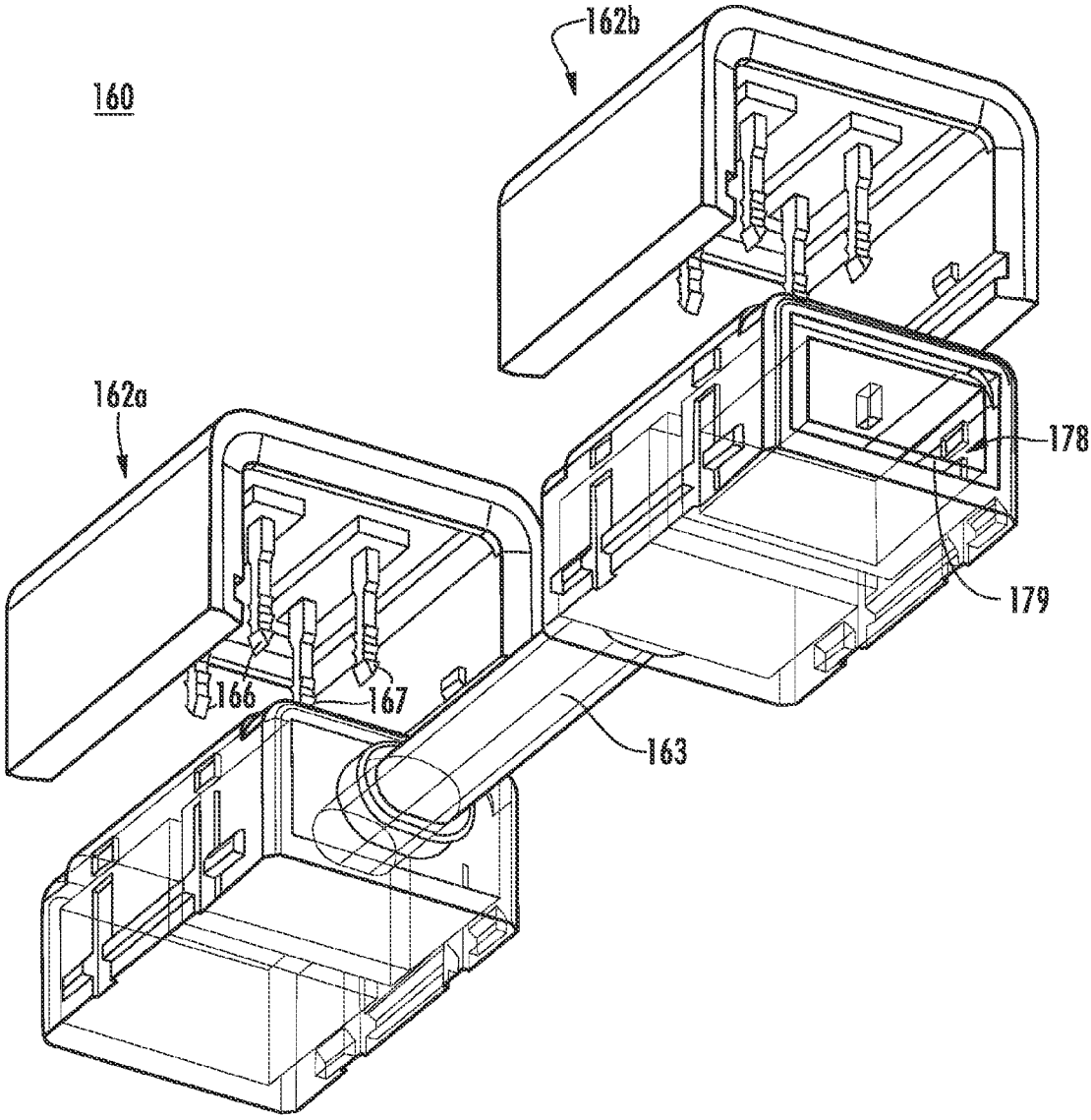
Figure 30B:
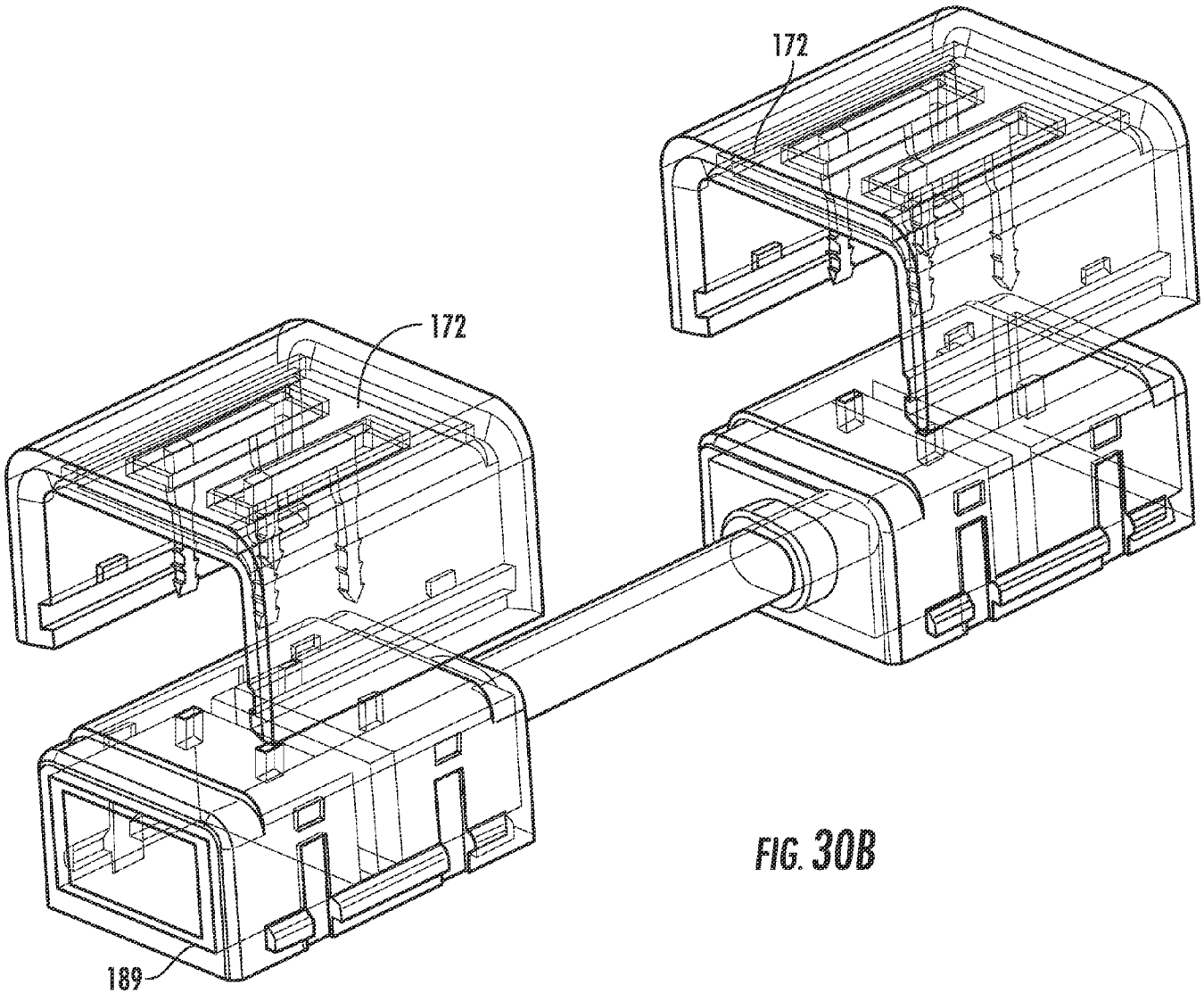
Figure 31:
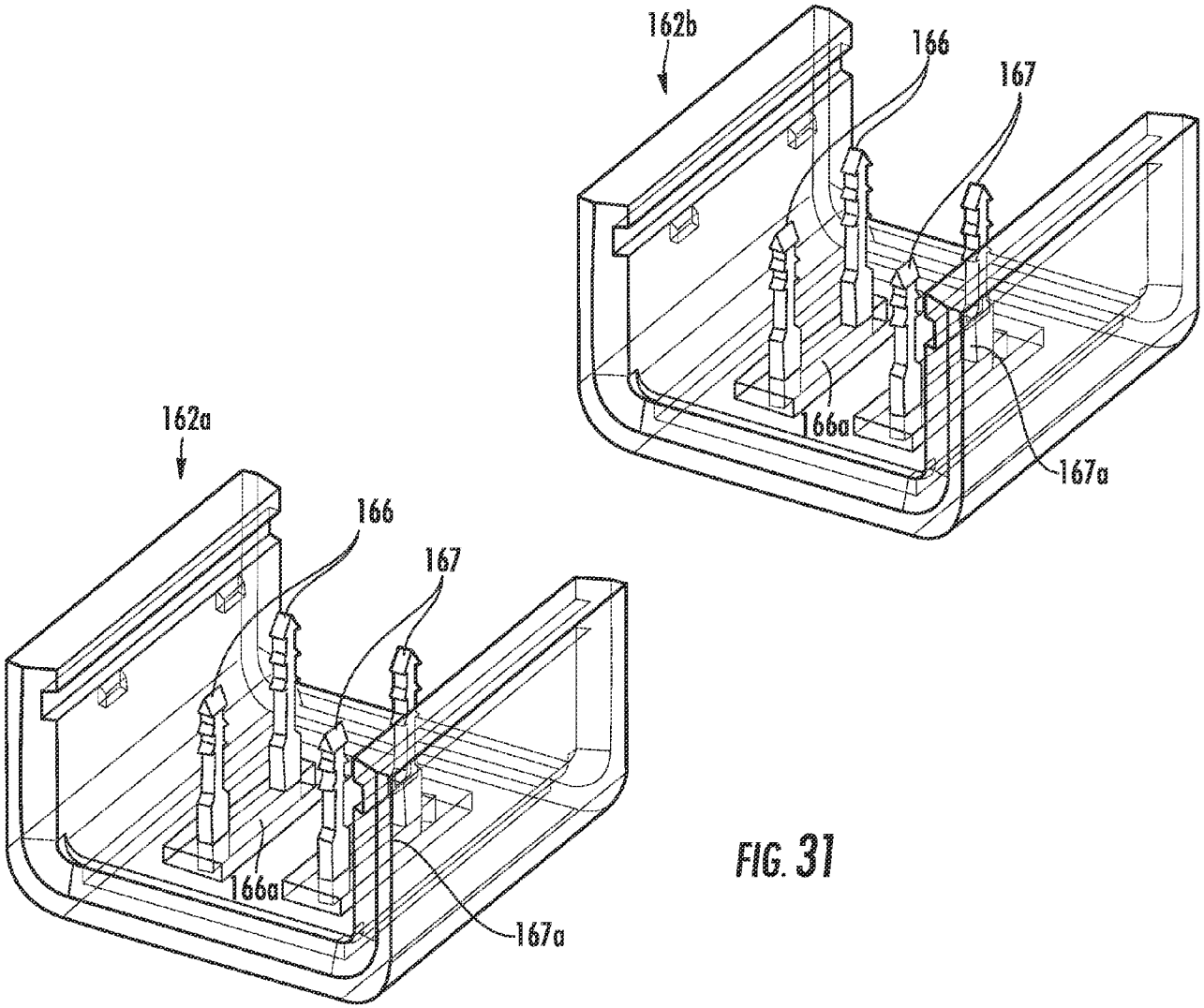
FIG. 31 are X-ray views of upper housings in accordance with the sixth embodiment of the present invention.

Each upper housing includes interlocking groove(s) 170. The interlocking groove(s) 170 mate with interlocking tongue(s) 171 in the corresponding lower housing 174*a* or 174*b* to achieve a secure connection, e.g., a snap fit, between the upper and corresponding lower housing when the connector is assembled. As shown in FIG. 30B, a gasket 172 may be provided between the upper and lower housings, in a manner similar to that shown with regard to the other embodiments, to ensure a tight fit of the housings when the connector 160 has been assembled.

The lower housings 164*a* and 164*b* each includes plural connector pin guide holes 174, and openings 178. In the I-extender embodiment, an end portion of a first length of lighting apparatus 181 is inserted into one of the openings 178 and an end portion of a second length of lighting apparatus 182 is inserted into the other one of the openings 178, as can be seen particularly in FIGS. 32 and 33. An opening gasket 179 may be used to line the openings 188 in the lower housings. Opening gaskets 179 prevent water leaking between the lower housings 164*a* and 164*b* and the lighting apparatuses inserted into the openings 178.

To assemble the connector 160, the upper housings 162*a* and 162*b* are coupled with the corresponding lower housings 164*a* and 164*b*, via the corresponding interlocking groove(s) 170 and tongue(s) 171. When pressing the upper housings 162*a* and 162*b* and the lower housings 164*a* and 164*b* together, the connector pins 166 and 167 on the upper housings are matched with their corresponding connector pin guide holes 174 on the lower housings. The connector pins/connector pin guide holes guide the upper housings and lower housings in a manner which permits easy coupling of the corresponding interlocking groove(s) and tongue(s).

Figure 33:
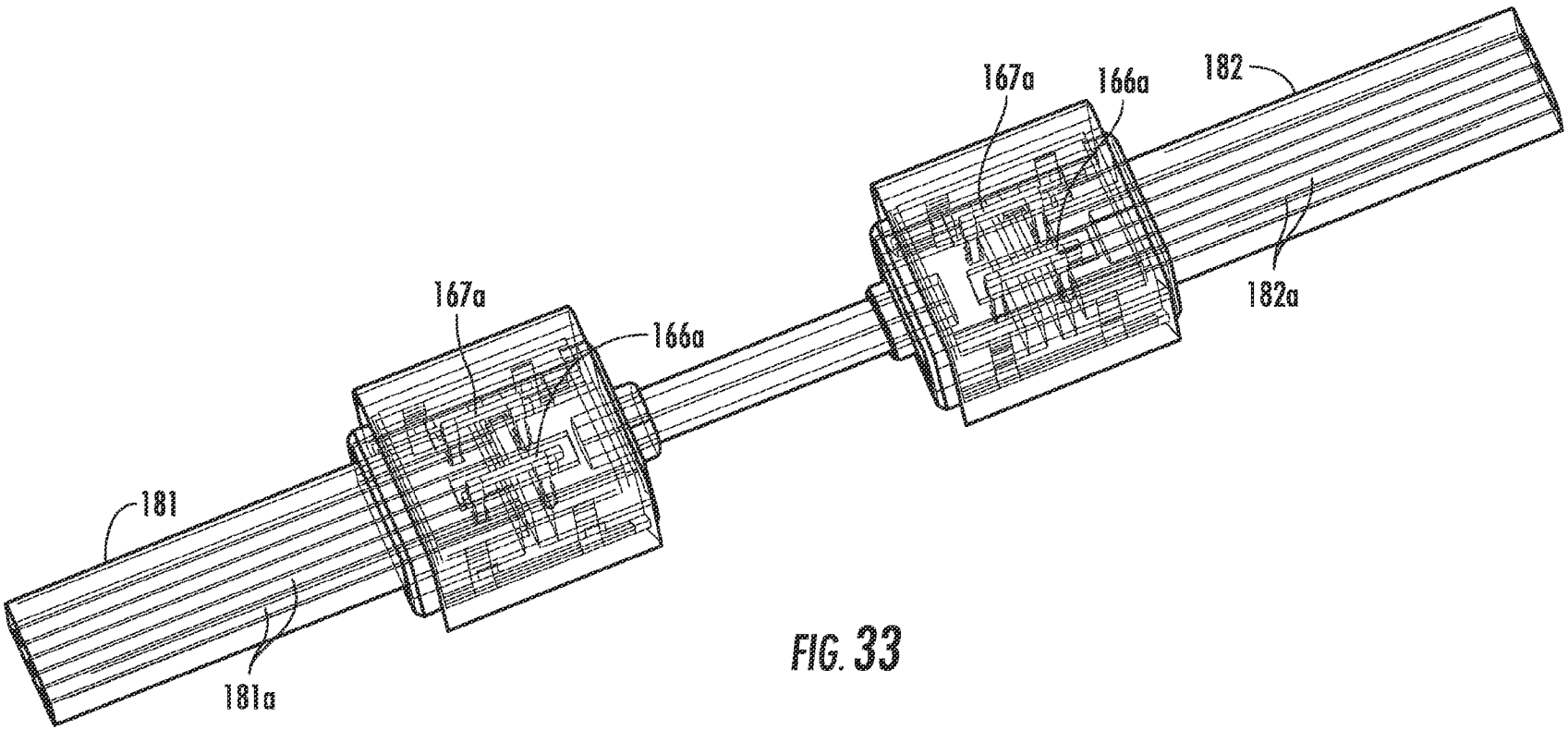
FIG. 33 is an X-ray view of an assembled I-extending lighting connector in accordance with a sixth embodiment of the present invention.
Figure 34:
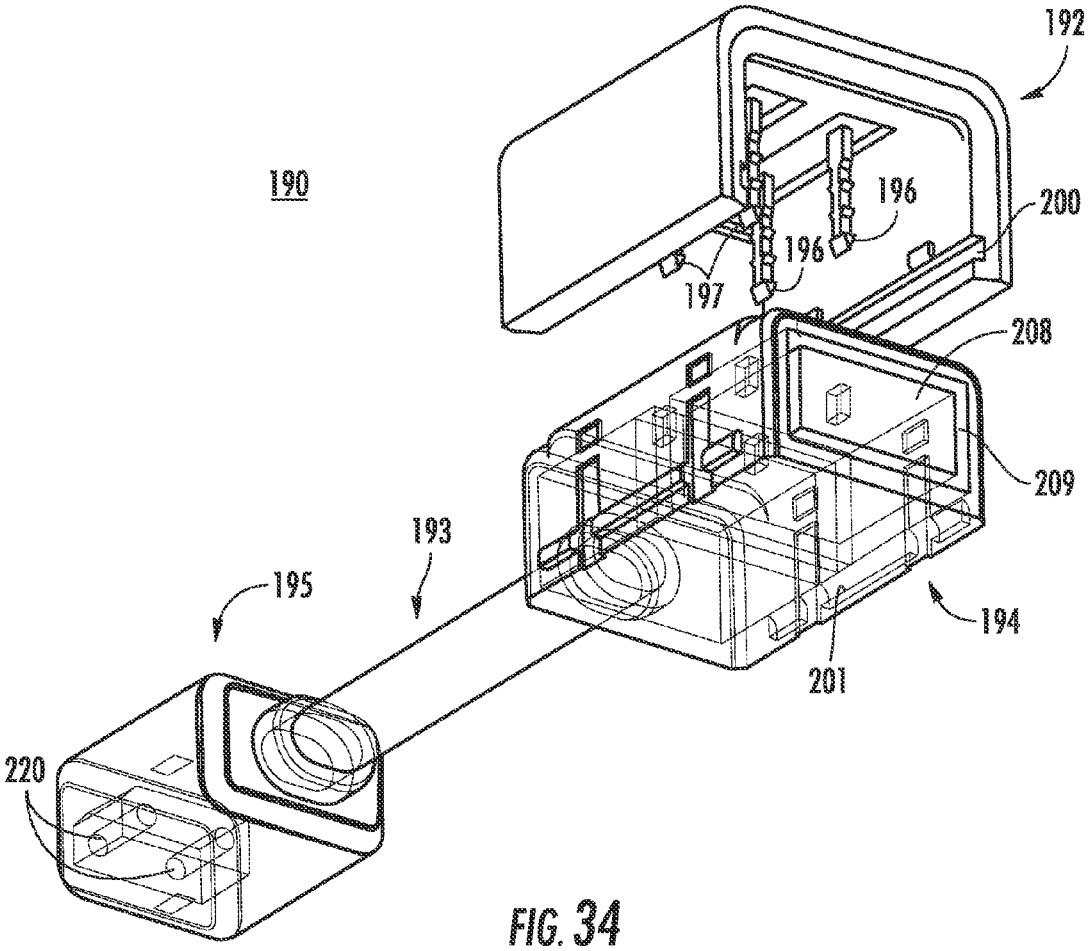
FIGS. 34 and 35 are X-ray views of a disassembled power source-extender connector in accordance with a seventh embodiment of the present invention.
Figure 35:
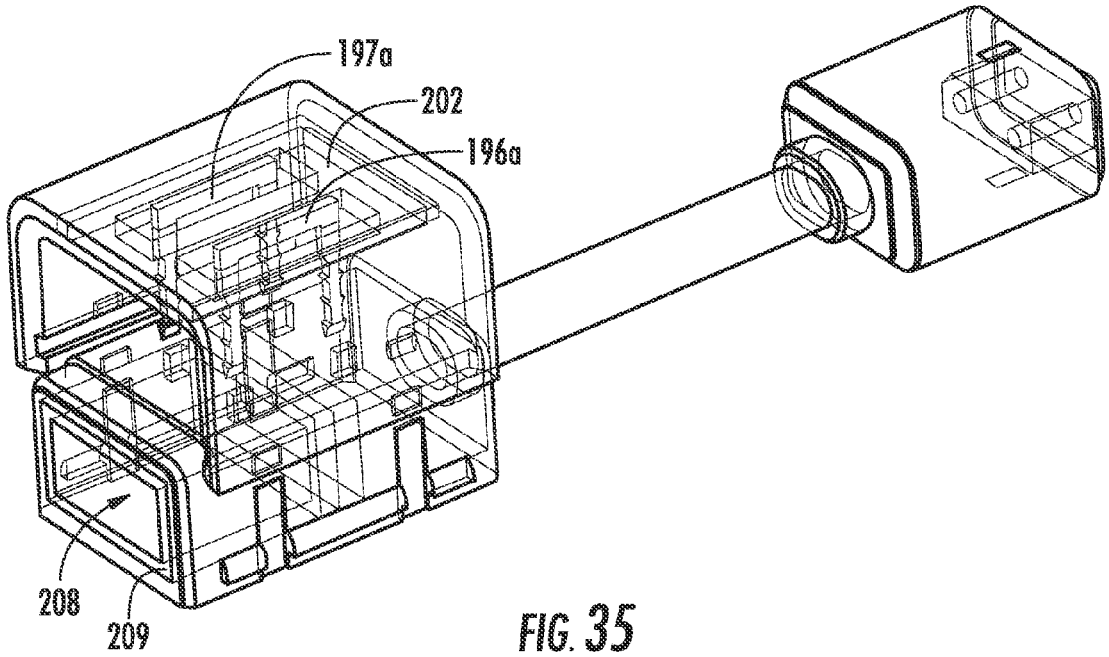

Preferably the tips of each connector pin are configured to increase the contact area between the connector pin and a conductive bus of the lighting apparatus, e.g., conductor bus 151*a* or conductor bus 152*a*, as shown in FIG. 33. To achieve this function, the tip can be in the shape of an inverted "V" or "U."

When assembling the connector 160, the pressure caused by the coupling of the interlocking groove(s) 170 and tongue(s) 171, as well as the penetration of the connector pins 166 and 167 through the opening gaskets 189, and into an encapsulant or protective sheath(es), cover(s) or layer(s) of a lighting apparatus (such as an LED light wire, cable, bar or tube), creates a waterproof seal between the upper housings 162*a* and 162*b* and lower housings 164*a* and 164*b*, and between the opening gaskets 179 and the lighting apparatuses. The gasket 172 provided between the upper and lower housings provides a tighter pressure seal. Further, opening gaskets 179 tightly press the lighting apparatuses via pressure insertion of the lighting apparatus into the openings 178, and the penetration of the connector pins 166 and 167 into the lighting apparatus.

Figure 32:
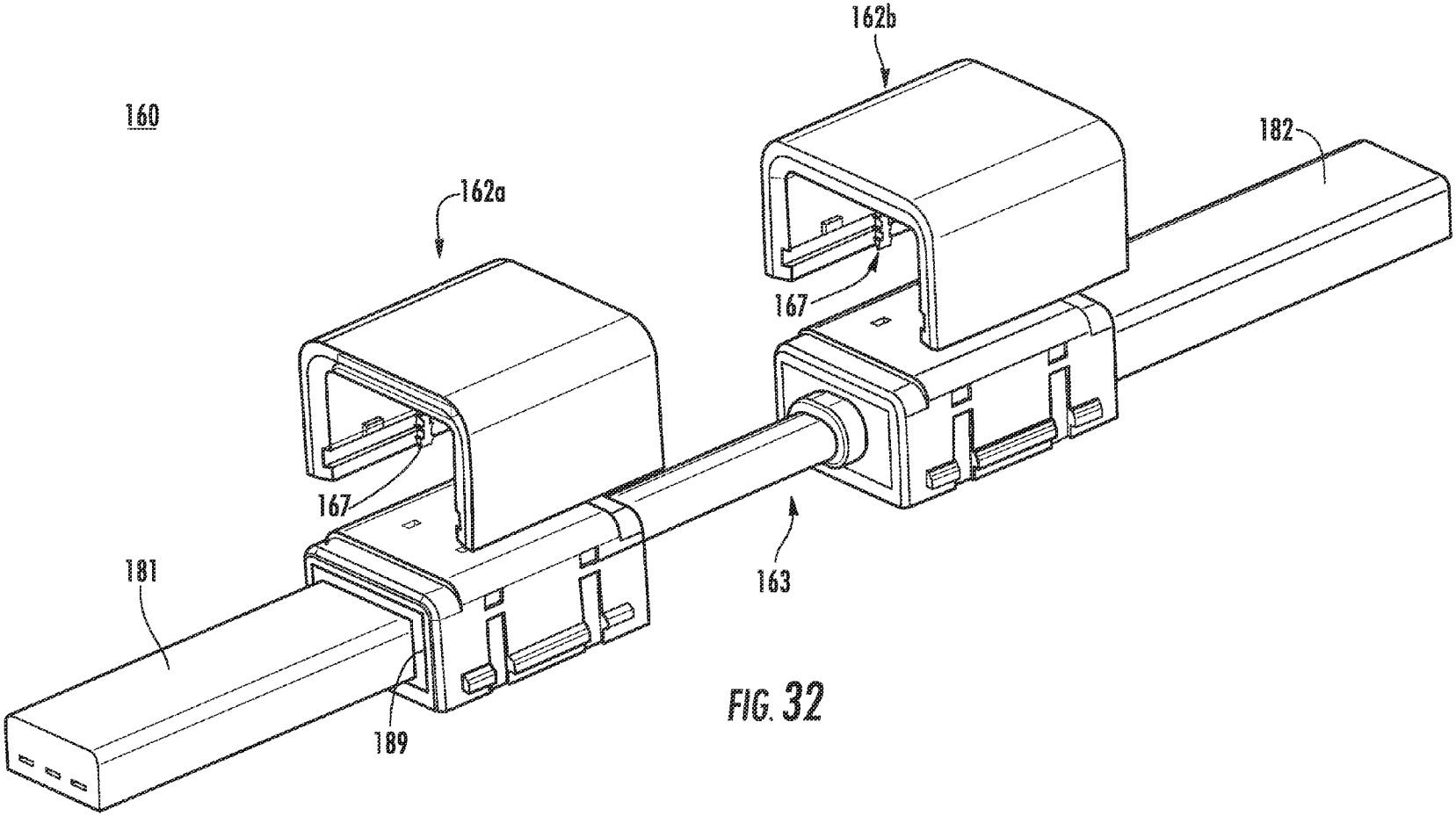
FIG. 32 is a perspective view of a disassembled I-extending lighting connector in accordance with a sixth embodiment of the present invention showing how lengths of lighting apparatus are connected to the lighting connector.

As can be seen in FIGS. 32 and 33, when the connector is assembled, the outermost ones of the connector pins 166 and 167 penetrate through the encapsulant of the lighting apparatuses 181 and 182. The innermost ones of the connector pins 166 and 167 penetrate into the inner portions of the lower housings to make contact with (a) conductive leads that electrically couple with wires in the flexible connector extension 163, (b) the wires from the flexible connector extension 163, or (c) the wires within the flexible connector extension 163 by penetrating through the flexible connector extension 163 and contacting the wires within the flexible connector extension 163. Flexible connector extension 163 can have one or more wires electrically coupled to the conductive leads in the inner portion of each lower housing. Each of the possible connections described above causes an electrical connection to be formed between the conductor buses 181*a* and 182*a*, by the electrical coupling of the lower housings to one another, to permit an electrical signal and/or power to pass between lighting apparatuses 181 and 182 and securely connecting the lighting apparatuses together. In one alternative embodiment, the connector pins that couple directly or indirectly with the wires in flexible connector extension 163 are U-shaped at the tip.

As shown in FIGS. 34-37, in accordance with a seventh preferred embodiment, power source-extender connector 190 is formed from upper housings 192, lower housing 194, a power supply plug 195, and a preferably flexible connector extension 193 formed so as to electrically connect the lower housing with the power supply plug 195.

As in the first through sixth embodiments, connector pins 196 and 197 are provided in the upper housing 192. The connector pins 196 and 197 have embedded portions 196*a* and 197*a*, respectively formed in the upper housing.

The upper housing 192 and the lower housing 194 are substantially the same as one of the upper and lower housings 162*b* and 164*b* described above with reference to the I-extender embodiment. The difference between the power source-extender connector 190 and the I-extender embodiment is that instead of the flexible connector extension 193 terminating in another set of upper and lower housings to connect with another length of lighting apparatus, in the seventh embodiment, the flexible connector extension 193 terminates in a power supply plug 195, which supplies power to the lighting apparatus connected to the power source-extender connector 190. Thus, in the seventh embodiment, there is only a single upper and lower housing pair, instead of two, as was the case in the sixth embodiment. Power supply plug 195 preferably includes a female power connector 220, which can mate with any conventional power source for powering lighting apparatuses. Of course the connector is not limited to a female connector, and any known manner of electrical connection may be employed, e.g., depending on the configuration of the power source supply cable.

The upper housing includes interlocking groove(s) 200. The interlocking groove(s) 200 mate with interlocking tongue(s) 201 in the lower housing 194 to achieve a secure connection, e.g., a snap fit, between the upper and lower housing when the connector is assembled. A gasket 202 is provided between the upper and lower housings and is used to ensure a tight fit of the housings when the connector has been assembled.

The lower housing 194 includes plural connector pin guide holes 204, and openings 208. An end portion of a length of lighting apparatus 211 is inserted into the opening 208, as can be seen particularly in FIGS. 36 and 37. An opening gasket 209 lines the opening 208 in the lower housing. The opening gasket 209 prevents water leaking between the lower housing 194 and the lighting apparatus inserted into the opening 208.

To assemble the connector 190, the upper housing 192 is coupled with the lower housing 194 via the corresponding interlocking groove(s) 200 and tongue(s) 201. When pressing the upper housing 192 and the lower housing 194 together, the connector pins 196 and 197 on the upper housing are matched with their corresponding connector pin guide holes 204 on the lower housing. The connector pins/connector pin guide holes guides the upper housing and lower housing in a manner which permits easy coupling of the corresponding interlocking groove(s) and tongue(s).

Figure 36:
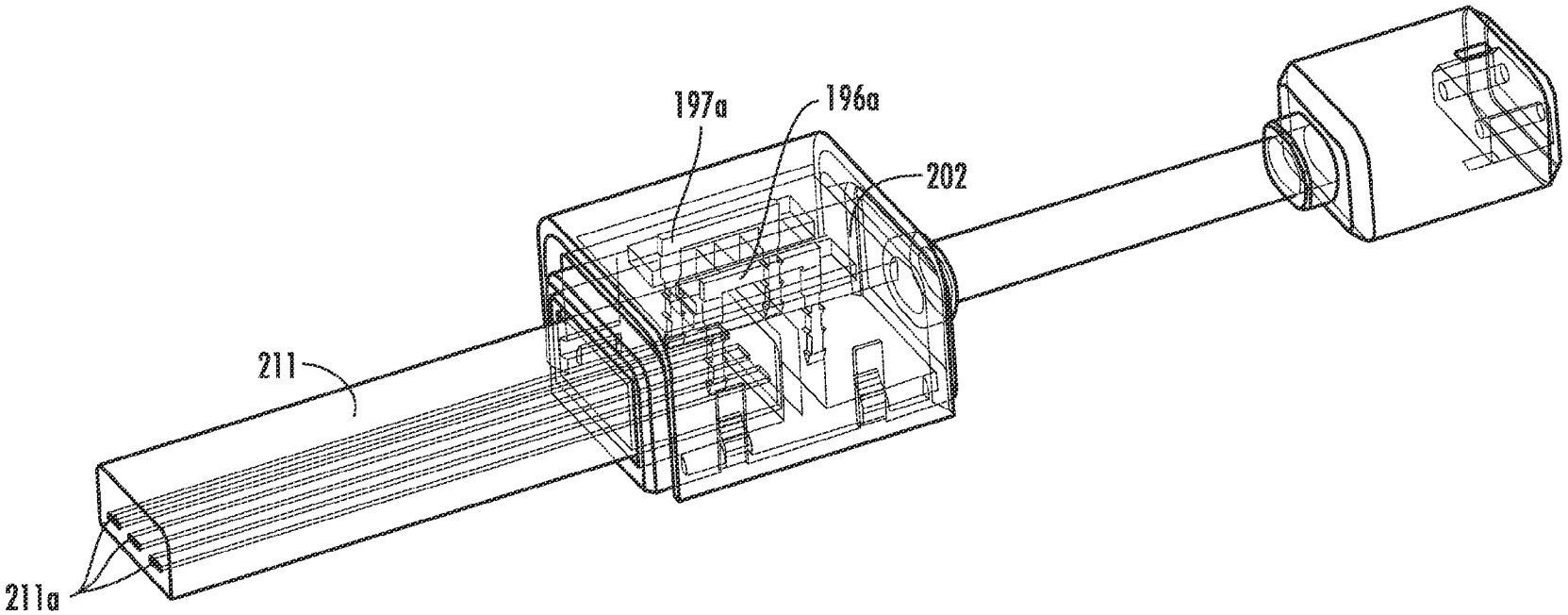
FIG. 36 is an X-ray view of an assembled power source-extender connector in accordance with the seventh embodiment of the present invention.
Figure 37:
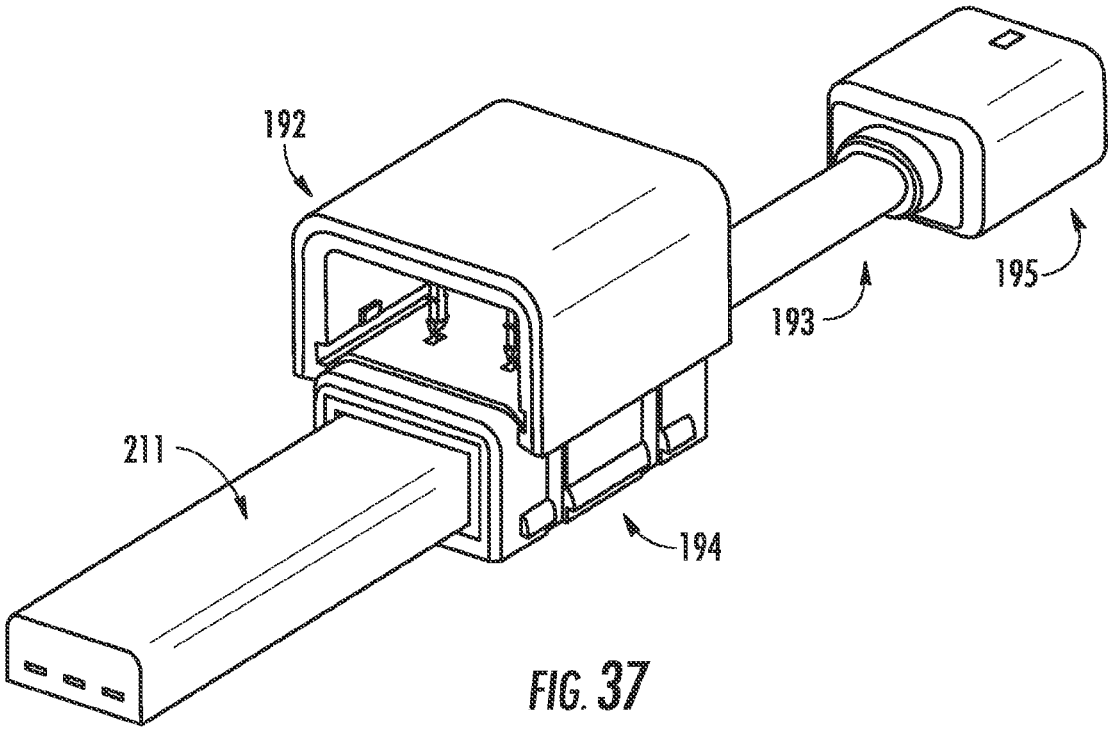
FIG. 37 is a perspective view of a disassembled power source-extender connector in accordance with a seventh embodiment of the present invention.

Preferably the tips of each connector pin are configured to increase the contact area between the connector pin and a conductive bus of the lighting apparatus, e.g., conductor bus 211*a*, as shown in FIG. 36. To achieve this function, the tip can be in the shape of an inverted "V" or "U."

As in the I-extender embodiment, for example, when assembling the connector 190, and in particular, the upper and lower housings, the pressure caused by the coupling of the interlocking groove(s) 200 and tongue(s) 201, as well as the penetration of the connector pins 196 and 197 through the opening gasket 209, and into an encapsulant or protective sheath(es), cover(s) or layer(s) of a lighting apparatus (such as an LED light wire, cable, bar or tube), creates a waterproof seal between the upper housing 192 and the lower housing 194, and between the opening gasket 209 and the lighting apparatus. The gasket 202 provided between the upper and lower housing provides a tighter pressure seal. Further, opening gasket 209 tightly presses the lighting apparatuses via pressure insertion of the lighting apparatus into the openings 208, and the penetration of the connector pins 196 and 197 into the lighting apparatus.

As can be seen in FIG. 36, when the connector is assembled, one end of each of the connector pins 196 and 197 (the leftmost ends in FIG. 36) penetrate through the encapsulant of the lighting apparatus 211 to make contact with the conductor buses 211*a*. The innermost ones of the connector pins 196 and 197 penetrate into the inner portion of the lower housing to make contact with (a) conductive leads that electrically couple with wires in the flexible connector extension 193, (b) the wires from the flexible connector extension 193, or (c) the wires within the flexible connector extension 193 by penetrating through the flexible connector extension 193 and contacting the wires within the flexible connector extension 193. Flexible connector extension 163 can have one or more wires electrically coupled to the conductive leads in the inner portion of the lower housing. Flexible connector extension 193 can have one or more wires electrically coupled to the conductive leads in the inner portion of the lower housing. Each of the possible connections described above causes an electrical connection to be formed between the conductor bus 211*a* and the power supply to permit an electrical signal and/or power to pass to the lighting apparatus 211 from the power supply plug 195. In one alternative embodiment, the connector pins that couple directly or indirectly with the wires in flexible connector extension 193 are U-shaped at the tip.

When creating a lighting system with one or more lighting connector devices, at least two segments of a lighting apparatus (such as an LED light wire, cable, bar or tube) are inserted into their respective opening or slot in the lower housing, and then the upper housing is pressed onto the lower housing. The connector pins will penetrate the encapsulant, protective sheath(es), cover(s) or layer(s) of the segments of the lighting apparatus, and will electrically connect with the conductive buses of the lighting apparatus; thereby, electrically connecting the segments.

Figure 38:
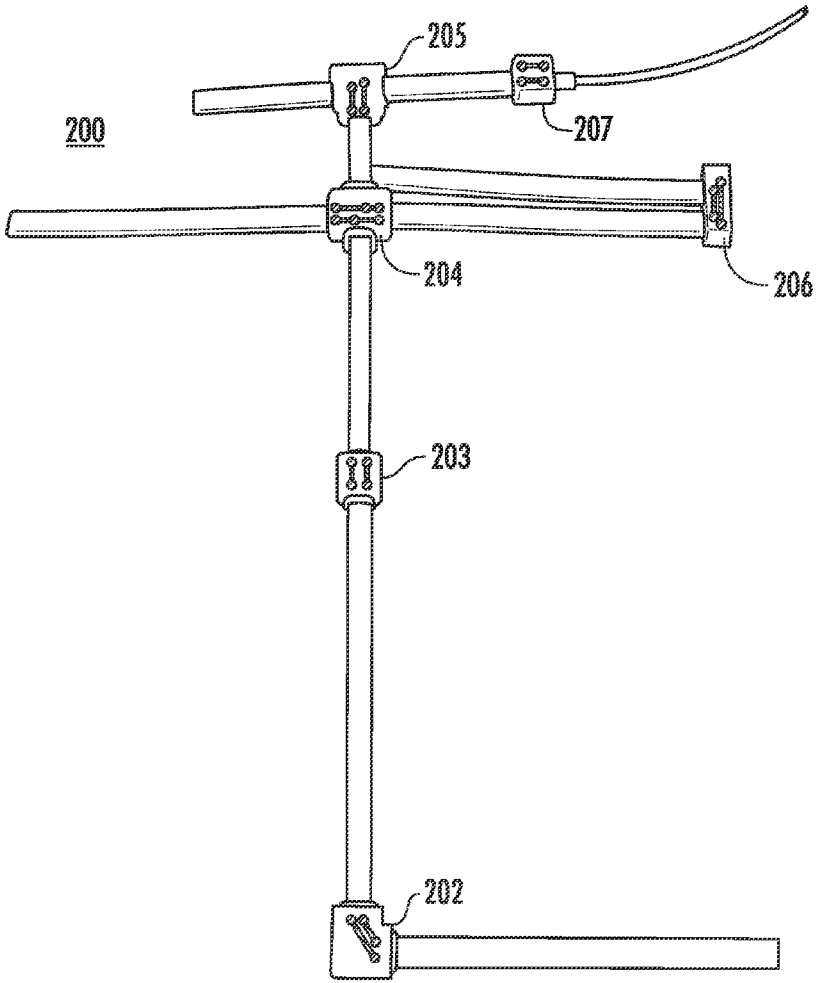
FIG. 38 is a plan view of a lighting system using lighting connectors in accordance with disclosed embodiments of the present invention.

Thus, as would be understood by those skilled in the art, a lighting system can be formed by connecting a number of lengths of lighting apparatus using one or more of the connectors of the above-described embodiments. For example, FIG. 38 shows a number of lengths of lighting apparatus connected to one another using an L-branch connector 202, an I-branch connector 203, an X-branch connector 204, a T-branch connector 205 and a U-branch connector 206 in accordance with the above-described embodiments, to form a light system. The power source for the entire fixture can be provided by a power supply connector device 207, for example, one in accordance with the seventh embodiment.

Figure 39:
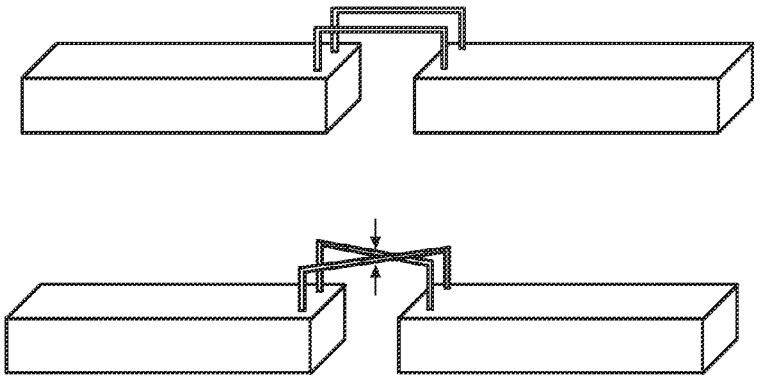
FIG. 39 is a diagram showing orientation of connector pins to connect lengths of lighting apparatus in accordance with the present invention.

While the connector pins of the above described embodiments are each arranged in parallel with one another in any given upper housing, the connector pins may instead be formed within the upper housings so as to cross one another, as long as clearance is provided between the pins to prevent, e.g., a shorting of the connection. Preferably in such a crossing configuration, a clearance of about 1-2 mm should be provided between the embedded portions of the pins within the upper housing, as shown in FIG. 39.

As shown in FIGS. 40A-44, in accordance with an eighth preferred embodiment, a T-connector 221 is formed from three upper housings 222, three lower housings 224, a T-connecting portion 225, and three preferably flexible connector extensions 223 formed so as to electrically connect each of the lower housings 224 with the T-connecting portion 225, and with desired other ones of the lower housings 224. As can be seen in the figures, the upper and lower housings in this embodiment are substantially the same as those described above with reference to the power source extender embodiment. However, in the eight embodiment, there are three sets of housings and each of the three lower housings 224 is connected to a T-connecting portion, instead of to a power supply plug.

As in the first through seventh embodiments, connector pins 226 and 227 are provided in each upper housing 222. The connector pins 226 and 227 have embedded portions 226*a* and 227*a*, respectively formed in the upper housing.

The upper housings 222 and the lower housings 224 are each substantially the same as the upper and lower housings 192 and 194 described above with reference to the power-source extender embodiment. The difference between T-connector 221 and the power source-extender connector 190 is that instead of there being only one set of upper and lower housings, in the T-connector 221, each of three sets of upper and lower housings has a flexible connector extension 223 connected to a T-connecting portion 225, which is itself connected to two other sets of upper and lower housings.

The provision of the T-connecting portion 225 allows three sets of upper and lower housings to connect with one another, enabling the connection of three lengths 241 of lighting apparatus.

Just as in the embodiments discussed above, each upper housing 222 includes interlocking groove(s) 230. The interlocking groove(s) 230 mate with interlocking tongue(s) 231 in the lower housing 224 to achieve a secure connection, e.g., a snap fit, between the upper and lower housing when the connector is assembled. A gasket 232 is provided between the upper and lower housings and is used to ensure a tight fit of the housings when the connector has been assembled.

The lower housings 224 each includes plural connector pin guide holes 234, and openings 238. An end portion of a length of lighting apparatus 241 is inserted into the openings 238 of each lower housing, as can be seen particularly in FIGS. 40A to 42 and 44. An opening gasket 239 lines each opening 238 in each lower housing. The opening gasket 239 prevents water leaking between the lower housing 224 and the lighting apparatus inserted into the opening 238.

To assemble the T-connector 221, each upper housing 222 is coupled with its corresponding lower housing 224 via the corresponding interlocking groove(s) 230 and tongue(s) 231. When pressing the upper housing 222 and the respective lower housing 224 together, the connector pins 226 and 227 on each upper housing are matched with their corresponding connector pin guide holes 234 on the corresponding lower housing. The connector pins/connector pin guide holes guides the upper housing and lower housing in a manner which permits easy coupling of the corresponding interlocking groove(s) and tongue(s).

Figure 40A:
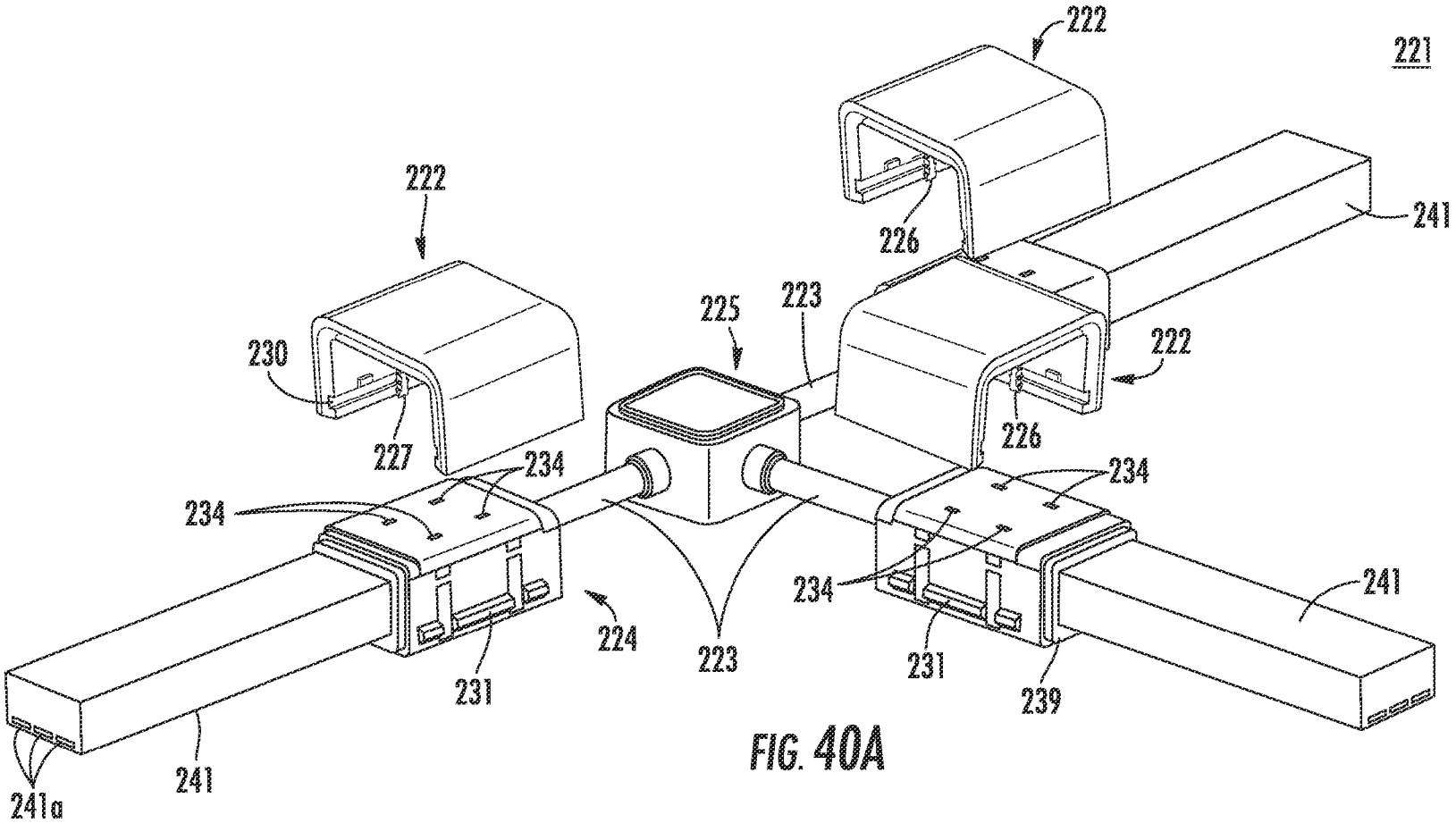
FIGS. 40A and 40B are perspective views of a T-connector in accordance with an eighth embodiment of the present invention, FIG. 40B being an X-ray view.
Figure 40B:
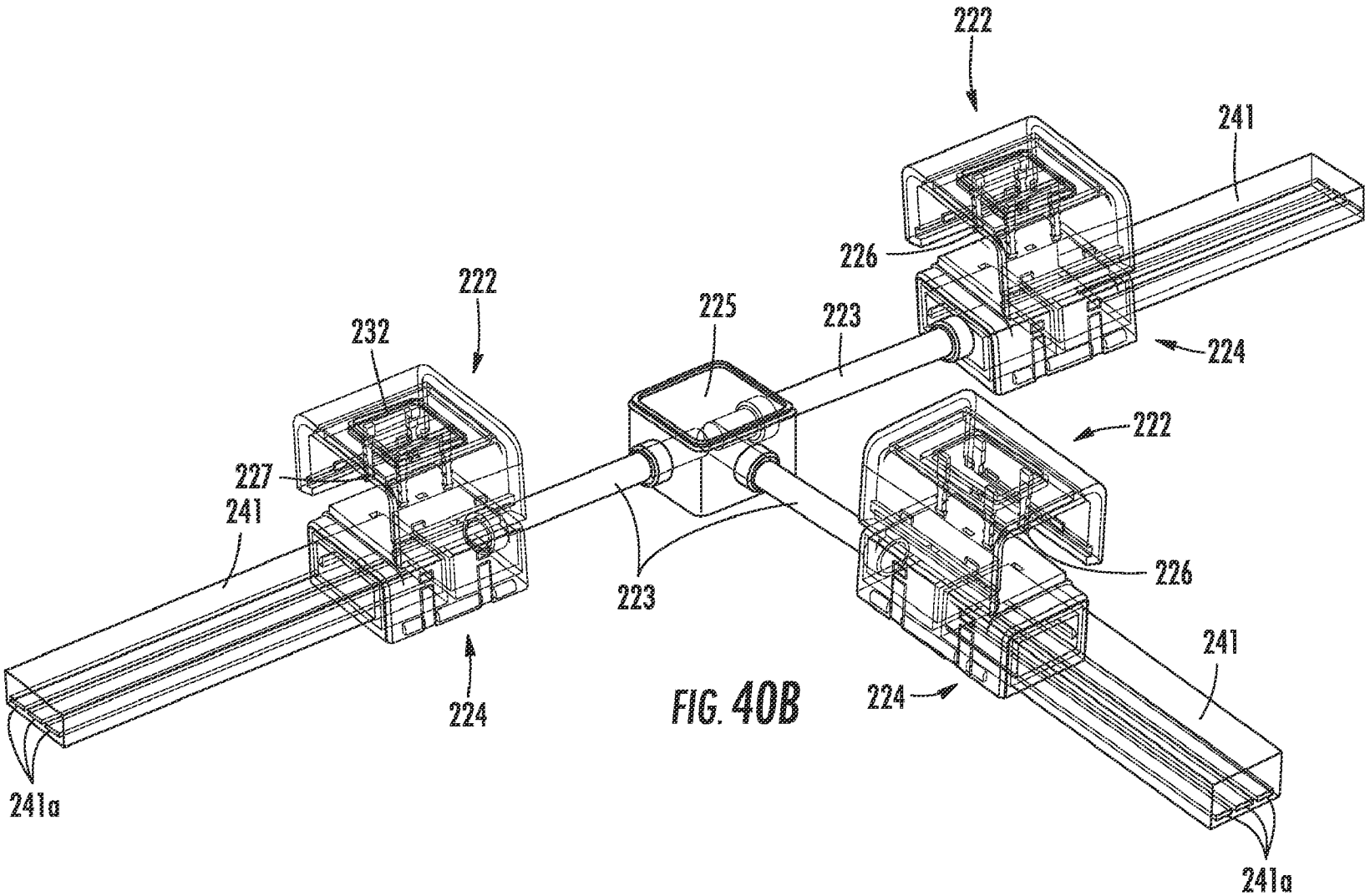
Figure 47:
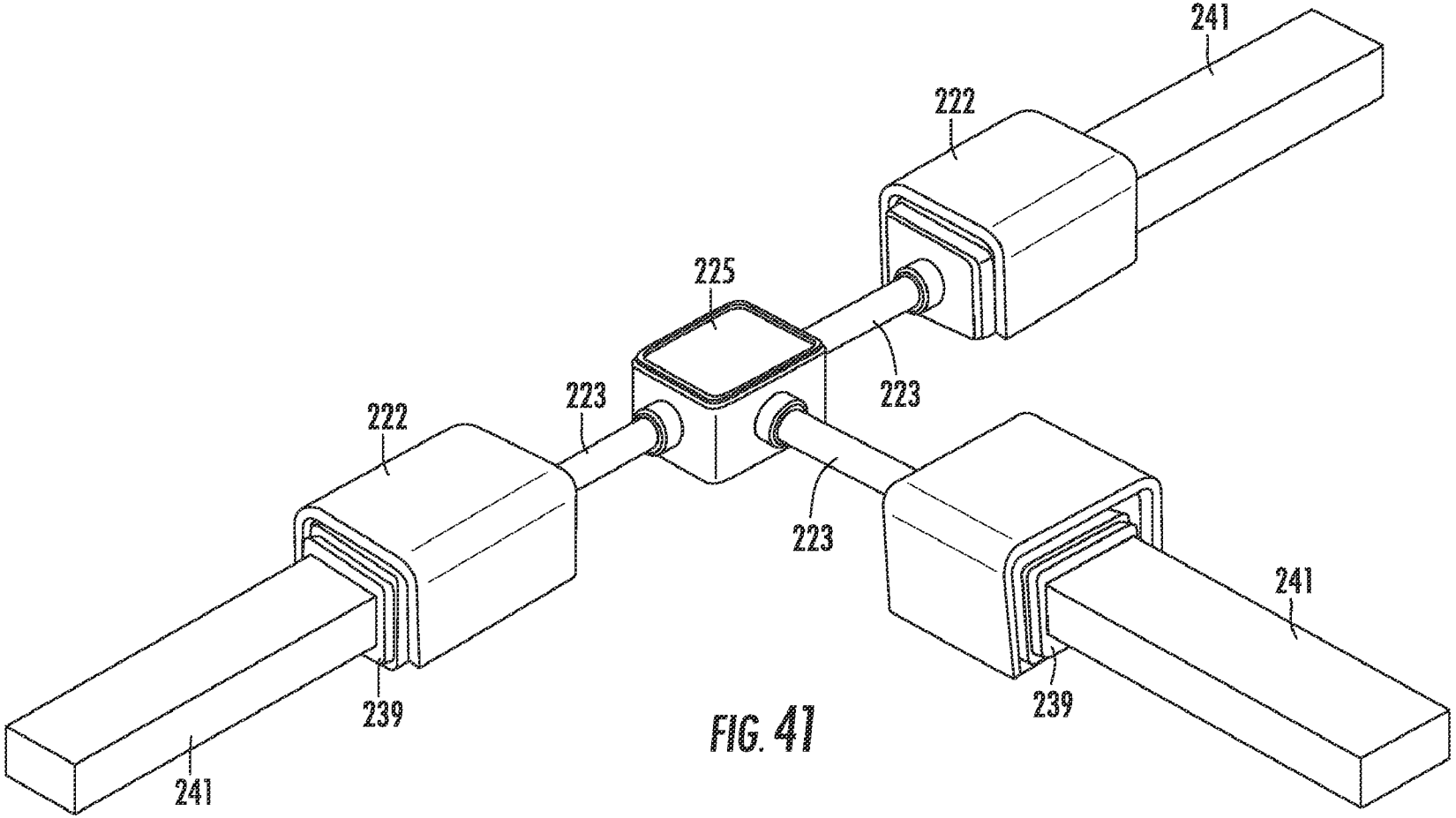
FIG. 47 is an X-ray view of the X-connector in accordance with the ninth embodiment.
Figure 42:
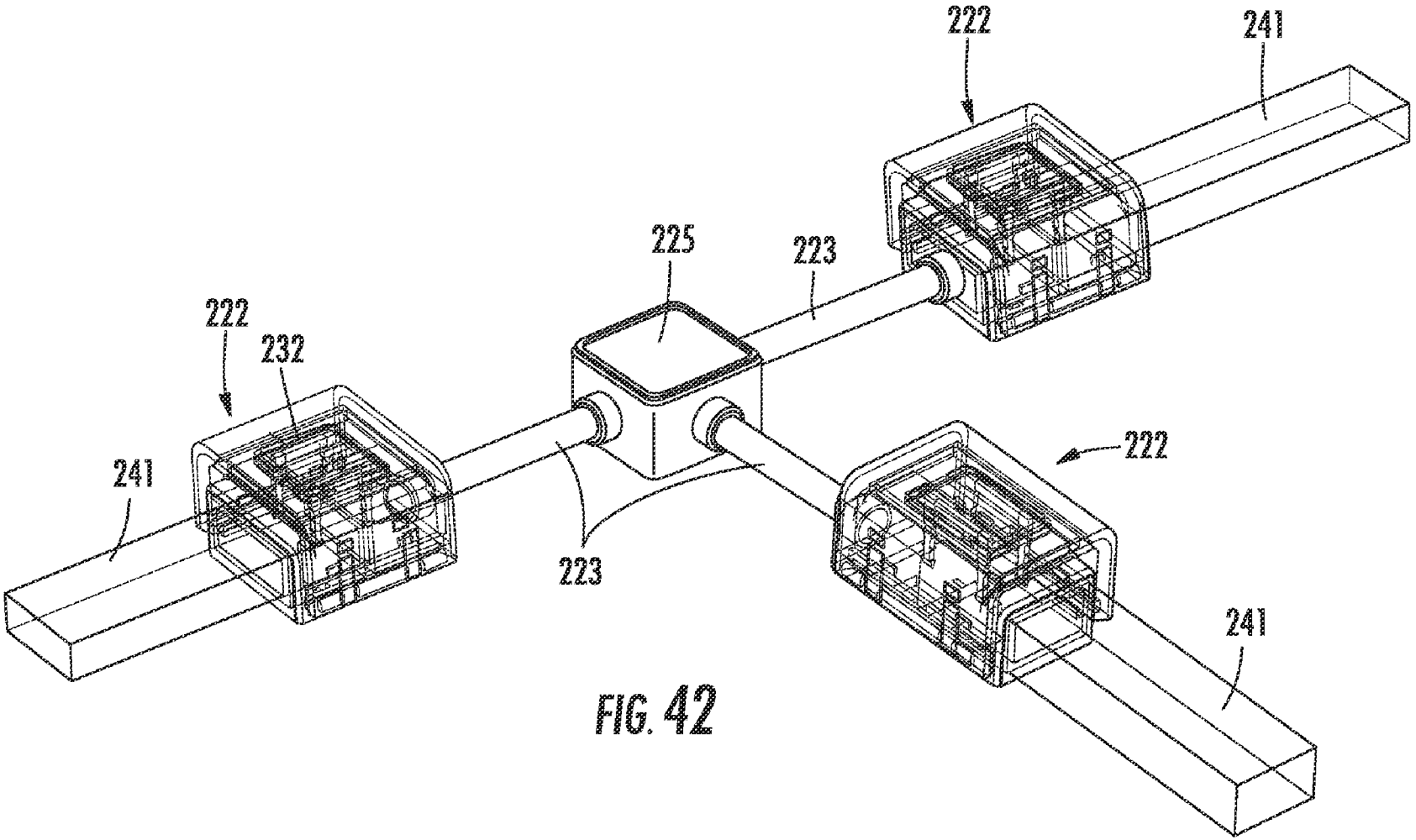
FIG. 42 is an X-ray view of the T-connector in accordance with the eighth embodiment.
Figure 43:
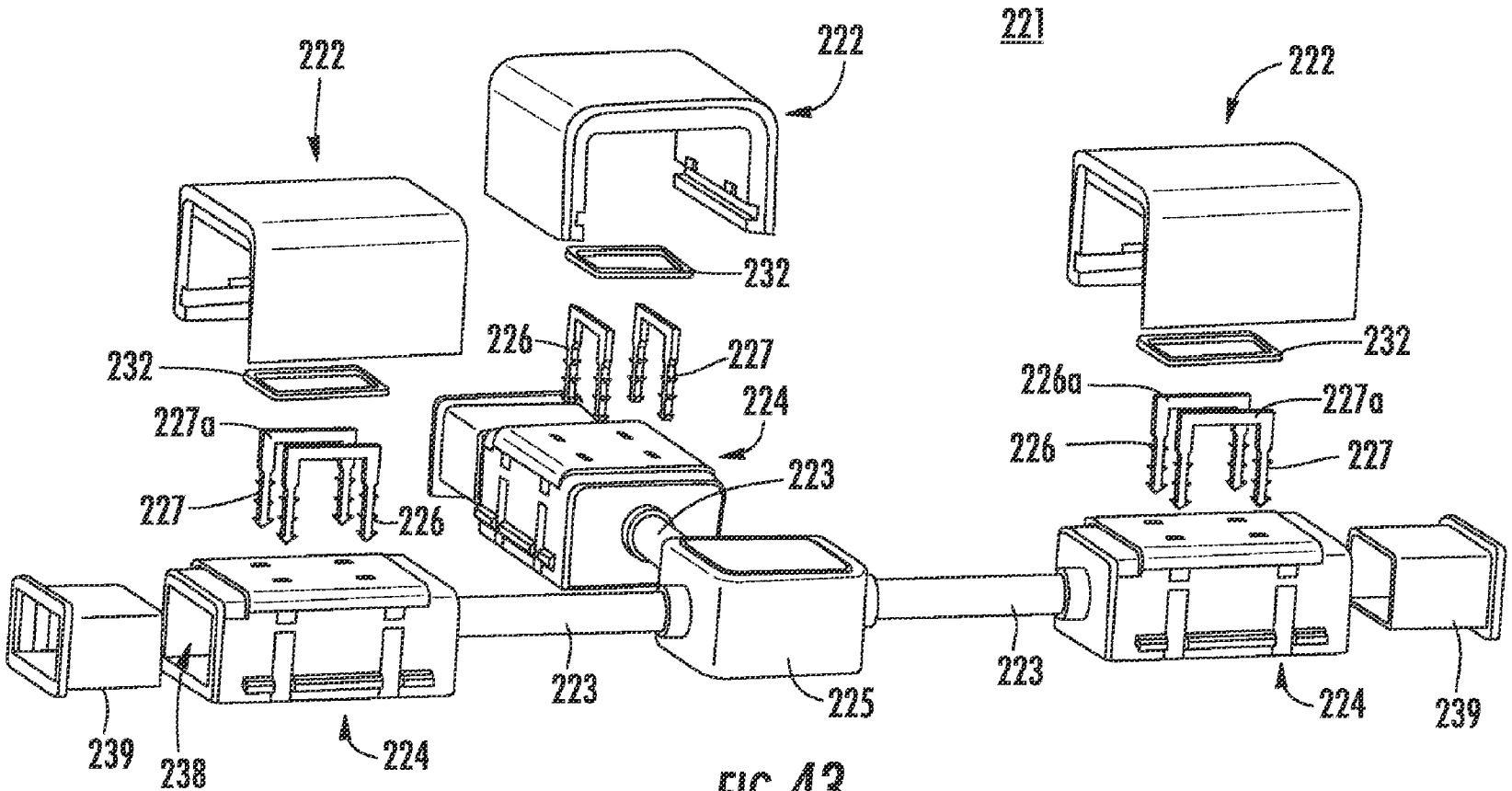
FIG. 43 is an exploded parts view of the T-connector in accordance with the eighth embodiment.
Figure 44:
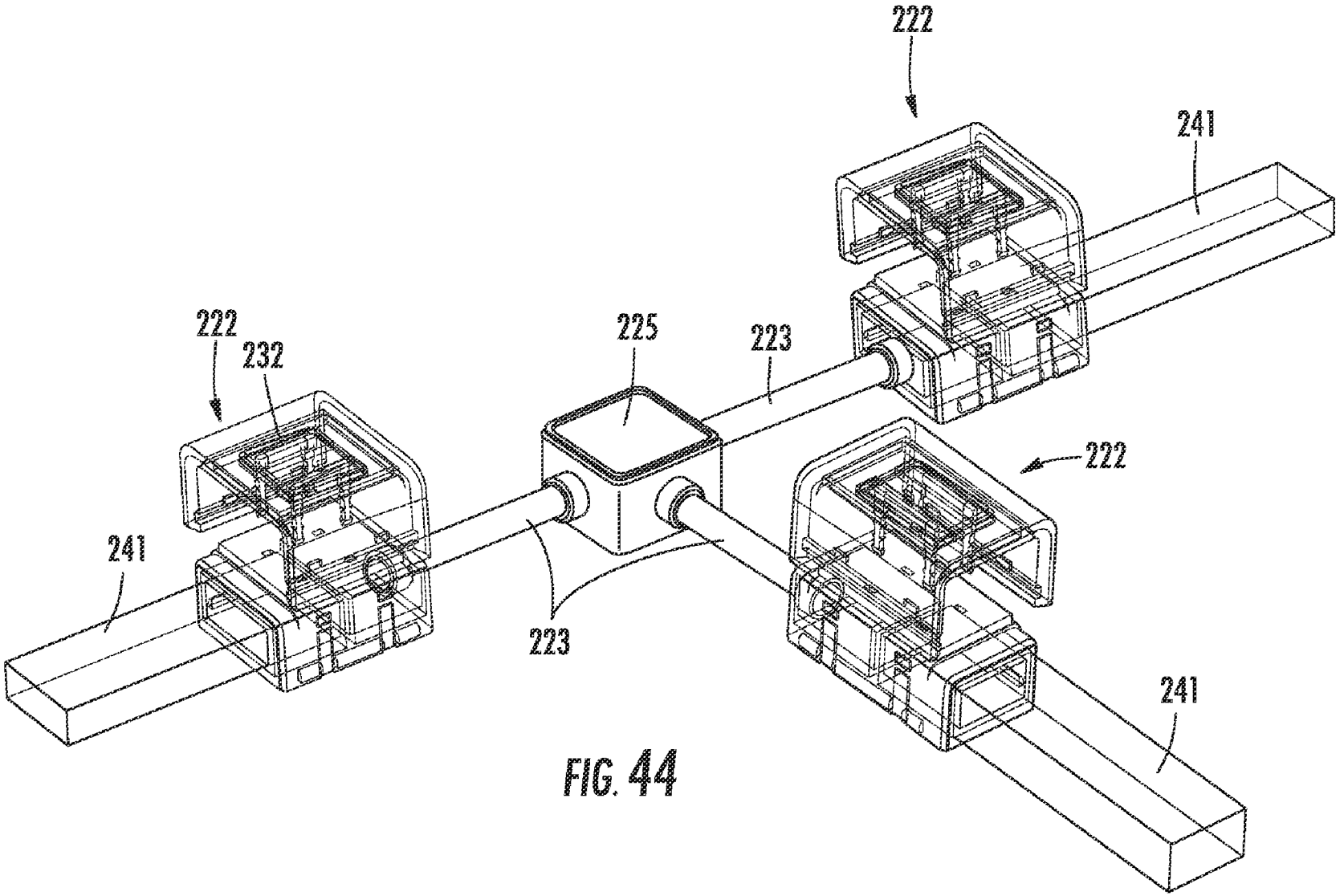
FIG. 44 is another X-ray view of the T-connector in accordance with the eighth embodiment.

Preferably the tips of each connector pin are configured to increase the contact area between the connector pin and a conductive bus of the lighting apparatus, e.g., conductor bus 241*a*, as shown in FIGS. 40A and 40B. To achieve this function, the tip can be in the shape of an inverted "V" or "U."

As in previously described embodiments, for example, when assembling the T-connector 221, and in particular, each of the sets of upper and lower housings, the pressure caused by the coupling of the interlocking groove(s) 230 and tongue(s) 231, as well as the penetration of the connector pins 226 and 227 through the opening gasket 239, and into an encapsulant or protective sheath(es), cover(s) or layer(s) of a lighting apparatus (such as an LED light wire, cable, bar or tube), creates a waterproof seal between the upper housing 222 and the lower housing 224, and between the opening gasket 239 and the lighting apparatus. The gasket 232 provided between the upper and lower housing provides a tighter pressure seal. Further, opening gasket 239, which can be, for example formed of silicone, tightly presses the lighting apparatuses via pressure insertion of the lighting apparatus into the openings 238, and the penetration of the connector pins 226 and 227 into the lighting apparatus.

When the T-connector is assembled, one end of each of the connector pins 226 and 227 penetrate through the encapsulant of each lighting apparatus 241 to make contact with the conductor buses 241*a*. The innermost ones of the connector pins 226 and 227 penetrate into the inner portion of each respective lower housing to make contact with (a) conductive leads that electrically couple with wires in the respective flexible connector extension 223, (b) the wires from the respective flexible connector extension 223, or (c) the wires within the respective flexible connector extension 223 by penetrating through the flexible connector extension 223 and contacting the wires within the flexible connector extension 223. Each flexible connector extension 223 can have one or more wires electrically coupled to the conductive leads in the inner portion of the lower housing. Flexible connector extension 223 can have one or more wires electrically coupled to the conductive leads in the inner portion of the lower housing. Each of the possible connections described above causes an electrical connection to be formed between any of the conductor buses 241*a* of the three lighting apparatuses to permit an electrical signal and/or power to pass between the three conductor buses 241*a*. In one alternative embodiment, the connector pins that couple directly or indirectly with the wires in flexible connector extension 223 are U-shaped at the tip.

The T-connecting portion 225 preferably includes connections so as to facilitate power and/or signal connections between one or more of the three housings and lengths of lighting wire. The internal wiring connections can be, for example, configured to permit signals to travel directly across, i.e., to the lighting wire on the opposite side of the connector, signals to travel at a right angle, to a lighting wire at right angles to a given housing, and/or to both of the other lighting wires connected to the T-connector. The configuration of the wires inside of the T-connecting portion for performing each of these connection functions can be done in any manner of connection know to those of skill in the art. The T-connector as described above advantageously permits lighting apparatuses (such as an LED light wire, cable, bar or tube) to be more easily adjusted, permitting three different angles of tilt of the connected light wires to cope with various installation needs.

As shown in FIGS. 45A-49, in accordance with an ninth preferred embodiment, an X-connector 251 is formed from four upper housings 252, four lower housings 254, an X-connecting portion 255, and four preferably flexible connector extensions 253 formed so as to electrically connect each of the lower housings 254 with the X-connecting portion 255, and with desired other ones of the lower housings 254. As can be seen in the figures, the upper and lower housings and flexible connector extensions in this embodiment are substantially the same as those described above with reference to the T-connector embodiment. However, in the X-connector embodiment, there are four sets of housings and each of the four lower housings 254 is connected to an X-connecting portion, instead of to a T-connecting portion.

As in the first through eighth embodiments, connector pins 256 and 257 are provided in each upper housing 252. The connector pins 256 and 257 have embedded portions 256*a* and 257*a*, respectively formed in the upper housing.

The upper housings 252 and the lower housings 254 are each substantially the same as the upper and lower housings described above with reference to the T-connector embodiment. The difference between X-connector 251 and the T-connector is that instead of there being three sets of upper and lower housings, in the X-connector 251, each of four sets of upper and lower housings has a flexible connector extension 253 connected to an X-connecting portion 255, which is itself connected to three other sets of upper and lower housings.

The provision of the X-connecting portion 255 allows four sets of upper and lower housings to connect with one another, enabling the connection of four lengths 271 of lighting apparatus.

Just as in the embodiments discussed above, each upper housing 252 includes interlocking groove(s) 260. The interlocking groove(s) 260 mate with interlocking tongue(s) 261 in the lower housing 254 to achieve a secure connection, e.g., a snap fit, between the upper and lower housing when the connector is assembled. A gasket 262 is provided between the upper and lower housings and is used to ensure a tight fit of the housings when the connector has been assembled.

The lower housings 254 each includes plural connector pin guide holes 264, and openings 268. An end portion of a length of lighting apparatus 271 is inserted into the openings 268 of each lower housing, as can be seen particularly in FIGS. 45A to 47 and 49. An opening gasket 269 lines each opening 268 in each lower housing. The opening gasket 269 prevents water leaking between the lower housing 254 and the lighting apparatus inserted into the opening 268.

To assemble the X-connector 251, each upper housing 252 is coupled with its corresponding lower housing 254 via the corresponding interlocking groove(s) 260 and tongue(s) 261. When pressing the upper housing 252 and the respective lower housing 254 together, the connector pins 256 and 257 on each upper housing are matched with their corresponding connector pin guide holes 264 on the corresponding lower housing. The connector pins/connector pin guide holes guides the upper housing and lower housing in a manner which permits easy coupling of the corresponding interlocking groove(s) and tongue(s).

Figure 45A:
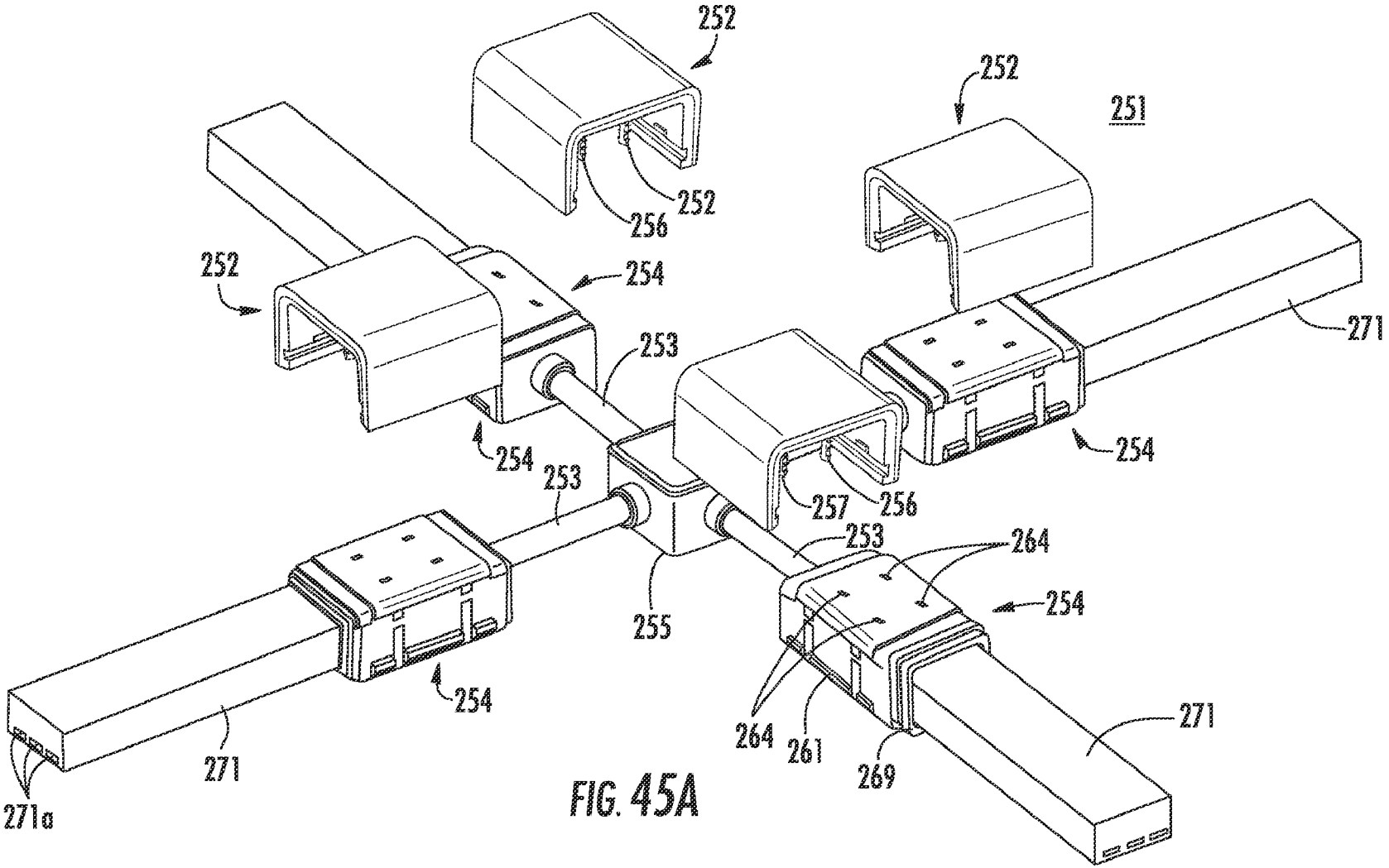
FIGS. 45A and 45B are perspective views of an X-connector in accordance with a ninth embodiment of the present invention, FIG. 45B being an X-ray view.
Figure 45B:
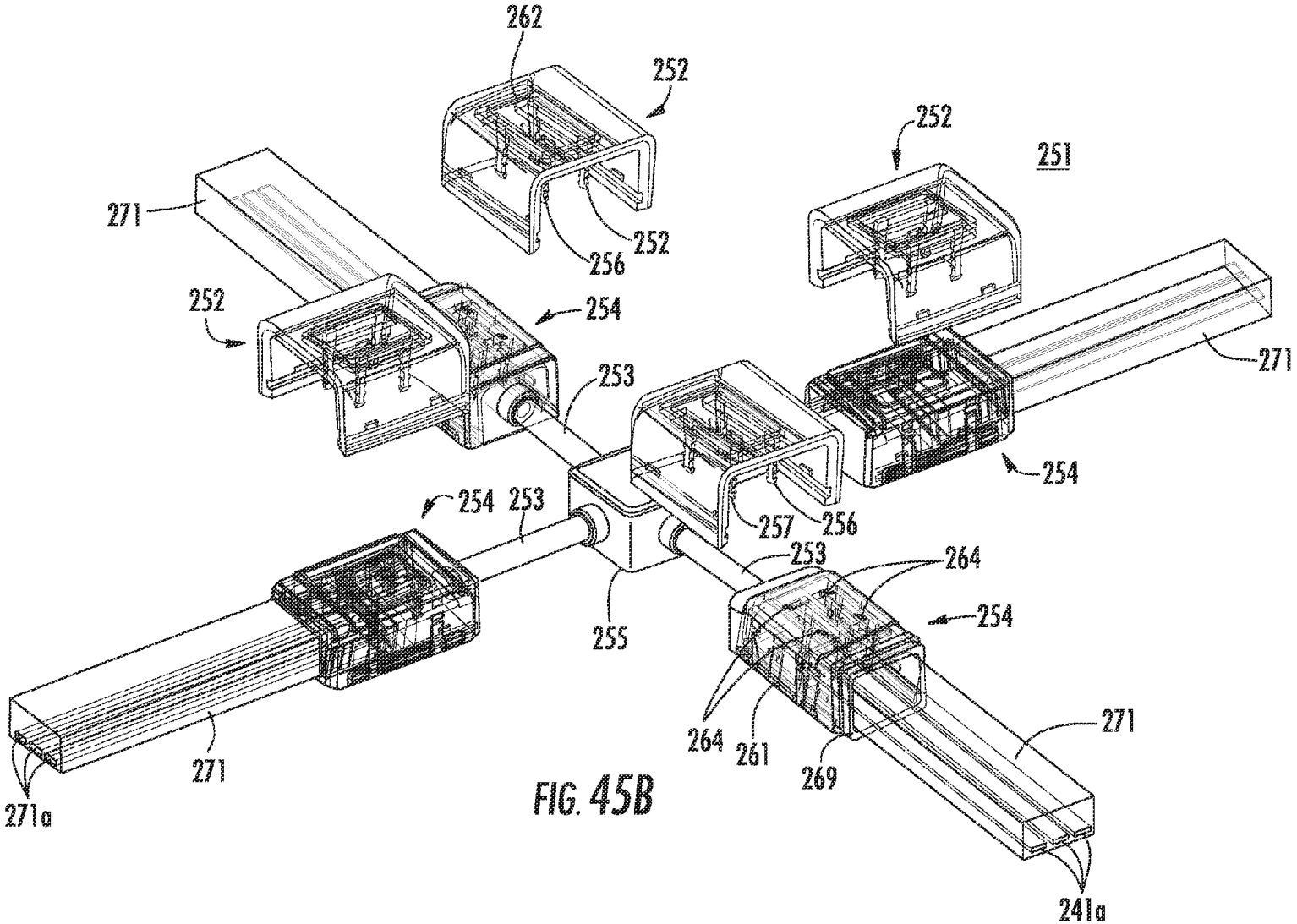
Figure 46:
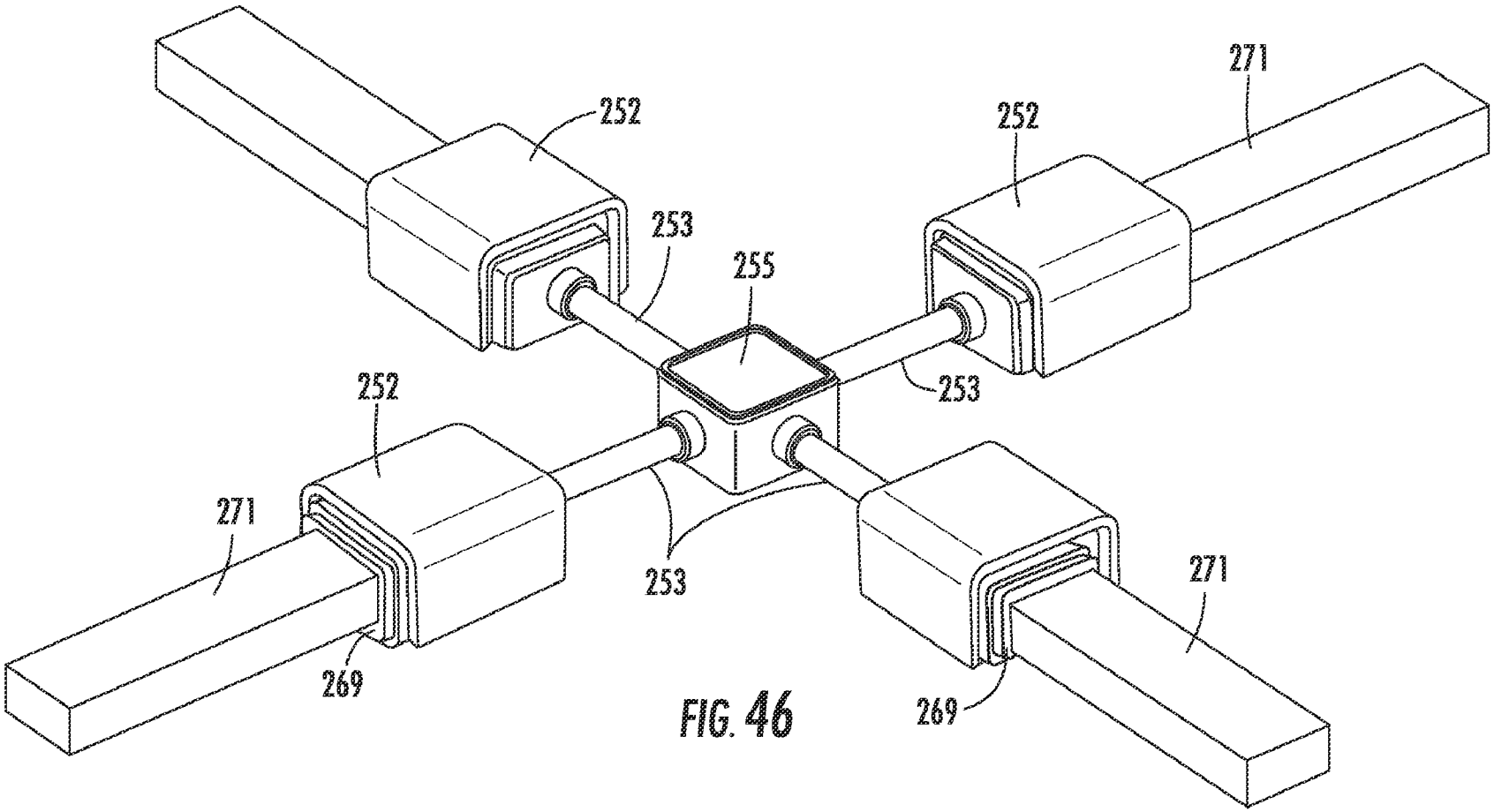
FIG. 46 is a perspective view of an X-connector in accordance with the ninth embodiment.
Figure 47:
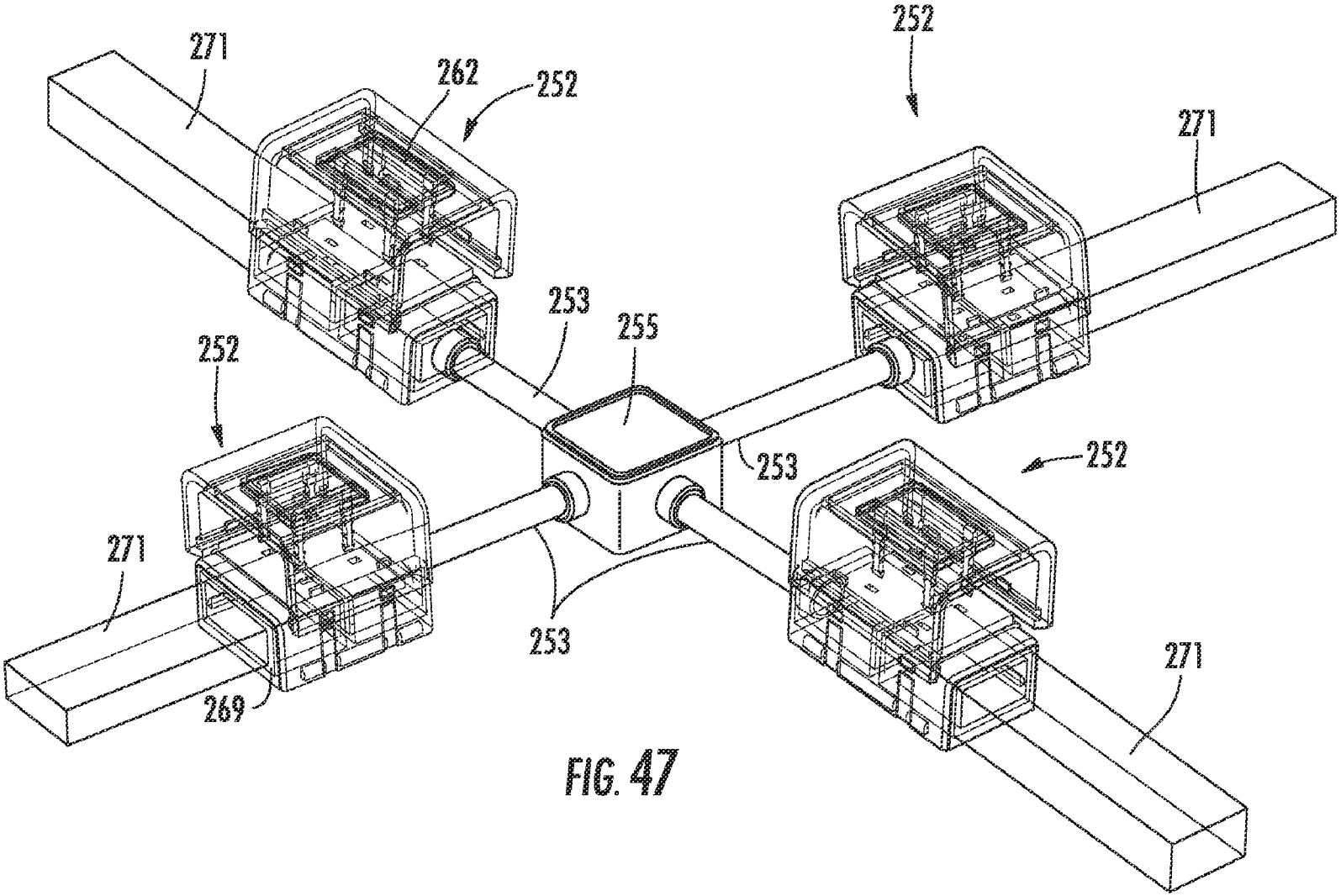
Figure 48:
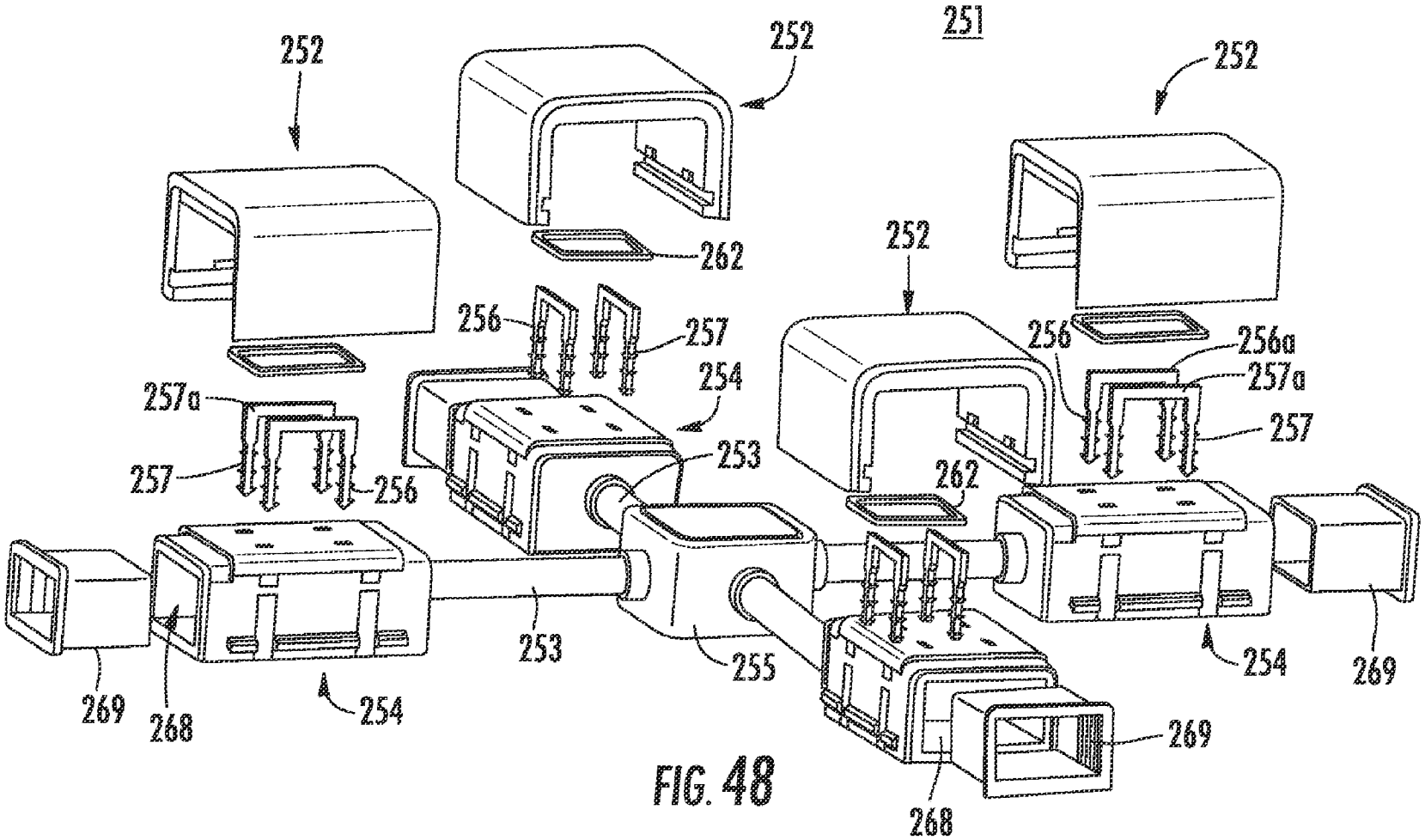
FIG. 48 is an exploded parts view of the X-connector in accordance with the ninth embodiment
Figure 49:
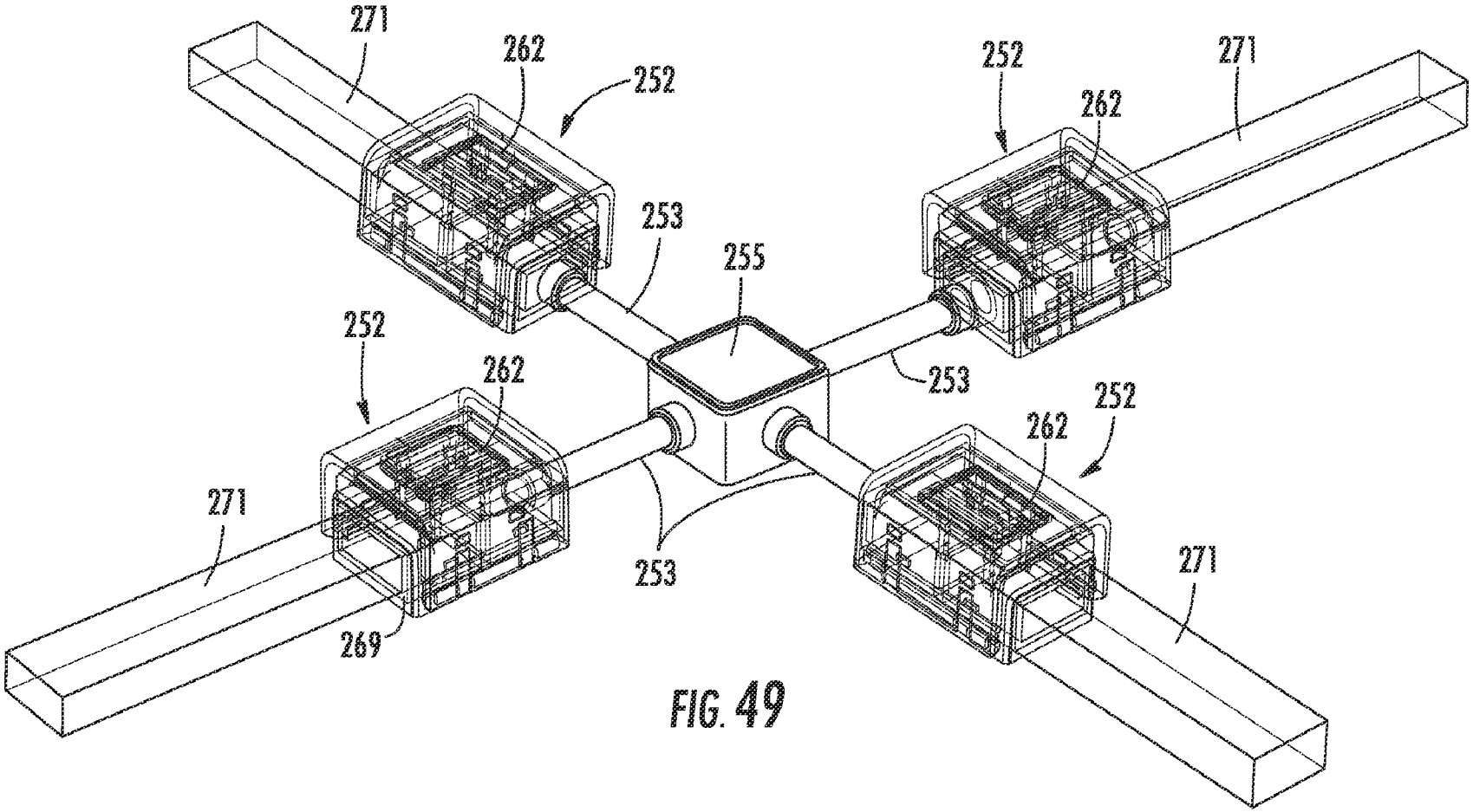
FIG. 49 is another X-ray view of the X-connector in accordance with the ninth embodiment.

Preferably the tips of each connector pin are configured to increase the contact area between the connector pin and a conductive bus of the lighting apparatus, e.g., conductor bus 271*a*, as shown in FIGS. 45A and 45B. To achieve this function, the tip can be in the shape of an inverted "V" or "U."

As in previously described embodiments, for example, when assembling the X-connector 221, and in particular, each of the sets of upper and lower housings, the pressure caused by the coupling of the interlocking groove(s) 260 and tongue(s) 261, as well as the penetration of the connector pins 256 and 257 through the opening gasket 269, and into an encapsulant or protective sheath(es), cover(s) or layer(s) of a lighting apparatus (such as an LED light wire, cable, bar or tube), creates a waterproof seal between the upper housing 252 and the lower housing 254, and between the opening gasket 269 and the lighting apparatus. The gasket 262 provided between the upper and lower housing provides a tighter pressure seal. Further, opening gasket 269, which can be, for example, formed of silicone, tightly presses the lighting apparatuses via pressure insertion of the lighting apparatus into the openings 238, and the penetration of the connector pins 256 and 257 into the lighting apparatus.

When the X-connector is assembled, one end of each of the connector pins 256 and 257 penetrate through the encapsulant of each lighting apparatus 271 to make contact with the conductor buses 271*a*. The innermost ones of the connector pins 256 and 257 penetrate into the inner portion of each respective lower housing to make contact with (a) conductive leads that electrically couple with wires in the respective flexible connector extension 253, (b) the wires from the respective flexible connector extension 253, or (c) the wires within the respective flexible connector extension 253 by penetrating through the flexible connector extension 253 and contacting the wires within the flexible connector extension 253. Each flexible connector extension 253 can have one or more wires electrically coupled to the conductive leads in the inner portion of the lower housing. Flexible connector extension 253 can have one or more wires electrically coupled to the conductive leads in the inner portion of the lower housing. Each of the possible connections described above causes an electrical connection to be formed between and among any of the conductor buses 271*a* of the four lighting apparatuses to permit an electrical signal and/or power to pass between the four lighting apparatuses. In one alternative embodiment, the connector pins that couple directly or indirectly with the wires in flexible connector extension 223 are U-shaped at the tip.

The X-connecting portion 255 preferably includes connections so as to facilitate power and/or signal connections between one or more of the four housings and lengths of lighting wire. The internal wiring connections can be, for example, configured to permit signals to travel directly across, i.e., to the lighting wire on the opposite side of the connector, signals to travel at a right angle, to a lighting wire at right angles to a given housing, and/or to both or all three of the other lighting wires connected to the X-connector. The configuration of the wires inside of the X-connecting portion for performing each of these connection functions can be done in any manner of connection know to those of skill in the art. The X-connector as described above advantageously permits lighting apparatuses (such as an LED light wire, cable, bar or tube) to be more easily adjusted, permitting four different angles of tilt of the connected light wires to cope with various installation needs.

When creating a lighting system with one or more lighting connector devices, at least two segments of a lighting apparatus (such as an LED light wire, cable, bar or tube) are inserted into their respective opening or slot in the lower housing, and then the upper housing is pressed onto the lower housing. The connector pins will penetrate the encapsulant, protective sheath(es), cover(s) or layer(s) of the segments of the lighting apparatus, and will electrically connect with the conductive buses of the lighting apparatus; thereby, electrically connecting the segments.

An objective of the present invention in accordance with the above exemplary embodiments is to provide easy-to-assemble connector devices which electrically and mechanically connect segments of a hard and/or flexible lighting apparatus, such as an LED light wire, cable, bar or tube. The connector devices are for indoor and outdoor use.

The present invention relates to a lighting connector device which has a housing, the housing comprising an upper housing, the upper housing having a plurality of connector pins, an upper housing gasket and at least one receiving interlocking groove; a lower housing coupled to the upper housing by at least one interlocking groove on the upper housing coupled to at least one interlocking tongue on the lower housing, the lower housing comprising a plurality of connector pin guide holes, at least one gasket groove, at least one opening, at least one opening gasket within the at least one opening, and at least one interlocking tongue. The location of the interlocking grooves and tongues are interchangeable—for example, the interlocking grooves and tongues can be located on the lower housing and upper housing, respectively, or a combination thereof.

Preferably, the upper and lower housings of the above-described embodiments are made of a thermoplastic, such as polypropylene ("PP"), polyethylene ("PE"), acrylonitrile butadiene styrene ("ABS")) or the like.

The gaskets provided between the housing, and opening gaskets are preferably made of water-resistant rubber (such as silicone or the like), plastic, foam or any other water-resistant material known in the art. The preferred water-resistant material for the upper housing gasket and opening gasket is a silicone. The upper housing gasket or opening gasket can be a stand-alone part or molded with the upper housing or the opening using methods known in the art, e.g., double injection with the upper housing or lower housing. With respect to the opening gasket, it may cover all or part of the interior of the opening. The upper housing can have a groove which houses an upper housing gasket.

Opening gaskets may be optional since the openings (e.g., opening 28, 58, 88, 118, 148, 178, 208) of the present invention can be made to create a tight fit with a lighting apparatus.

The connector pins are made of electrically conductive material (such as copper, steel, or copper clad steel). The electrically conductive material can be electroplated with tin to improve conductivity and prevent oxidation. The connector pins may, for example, be barbed in order to better penetrate any encapsulant or protective sheath(es), cover(s) or layer(s) of a lighting apparatus (such as an LED light wire, cable, bar or tube), and to prevent the connector pins from sliding out from their respective penetration points, hence allowing the connector pins to maintain electrical contact with the conductive buses of the lighting apparatus, while securing the coupling of the upper housing and lower housing. The connector pins can be insert-molded to the upper housing for maximum durability.

Figure 50:
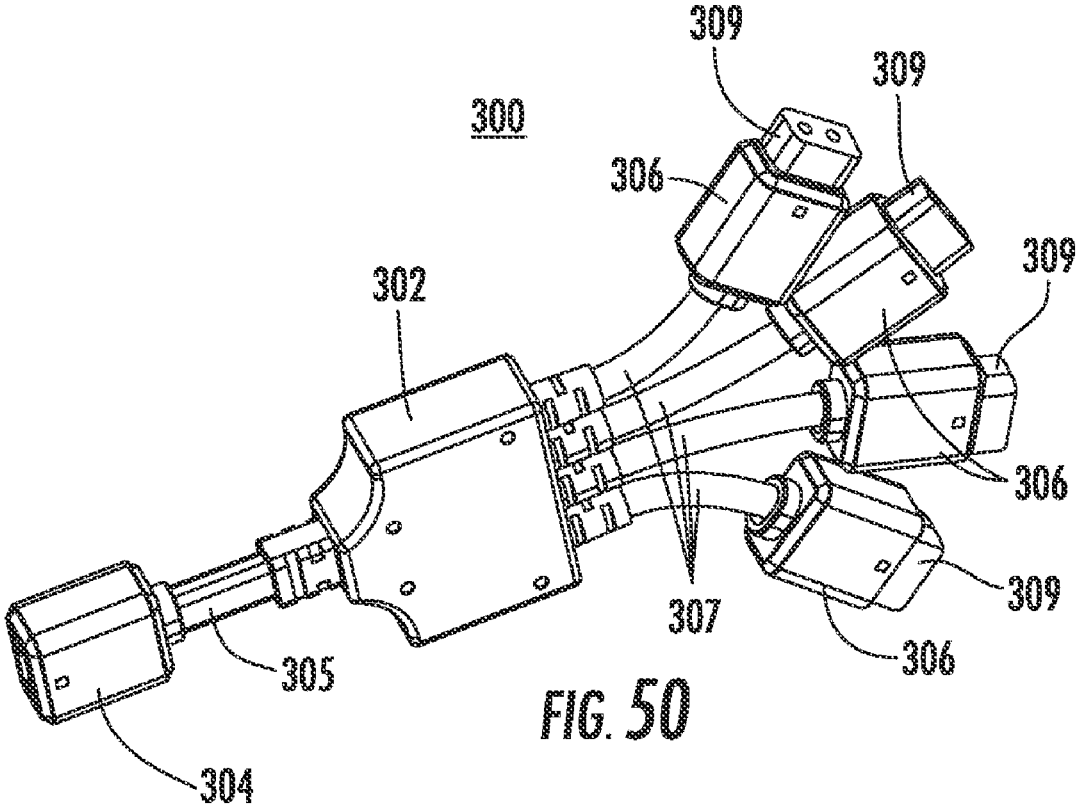
FIG. 50 is a perspective view of a power splitter in accordance with another aspect of the present invention.
Figures 51A, 51B:
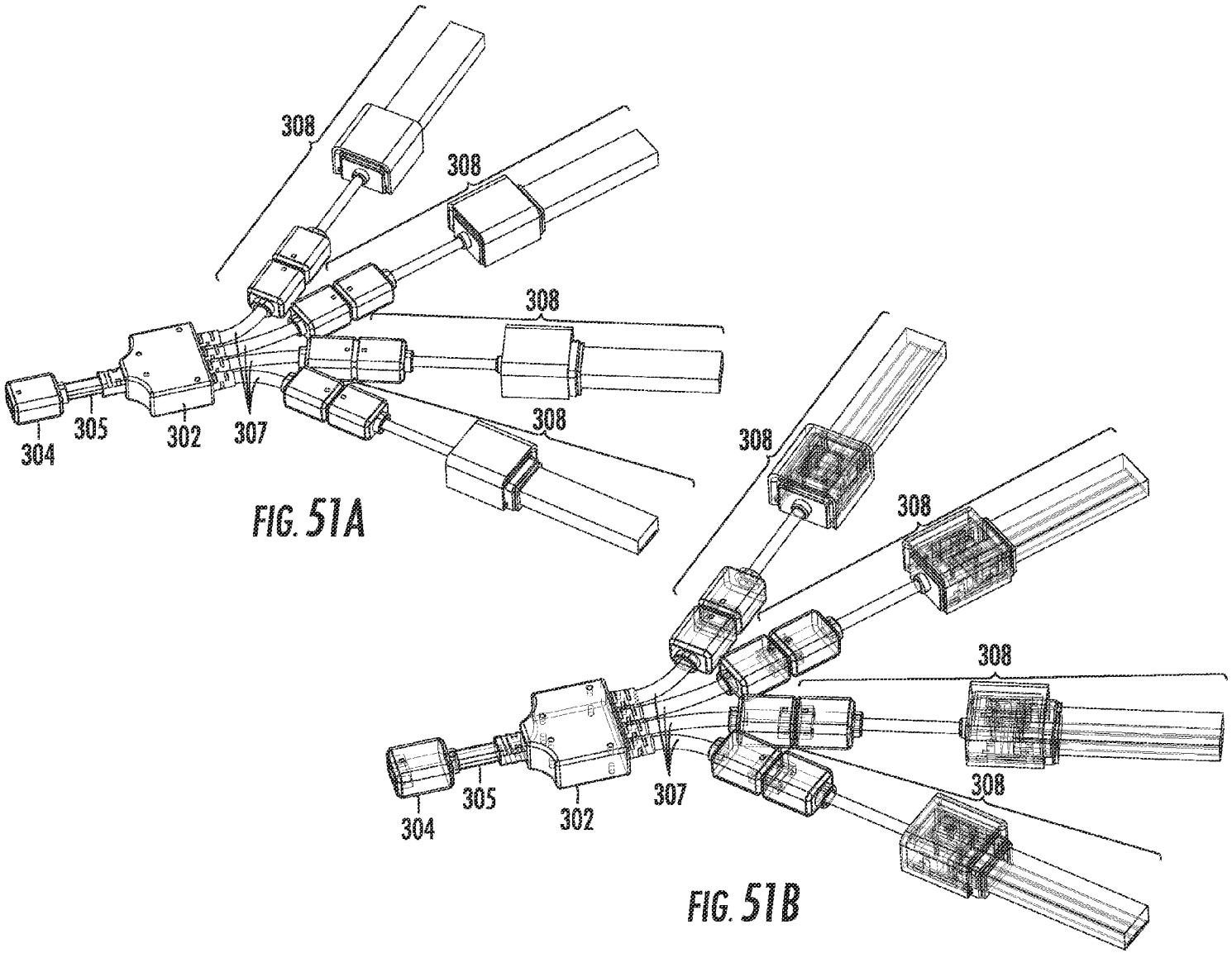
Figure 52:
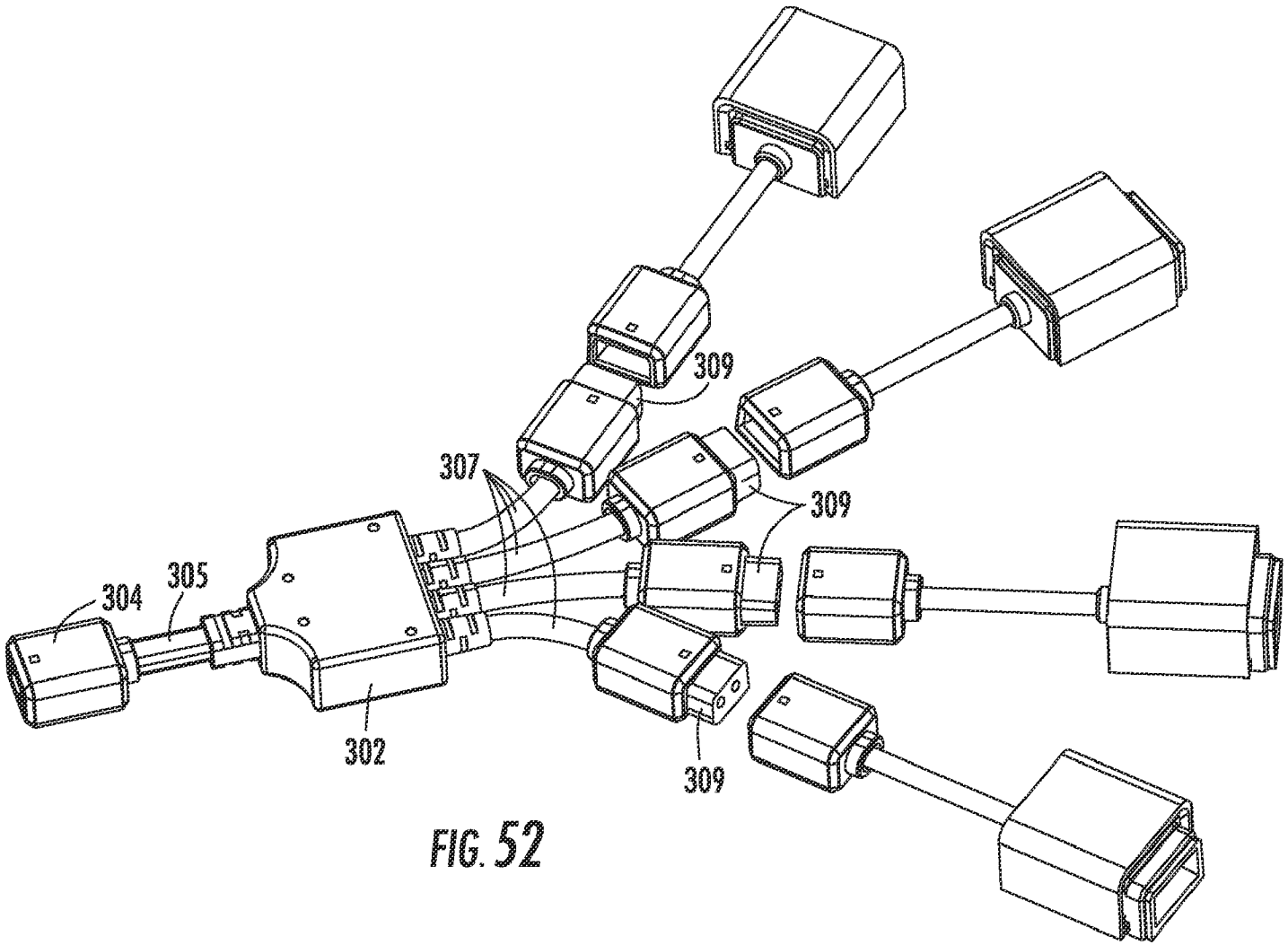

A multi-way splitter for application of power and/or other electrical signals to flexible lighting apparatuses is shown in FIGS. 50-52. Multi-way splitter 300 includes a splitter section 302, which includes internal wiring and electrical parts for splitting power and/or other signals received from power/signal plug 304 and distributing it to connectors 306, which are connected to the splitter section 302 by e.g., flexible cabling 307. The power/signal plug 304 is connected to the splitter section 302 by, e.g., a flexible cable 305. Connector ends 309 are provided at the end of each connector 306 to provide the ability to connect the power and/or signals produced by the splitter 300 to multiple components for supplying signals and/or power for lighting. In the illustrated embodiment, the number of connectors is 4, but the invention is not limited to this number and may be two or more.

FIGS. 51A, 51B and 52 illustrate how the multi-way splitter can be used in supplying power and/or signals to lighting apparatuses 308. Each of lighting apparatuses 308 shown in the figure is substantially identical to power source-extender connector 190 of the seventh embodiment, shown in FIGS. 34-37 above, the detailed description of each of which will not be repeated here. As can be seen in the figures, a number of lighting apparatuses (power source-extender connectors) 308 can be connected to the plural connectors 306 and thereby coupled to a single power/signal source plug 304. Each connector 306 preferably includes a coupling portion 309 that preferably snugly mates with a corresponding portion of the lighting apparatus 308. Although the multi-way splitter can be used for supplying power to the power source-extender embodiment described above, it is not limited to being used for this particular lighting apparatus, and may be used to supply power/signals to any lighting apparatus.

The internal wiring and components of the splitter section 302 used for splitting the power can be made in any manner known to those of skill in the art for splitting an electrical signal, including, for example, passive signal splitting, or splitting with amplification. Splitting of the signals to the connectors 306 via, e.g., flexible cabling 307 permits plural lighting apparatuses, such as an LED light wire, cable, bar or tube, in apparatuses 308, to be placed in parallel for brighter displays.

Figure 53A:
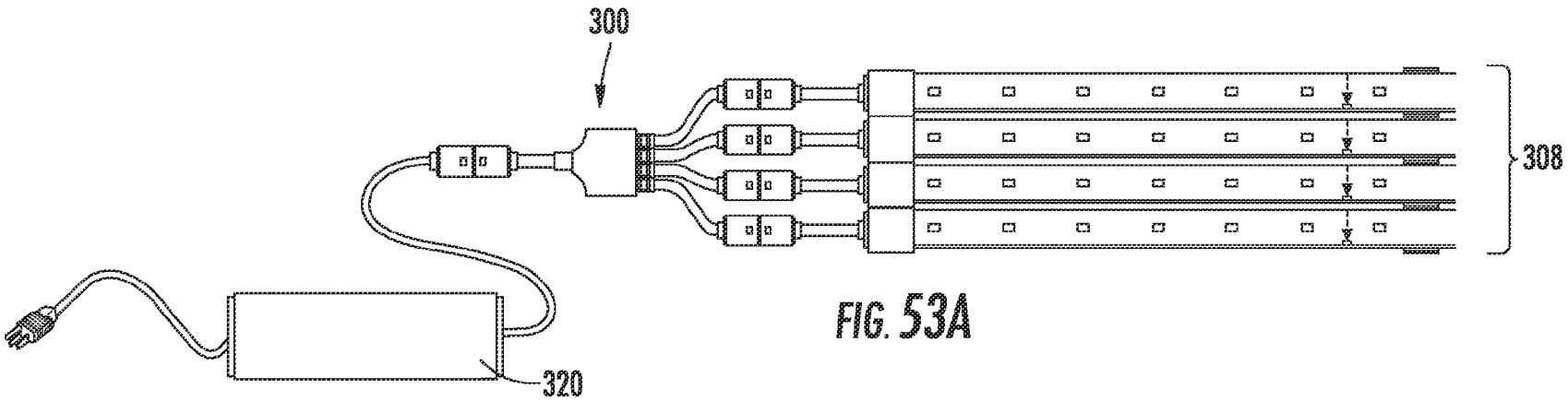
FIGS. 53A-53C are diagrams showing the power splitter connected to a power source, and connected to plural lighting apparatuses according to the seventh embodiment of the present invention.
Figure 53B:
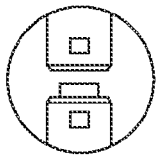
Figure 53C:
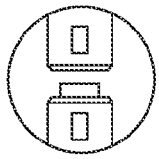

FIG. 53A is a diagram showing the multi-way splitter used to supply power from a power supply 320 to lighting apparatuses 308. FIGS. 53B and 53C are close up views of the plug connections between the multi-way splitter and the lighting apparatuses 308. Of course, the invention is not limited to the disclosed embodiment and the connection may be made in any known manner for electrical connection.

The lighting apparatuses connected together by the connectors of the disclosed embodiments may be, for example, light wire, cable, bar or tube, such as, but not limited to:

CabLED™ from OptiLED Lighting International Ltd. (http://cabled.optiled.com/; http//cabled.optiled.com/MyImage/image/Web/CabLED%20brochure%20final.pdf);

Rigid Light Strip™ from Light Engine Ltd. (http://www.lightengine-tech. com/en/generallighting 3_detail.asp?ID=38&CATID=38; http://www.lightengine-tech.com/upload/PRODUCTG_PL38.pdf); and Flexible Light Strip™ from Light Engine Ltd. (http://www.lightengine-tech.com/en/generallighting3_detail.asp?ID=40&CATID=40; http://www.lightengine-tech.com/upload/PRODUCTG_PL40.pdf).

The lighting apparatuses can be solid-state lighting apparatuses, including, but not limited to LED lighting apparatuses.

Although specific preferred embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that the present invention be limited only by the claims and the equivalents thereof.

What is claimed is:

1. A multi-way connector for connecting a plurality of lighting apparatuses together, the multi-way connector comprising:

(a) a plurality of lighting connectors, each lighting connector comprising:

(i) an upper housing having:
plural connector pins, and
one or more interlocking grooves; and (ii) a lower housing, the lower housing having a plurality of connector pin guide holes, and one or more interlocking tongue portions, the lower housing being connectable with the upper housing to form each lighting connector by coupling at least one of the one or more interlocking grooves with at least one of the one or more interlocking tongue portions, and by coupling at least one of the plural connector pins with at least one of the connector pin guide holes;

(b) a multi-way connecting portion configured to permit power and/or signals to pass between and among the plurality of lighting connectors; and (c) plural flexible connectors electrically connecting an inner side of each lower housing with the multi-way connecting portion;

wherein the multi-way connector is an I-connector configured to connect two lighting connectors.

2. The multi-way connector according to claim 1, wherein each of the plural connector pins comprises an embedded portion situated within the upper housing, and plural protruding portions, at least one of the protruding portions being configured to couple with a respective corresponding one of the at least one connector pin guide holes.

3. The multi-way connector according to claim 2, each lower housing further comprising at least one opening for receiving an end portion of a length of lighting apparatus.

4. The multi-way connector according to claim 3, further comprising in each lower housing a gasket in a lining of the at least one opening.

5. The multi-way connector according to claim 4, wherein each of the connector pins are made of an electrically conductive material.

6. The multi-way connector according to claim 4, wherein the embedded portion of each of the connector pins is insert-molded into the upper housing.

7. The multi-way connector according to claim 4, wherein the protruding portions of each of the connector pins comprise a barbed tip, inverted "V" tip, or a "U" tip.

8. The multi-way connector according to claim 4, wherein the upper and lower housings are made of a thermoplastic.

9. A lighting system comprising plural lighting connectors connected together using at least one multi-way connector of claim 1.

* * * * *